US007101658B2

(12) United States Patent
Ohzeki et al.

(10) Patent No.: US 7,101,658 B2
(45) **Date of Patent: *Sep. 5, 2006**

(54) HEAT-DEVELOPABLE PHOTOSENSITIVE MATERIAL AND HEAT-DEVELOPING METHOD USING THE SAME

(75) Inventors: Tomoyuki Ohzeki, Kanagawa (JP); Katsutoshi Yamane, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/238,611

(22) Filed: Sep. 11, 2002

(65) Prior Publication Data

US 2003/0194659 A1 Oct. 16, 2003

(30) Foreign Application Priority Data

Sep. 12, 2001 (JP) ..... 2001-277150
Oct. 31, 2001 (JP) ..... 2001-335613

(51) Int. Cl.
*G03C 1/498* (2006.01)
*G03C 5/16* (2006.01)

(52) U.S. Cl. ..... 430/350; 619/620

(58) Field of Classification Search ..... 430/619, 430/567, 620, 350, 605, 264, 569
See application file for complete search history.

(56) References Cited

U.S. PATENT DOCUMENTS

| | | | | |
|---|---|---|---|---|
| 2,910,377 A | | 10/1959 | Owen | |
| 3,152,904 A | | 10/1964 | Sorensen et al. | |
| 3,457,075 A | | 7/1969 | Morgan et al. | |
| 3,801,321 A | * | 4/1974 | Evan et al. | |
| 4,332,889 A | * | 6/1982 | Siga et al. | 430/583 |
| 4,395,484 A | * | 7/1983 | McCarney | 430/620 |
| 5,656,419 A | * | 8/1997 | Toya et al. | 430/619 |
| 5,998,126 A | * | 12/1999 | Toya et al. | 430/619 |
| 6,090,538 A | * | 7/2000 | Arai et al. | 430/619 |
| 6,143,488 A | | 11/2000 | Uytterhoeven et al. | |
| 6,156,491 A | * | 12/2000 | Goto | 430/619 |
| 6,165,705 A | | 12/2000 | Dankosh et al. | |
| 6,210,869 B1 | * | 4/2001 | Ito | 430/350 |
| 6,395,466 B1 | * | 5/2002 | Katoh et al. | 430/619 |
| 6,413,712 B1 | * | 7/2002 | Yoshioka et al. | 430/619 |
| 6,482,583 B1 | * | 11/2002 | Ikari | 430/619 |
| 6,645,714 B1 | * | 11/2003 | Oya et al. | 430/619 |

FOREIGN PATENT DOCUMENTS

| | | | |
|---|---|---|---|
| EP | 0 922 955 A1 | | 6/1999 |
| JP | 43-4924 B | | 2/1968 |
| JP | 8-297345 A | | 11/1996 |
| JP | 2785129 | | 5/1998 |
| JP | 2000292886 | * | 10/2000 |
| JP | 2001-42472 | * | 2/2001 |
| JP | 2001092075 | * | 4/2001 |
| WO | WO 97/48014 | | 12/1997 |
| WO | WO 97/48015 | | 12/1997 |

* cited by examiner

*Primary Examiner*—Thorl Chea
(74) *Attorney, Agent, or Firm*—Sughrue Mion, PLLC

(57) ABSTRACT

A heat-developable photosensitive material includes at least a photosensitive silver halide particle, a nonphotonsensitive organic silver salt, a developing accelerator, a reducing agent and a binder on a support, wherein the photosensitive silver halide includes silver iodide at 5 mol % to 100 mol % and the average particle size of the photosensitive silver halide is 5 nm to 80 nm. A heat developing method for the heat-developable photosensitive material is also disclosed.

7 Claims, No Drawings

HEAT-DEVELOPABLE PHOTOSENSITIVE MATERIAL AND HEAT-DEVELOPING METHOD USING THE SAME

BACKGROUND OF THE INVENTION

1. Field of the Invention

The present invention relates to a heat-developable photosensitive material and an image forming method using the photosensitive material, and particularly to a heat-developable photosensitive material suitable for medical diagnosis, industrial photographs, and COM, and to a heat developing method using the same.

2. Description of the Related Art

In recent years, there has been a strong desire for decreasing the amount of waste from the viewpoint of environmental protection and space saving in the medical diagnosis film fields and photographic plate-making film fields. As a result, technologies for heat-developable photosensitive materials that are used for medical diagnosis films and photographic plate-making films, which can be efficiently exposed using a laser-image setter or a laser imager, and can form a distinct black image having high resolution and definition, are required. According to the heat-developable photosensitive material, a heat developing system which requires no solution type processing chemical, and which is simple and does not damage the environment, can be supplied to customers.

Though in the general field for image forming materials there is the demand, images for medical diagnosis especially require high image qualities having excellent definition and granularity, because fine drawings are required for medical diagnosis. Further, images having a cold black tone tend to be preferred from the viewpoint of medical diagnostic easiness. At present, a variety of hard copy systems utilizing pigments and dyes such as ink jet printers and electrophotographs are distributed as general image forming systems. However, none of these systems is satisfactory as the output system of medical images.

On the other hand, a heat image forming system utilizing an organic silver salt is described in, for example, respective specifications of U.S. Pat. Nos. 3,152,904 and 3,457,075 and in B. Shely, "Thermally Processed Silver Systems" (Imaging Processes and Materials), Neblette, No. 8 edition, edited by J. Sturge, V. Walworth and A. Shepp, page 2, 1996.

Particularly, a heat-developable photosensitive material generally has a photosensitive layer comprising a reducing agent, a reducible silver salt (e.g., organic silver salts), a photocatalyst (e.g., silver halide), in an amount to be active as a catalyst, and as required, a color tone controlling agent for controlling the tone of the silver. These materials are dispersed in a binder matrix in the layer. The heat-developable photosensitive material is heated at a high temperature (for example, 80° C. or more) after image exposure, and a silver image having a black color is formed by an oxidation-reduction reaction between the reducible silver salt (functions as an oxidizer) and the reducing agent. The oxidation-reduction reaction is facilitated by the catalytic action of a silver halide latent image generated by exposure. Accordingly, the silver image having a black color is formed in the exposed region. The heat-developable photosensitive material is disclosed in many documents such as U.S. Pat. No. 2,910,377 and Japanese Patent Application Publication (JP-B) No. 43-4924. Further, the Fuji Medical Dry Imager FM-DP L, which is a medical image forming system using a heat-developable photosensitive material, has been put on the market.

In a heat type image forming system utilizing an organic silver salt, there is a method in which production is carried out by applying a solvent, and a method in which production is carried out by applying a coating solution containing polymer fine particles comprised as a main binder and dispersed in water, followed by drying. The latter method does not require the steps of recovering the solvent and the like. Therefore, production equipment for the latter method is simple, and the method is advantageous for mass-production.

The image forming system utilizing an organic silver salt does not include a fixing step. Therefore, the system has a large problem concerning image preserving ability after developing, particularly, concerning deterioration of the printout when exposed to light after development. As a method for improving deterioration of the printout, a method utilizing AgI, which is formed by converting an organic silver salt, is disclosed in U.S. Pat. No. 6,143,488 and EP No. 0,922,995. However, such a method in which the organic silver salt is converted using iodine as disclosed in the above cannot obtain sufficient sensitivity and it is difficult to form an actual system.

In addition, there are descriptions concerning photosensitive materials utilizing AgI in WO 97-48014, WO 97-48015, U.S. Pat. No. 6,165,705, Japanese Patent Application Laid-Open (JP-A) No. 8-297345, Japanese Patent No. 2785129 and the like. However, none of these photosensitive materials can attain a sufficient level of sensitivity and fogging and is fit for practical use as a photosensitive material to be exposed with a laser. Therefore, the development of a method in which a silver halide containing a large content of silver iodide can be used has been desired.

SUMMARY OF THE INVENTION

An object of the present invention is to solve the aforementioned problems of the prior art. More concretely, an object of the present invention is to provide a heat-developable photosensitive material having high sensitivity and high image quality wherein the material comprises a silver halide photosensitive material having a high content of silver iodide, and to provide a method using the same.

The above object of the invention is attained by the following heat-developable photosensitive material and heat developing method using the photosensitive material.

Accordingly, a first aspect of the invention is a heat-developable photosensitive material comprising at least a photosensitive silver halide, a nonphotonsensitive organic silver salt, a reducing agent, a developing accelerator and a binder on a support. The photosensitive silver halide includes silver iodide at 5 mol % to 100 mol %; and the average particle size of said photosensitive silver halide is 5 nm to 80 nm.

A second aspect of the invention is a heat developing method for a heat-developable photosensitive material comprising steps of preparing the aforementioned heat-developable photosensitive material and heat-developing the heat-developable photosensitive material at a maximum temperature of 100° C. or more and 120° C. or less.

DESCRIPTION OF THE PREFERRED EMBODIMENTS

The heat-developable photosensitive material according to the present invention will be explained in detail hereinafter.

The heat-developable photosensitive material of the present invention comprises on a support at least a photosensitive silver halide, a nonphotonsensitive organic silver salt, a reducing agent and a binder. The content of a silver iodide comprised in the above photosensitive silver halide is 5 mol % or more and 100 mol % or less, and the average particle size of the above photosensitive silver halide is 5 nm or more and 80 nm or less. Further the heat-developable photosensitive material comprises a developing accelerator.

Photonsensitive Silver Halide

The photosensitive silver halide to be used in the invention will be explained hereinafter.

It is important for the photosensitive silver halide used in the invention that the photosensitive silver halide is an emulsion having a high content of silver iodide such that the content of silver iodide is 5 mol % or more and 100 mol % or less. Generally, a silver halide having a high content of silver iodide has low sensitivity and therefore has a low utility value.

It is preferable that a part of the silver halide in the invention has a phase which absorbs light by direct transition. It is well known that, in an exposure wavelength from 350 nm to 450 nm, which is the exposure wavelength of the invention, the absorption of light obtained by direct transition can be achieved by having a high-silver iodide-content structure which has either a hexagonal system wurtzite structure or cubic system zincblende structure. However, silver halides such as above absorption structures have low sensitivity and low utility value from the stand point of the photographic industry.

The inventors of the invention have studied and found that it is possible to accomplish high sensitivity and definition of a photosensitive material having a high content of silver iodide by adding a developing accelerator according to the invention to a heat-developable photosensitive material having a nonphotonsensitive organic acid silver salt and a heat developer.

Also, according to the studies, the silver halide is preferably 80 nm or less in size. The effect of the present invention is clearly exhibited particularly in the case of using such a silver halide having a small particle size.

The silver halide used in the invention will be explained hereinafter.

The content of silver iodide comprised in the silver halide in the invention is 5 mol % or more and 100 mol % or less. The content of the silver iodide is preferably 10 mol % or more and 100 mol % or less, more preferably 40 mol % or more and 100 mol % or less, still more preferably 70 mol % or more and 100 mol % or less, and most preferably 90 mol % or more and 100 mol % or less.

As the distribution of the halogen composition in the above silver halide particle, it may be uniform or varied stepwisely or continuously. Further, a silver halide particle having a core/shell structure may be preferably used. The core/shell structure is preferably a double to quintuple structure, and more preferably a double to quadruple structure.

Although there is a limitation of the solid-solubility of iodine for other halogen compositions, the content of iodine can be arbitrarily determined by adopting a junction structure or a core/shell structure as described above.

Preferably, the photosensitive silver halide of the invention has a direct transition absorption, which is derived from a silver iodide crystal structure, in a wavelength range of from 350 nm to 450 nm. Whether or not these silver halides have photo-absorption due to direct transition can be easily determined by finding the excitation absorption, which results from direct transition, in or in the vicinity of the wavelength range of 400 nm to 430 nm.

A phase of a high content of a silver iodide, which is a direct transition photo-absorption type, may exist independently. It is also preferable that the phase exists in a state such that the phase is joined with a silver halide showing indirect transition absorption in a wavelength range of 350 mm to 450 mm, such as a silver bromide emulsion, a silver chloride emulsion, a silver bromoiodide emulsion, a silver chloroiodide emulsion and a mixed crystal thereof.

Further, the silver iodide phase also preferably can take a core/shell structure as described above or an indefinite structure due to a conversion of an iodaine ion.

The average content of total silver iodide in these cases is preferably 5 mol % or more and 100 mol % or less, more preferably 10 mol % or more and 100 mol % or less, still more preferably 40 mol % or 100 mol % or less, particularly preferably 70 mol % or more and 100 mol % or less, and most preferably 90 mol % or more and 100 mol % or less.

Such a silver halide phase, which absorbs light by direct transition, generally shows strong photo-absorption. However, the silver halide phase has lower sensitivity than a silver halide phase that shows only weak photo-absorption by indirect transition. Therefore the silver halide phase that absorbs light by direct transition is not utilized industrially.

In order to the overcome the problems, the inventors found that desirable sensitivity is obtained by using a developing accelerator for a heat-developable photosensitive material containing such a silver halide phase.

The silver halide used in the invention exhibits more desirable characteristics when its particle size is 5 nm or more and 80 nm or less. In particularly the case of a silver halide particle, wherein a phase which shows a direct transition photo-absorption exists, high sensitivity is exhibited when its particle size is 80 nm or less.

The above particle size is preferably 5 nm or more and 70 nm or less and more preferably 10 mm or more and 50 nm or less. The particle size here means a diameter of a circular image which is obtained by converting the silver halide particle into the circular image so as to have the same area as a projected area of the silver halide particle to be measured (a projected area of a primary plane in the case of a plane particle).

The forming methods of a photosensitive silver halide are well known in this field. The methods described in, for example, Research Disclosure No. 17029, June (1978), and U.S. Pat. No. 3,700,458 may be used. Specifically, a method is used in which a silver-donating compound and a halogen-donating compound are added to a solution of gelatin or other polymer to thereby prepare a photosensitive silver halide, and then it is mixed with an organic silver salt. Also, a method described in JP-A No. 11-119374, paragraph nos. 0217 to 0224, and methods described in JP-A No. 11-98708 and JP-A No. 2000-42336 are preferable.

Examples of the shape of the silver halide particle include cubic, octagonal, plane particle, spherical particle, bar-like particle and potato-like particle. In the present invention, a cubic particle is particularly preferable. Silver halide particles wherein the corners thereof are rounded are also preferably used. Particular limitations are not imposed on the surface index (Miller indices) of the external surface of the photosensitive silver halide particle. However, it is preferable that the proportion of a {100} plane, which has high spectral sensitizing efficiency when a spectral sensitizing dye is absorbed thereto, is high. The proportion is preferably 50% or more, more preferably 65% or more, and still more preferably 80% or more. The ratio of of the {100} plane obtained by the Miller indices can be determined by the method described in T. Tani, J. Imaging Sci., 29, 165 (1985). This method utilizes the adsorption dependency of a {111} plane and {100} plane in the adsorption of a sensitizing dye.

In the present invention, silver halide particles, on which a hexacyano metal complex is present on the outermost surface of the particle, are preferable. Examples of the hexacyano metal complex include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$ and $[Re(CN)_6]^{3-}$. In the invention, a hexacyano Fe complex is preferable.

The hexacyano metal complex exists in an ion state in an aqueous solution. Therefore the counter cation thereof is not important. However, ions which are easily mixed with water and adapt to a precipitating operation of the silver halide emulsion, are preferably used as the counter cation. Examples of such a cation include alkali metal ions such as a sodium ion, potassium ion, rubidium ion, cesium ion and lithium ion, ammonium ion and alkylammonium ions (e.g., a tetrmethylammonium ion, tetraethylammonium ion, tetrapropylammonium ion and tetra(n-butyl)ammonium ion).

When the hexacyano metal complex is used, the hexacyano metal complex may be mixed with, besides water, a mixed solvent comprising an organic solvent (e.g., alcohols, ethers, glycols, ketones, esters and amides) or gelatin.

The amount of the hexacyano metal complex to be added is preferably $1\times10^{-5}$ mol or more and $1\times10^{-2}$ mol or less, and more preferably $1\times10^{-4}$ mol or more and $1\times10^{3}$ mol or less, with respect to 1 mol of silver.

In order to make the hexacyano metal complex exist on the outermost surface of the silver halide particle, the hexacyano metal complex can be added directly after the addition of an aqueous silver nitrate solution, which is used for the formation of particles, is finished, and before a chemical sensitization step for performing chalcogen sensitization such as sulfur sensitization, selenium sensitization, and tellurium sensitization, or precious metal sensitization such as gold sensitization. Namely, the hexacyano metal complex can be added before a chemical sensitization step, at the end of a preparation step, during a water washing step or during a dispersion step, or just before the chemical sensitization step.

In order not to grow the silver halide fine particle, it is preferable that the hexacyano metal complex is added immediately after the silver halide fine particle is formed, and also preferable that the hexacyano metal complex is added before the preparation step is finished.

The addition of the hexacyano metal complex may be started after 96 mass % of silver nitrate with respect to the total amount of silver nitrate, which is used for forming the particles, is added. It is more preferable for the hexacyano metal complex to be added after 98 mass % of the total amount of silver nitrate is added, and most preferably after 99 mass % of the total amount of silver nitrate is added.

When the hexacyano metal complex is added after the aqueous silver nitrate solution is added, and just before the formation of a particle has been finished, the hexacyano metal complex can be absorbed to the outermost surface of the silver halide particle. Almost all of the hexacyano metal complex that is absorbed is formed of a slightly soluble salt with a silver ion present on the surface of the particle. The silver salt of hexacyano iron (II) is a salt which is dissolved more sparingly than AgI, and the redissolution of fine particles is therefore prevented. Accordingly, it is possible to produce silver halide fine particles having small particle size.

The photosensitive silver halide particle used in the invention may contain metals of group VIII to group X in the periodic table (the table shows I to XVIII group elements) or complexes of these metals. Preferable metals among the groups VIII to X metals or the center metals of these metal complexes are rhodium, ruthenium and iridium. These metal complexes may be used singly or in a combination of two or more where both combinations of the complexes of the same metals and different metals may be used. The content of these metals or metal complexes is preferably in a range of from $1\times10^{-9}$ mol to $1\times10^{3}$ mol per 1 mol of silver. These heavy metals or metal complexes and methods of adding these metals or metal complexes are described in JP-A Nos. 7-225449, 11-65021, paragraph nos. 0018 to 0024, and JP-A No. 11-119374, paragraph nos. 0227 to 0240.

Further, there are descriptions concerning metal atoms (e.g., $[Fe(CN)_6]^{4-}$) which can be comprised in the silver halide particle of the present invention, methods of desalting a silver halide emulsion and chemical sensitization methods in JP-A No. 11-84574, paragraph nos. 0046 to 0050, JP-A No. 11-65021, paragraphs nos. 0025 to 0031 and JP-A No. 11-119374, paragraphs nos. 0242 to 0250.

As the gelatin to be contained in the photosensitive silver halide emulsion used in the invention, various types of gelatin may be used. A gelatin having a low molecular weight of 500 to 60,000 is preferably used in order to maintain a well-dispersed condition of the photosensitive silver halide emulsion in an organic silver salt-containing coating solution. Although these low-molecular weight gelatins may be used during the formation of the particles, or during the dispersing of the particles after desalting treatment, they are preferably added during the dispersing of the particles after desalting treatment.

In the invention, a sensitizing dye may be used. As the sensitizing dye applicable to the invention, sensitizing dyes which have a spectral sensitivity adaptable to the spectral characteristics of an exposure light source used can be advantageously selected from sensitizing dyes which can spectrally sensitize silver halide particles (grains) in a desired wavelength range when the dyes are adsorbed to the silver halide particles. The sensitizing dyes and methods of adding these dyes are described in JP-A No. 11-65021, paragraph nos. 0103 to 0109, JP-A No. 10-186572 (compounds represented by the general formula (II)), JP-A No. 11-119374 (dyes represented by the general formula (I) and paragraph no. 0106), U.S. Pat. Nos. 5,510,236 and 3,871,887 (dyes in Example 5), JP-A Nos. 2-96131 and 59-48753 (dyes), European Patent Laid-Open No. 0803764 A1, page 19, line 38 to page 20, line 35, Japanese Patent Application Nos. 2000-86865 and 2000-102560. These sensitizing dyes may be used either singly or in combinations of two or more. The sensitizing dye is added to a silver halide emulsion preferably at any time after the desalting step but by the time of application, and more preferably at any time after desalting but before chemical sensitization is finished.

In the invention, the amount of the sensitizing dye to be added can be determined to be a desired amount in accordance with the properties such as sensitivity and fogging. The amount of the sensitizing dye is preferably $10^{-6}$ to 1 mol and more preferably $10^{-4}$ to $10^{-4}$ mol per 1 mol of the silver halide contained in the image forming layer.

In the present invention, a strong color sensitizer may be used in order to improve spectral sensitization efficiency. Examples of the strong color sensitizer include compounds described in European Patent Application Laid-Open No. 587,338, U.S. Pat. Nos. 3,877,943, 4,873,184 and JP-A Nos. 5-341432, 11-109547 and 10-111543.

The photosensitive silver halide particle according to the invention is preferably chemically sensitized using a sulfur sensitization method, selenium sensitization method or tellurium sensitization method. As compounds preferably used in the sulfur sensitization method, selenium sensitization method or tellurium sensitization method, known compounds such as those described in JP-A No. 7-128768 may be used. In the invention, tellurium sensitization is particularly preferable. Compounds described in JP-A No. 11-65021, paragraph no. 0030, and compounds represented by the formulae (II), (III) and (IV) described in JP-A No. 5-313284 are more preferable.

The photosensitive silver halide particle used in the invention is preferably chemically sensitized using a gold sensitization method either independently or in combination with the aforementioned chalcogen sensitization. As the gold sensitizer, the valency number of the gold thereof is preferably +1 or +3. Gold compounds usually used as a gold sensitizer are preferable. Typical examples of preferable gold sensitizer include chloroauric acid, bromoauric acid, potassium chloroaurate, potassium bromoaurate, auric trichloride, potassium auricthiocyanate, potassium iodoaurate, tetracycanoauric acid, ammonium aurothiocyanate and pyridyl trichlorogold. Gold sensitizers described in U.S. Pat. No. 5,858,637 and Japanese Patent Application No. 2001-79450 are also preferably used.

In the invention, the chemical sensitization may be carried out at any time prior to application and after the formation of particles. For examples, chemical sensitization at the time after desalting and (1) at a time before spectral sensitization, (2) at the same time spectral sensitization is performed, (3) at a time after spectral sensitization, and (4) at a time just before application, are applicable.

The amount of sulfur, selenium or tellurium sensitizer used in the invention is to be changed depending on the type of silver halide particle used, chemical ripening conditions and the like. However, the amount of sulfur, selenium or tellurium sensitizer is to be about $10^{-8}$ to $10^{-2}$ mol, and preferably about $10^{-7}$ to $10^{-3}$ mol per one mol of the silver halide.

A standard amount of a gold sensitizer is preferably $10^{-7}$ to $10^{-3}$ mol, and more preferably $10^{-6}$ to $5\times10^{-4}$ mol per one mol of the silver halide, though it can change depending on various conditions.

There is no particular limitation to the conditions for chemical sensitization. However, a pH of 5 to 8, a pAg of 6 to 11, and a temperature of about 40 to 95° C. is preferable.

A thiosulfonic acid compound may be compounded in the silver halide emulsion used in the invention by using the method described in European Patent Application Laid-Open No. 293,917.

In the photosensitive silver halide particle according to the invention, a reducing agent is preferably used. As a specific compound as a reducing agent used in a reduction sensitization method, ascorbic acid and thiourea dioxide are preferable. Other than the above compounds, stannous chloride, aminoiminomethanesulfinic acid, hydrazine derivatives, borane compounds, silane compounds, polyamine compounds and the like may be preferably used. The reducing sensitizer may be added during any process, from the process of the growth of crystals until the process of coordination just before application. It is also preferable that ripening for reduction sensitization is carried out under the conditions that the pH value of the emulsion is kept at 7 or more, or the pAg value is kept at 8.3 or less. It is also preferable to carry out reduction sensitization by introducing a single addition portion of a silver ion during the formation of the particles.

The photosensitive silver halide emulsion used in the invention preferably contains a FED sensitizer (fragmentable electron donating sensitizer) as a compound generating two electrons by one photon. As the FED sensitizer, compounds described in U.S. Pat. Nos. 5,747,235, 5,747,236, 605,426 and 5,994,051, and Japanese Patent Application No. 2001-86161 are preferable. As a step for adding the FED sensitizer, any of the photosensitive emulsion producing process steps, from the growth of crystals until the coordination step just before application, are preferable. The amount of the FED sensitizer is preferably $10^{-7}$ to $10^{-1}$ mol, and more preferably $10^{-6}$ to $5\times10^{-2}$ mol per one mol of the silver halide, though it may change depending on various conditions.

The photosensitive silver halide emulsion comprised in the heat-developable photosensitive material used in the invention may be used singly or in a combination of two or more (for example, those having different average particle sizes, halogen compositions, crystal habits or chemical sensitization conditions). The gradation can be controlled by using two or more photosensitive silver halides which have a different sensitivity from each other. Examples of technologies concerned thereto include technologies described in JP-A Nos. 57-119341, 53-106125, 47-3929, 48-55730, 46-5187, 50-73627 and 57-150841. As to the difference in sensitivity, a difference in sensitivity between each emulsion is preferably made to be 0.2 log E or more.

The amount of the photosensitive silver halide is preferably 0.03 to 0.6 g/m$^2$, more preferably 0.07 to 0.4 g/m$^2$, and most preferably 0.05 to 0.3 g/m$^2$, in terms of the amount of silver per 1 m$^2$ of the heat-developable photosensitive material applied. The amount of the photosensitive silver halide is preferably 0.01 mol or more and 0.3 mol or less, more preferably 0.02 mol or more and 0.2 mol or less, and most preferably 0.03 mol or more and 0.15 mol or less based on one mol of the organic silver salt.

As to methods and conditions for mixing the separately prepared photosensitive silver halide and organic silver salt to prepare an organic silver salt, there is a method in which the silver halide particle and the organic silver salt, which are respectively prepared, are completely mixed using a high speed stirrer, ball mill, sand mill, colloid mill, vibration mill, homogenizer or the like, and a method in which a completely prepared photosensitive silver halide is mixed with the organic silver salt at any timing during the preparation of the organic silver salt.

As described above, the silver halide according to the invention is preferably formed in a condition that excludes the existence of the organic silver salt. Also, during the step of mixing materials, the mixing of a water dispersion of two or more organic silver salts with a water dispersion of two or more photosensitive salts is preferable for the purpose of controlling photographic characteristics.

The preferable stage for adding the silver halide to the image forming layer coating solution is from 180 minutes before to just before the application of the solution, and more preferably from 60 minutes before to 10 seconds before the application. However, no particular limitation is imposed on the mixing method and conditions thereof in so far as the effect of the invention is sufficiently obtained. Specific examples of the mixing method include a method in which mixing is carried out in a tank in such a manner that the average retention time, which is calculated from the addition flow rate and the rate of the solution fed to a coater, is set to be the desired time, and a method using a static mixer as described in Chapter 8 of "Liquid Mixing Technologies" by N. Harnby, M. F. Edwards and A. W. Nienow, translated by Takahashi Kouji (published by The Nikkan Kogyo Newspaper, 1989).

The gradation of the photosensitive material is optional. However, in order to achieve the effect of the present invention efficiently, the average contrast at the density between 1.5 and 3.0 is preferably 1.5 or more and 10 or less in view of character definition performance, more preferably 2.0 or more and 7 or less, and most preferably 2.5 or more and 6 or less.

Here, the average contrast means the gradient of the line connecting the densities 1.5 and 3.0 on a characteristic curve wherein the ordinate is the logarithm of an exposure amount of a laser and the abscissa is the optical density of the photosensitive material exposed at the exposure amount after heat developing.

Developing Accelerator

The developing accelerator used in the invention will be explained in detail hereinafter.

The developing accelerator used in the invention is a compound having a sensitivity described below when the accelerator is comprised in a heat-developable photosensitive material having on the support at least one photosensitive layer, which comprises at least one photosensitive silver halide, at least one nonphotonsensitive organic silver salt, at least one reducing agent and at least one binder. When 10% of the accelerator, which is shown by a mol ratio based on the reducing agent (called a main reducing agent), is substituted, sensitivity at a density of 1.0 raises 0.05 or more with respect to the sensitivity when no substitution is made.

As the developing accelerator, a compound providing a sensitivity which raises 0.05 or more when 5 mol % of the compound is substituted is preferable, and a compound providing a sensitivity which raises 0.05 or more when 2 mol % of the compound is substituted is more preferable.

As the above developing accelerator, any compound may be used as long as the compound can raise the sensitivity when it is substituted with the main reducing agent in heat developing as described above. It is preferable to use a so-called reducing agent. Specific examples of the compounds include aminophenols, p-phenylenediamines, sulfonamidophenols, carbonamidophenols, 1-phenyl-5-pyrazolidones, ascorbic acid, hydrazines, phenols and naphthols. Among these compounds, sulfonamidophenols (e.g., compounds represented by the general formula (I) described in JP-A No. 10-221806, and compounds represented by the general formula (A) described in JP-A No. 2000-267222), and hydrazines are preferable.

As particularly preferable compounds, compounds represented by the following formulae (I) to (III) are exemplified.

General Formula (I)

$Q^1$-NHNH—$R^1$

General formula (II)

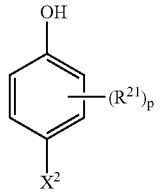

-continued

General formula (III)

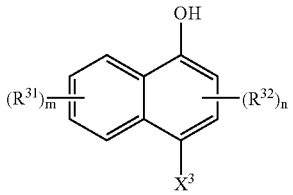

In the general formula (I), $Q^1$ represents a five to seven-membered unsaturated ring connected to NHNH—$R^1$ through a carbon atom thereof, and $R^1$ represents a carbamoyl group, an acyl group, an alkoxycarbonyl group, an aryloxycarbonyl group, a sulfonyl group or a sulfamoyl group. In the formulae (II) and (III), $X^2$ and $X^3$ each independently represent a hydrogen atom or a substituent, and $R^{21}$, $R^{31}$ and $R^{32}$ each independently represent a hydrogen atom or substituent. m and p each independently denote an integer from 0 to 4 and n denotes an integer from 0 to 2.

The most preferable compound as the developing accelerator in the invention is a compound (hydrazine derivatives) represented by the above general formula (I). The heat-developable photosensitive material of the invention is preferably provided on the support such that the reducing compound represented by the general formula (I) exists on the same plane as the photosensitive silver halide and nonphotonsensitive silver salt.

The reducing compound represented by the above general formula (I) is a developing agent which is generically called a hydrazine type developing agent. In the formula, $Q^1$ represents a five- to seven-membered unsaturated ring having a carbon atom connected to NHNH—$R^1$ and $R^1$ represents a carbamoyl group, an acyl group, an alkoxycarbonyl group, an aryloxycarbonyl group, a sulfonyl group or a sulfamoyl group.

Preferable examples of the five- to seven-membered unsaturated ring represented by $Q^1$ in the general formula (I) include a benzene ring, pyridine ring, pyrazine ring, pyrimidine ring, pyridazine ring, 1,2,4-triazine ring, 1,3,5-triazine ring, pyrrole ring, imidazole ring, pyrazole ring, 1,2,3-triazole ring, 1,2,4-triazole ring, tetrazole ring, 1,3,4-thiadiazole ring, 1,2,4-thiadiazole ring, 1,2,5-thiadiazole ring, 1,3,4-oxadiazole ring, 1,2,4-oxadiazole ring, 1,2,5-oxadiazole ring, thiazole ring, oxazole ring, isothiazole ring, isooxazole ring and thiophene ring. Condensed rings obtained by condensing these rings are also desirable.

These rings may have a substituent. When two or more substituents are included, these substituents may be the same or different. Examples of the substituent include halogen atoms, alkyl groups, aryl groups, carbonamide groups, alkylsulfonamide groups, arylsulfonamide groups, alkoxy groups, aryloxy groups, alkylthio groups, arylthio groups, a carbamoyl group, a sulfamoyl group, a cyano group, alkylsulfonyl groups, arylsulfonyl groups, alkoxycarbonyl groups, aryloxycarbonyl groups and acyl groups.

In the case where these substituents are groups which can be substituted, these substituents may have further a substituent. Preferable examples of the substituent may include halogen atoms, alkyl groups, aryl groups, carbonamide groups, alkylsulfonamide groups, arylsulfonamide groups, alkoxy groups, aryloxy groups, alkylthio groups, arylthio groups, acyl groups, alkoxycarbonyl groups, aryloxycarbonyl groups, a carbamoyl group, a cyano group, a sulfamoyl groups, alkylsulfonyl groups, arylsulfonyl groups and acyloxy groups.

In the general formula (I), the carbamoyl group represented by $R^1$ preferably has 1 to 50 carbon atoms and more preferably 6 to 40 carbon atoms. Specific examples of the carbamoyl group include an unsubstituted carbamoyl group, a methylcarbamoyl group, a N-ethylcarbamoyl group, a N-propylcarbamoyl group, a N-sec-butylcarbamoyl group, a N-octylcarbamoyl group, a N-cyclohexylcarbamoyl group, a N-tert-butylcarbamoyl group, a N-dodecylcarbamoyl group, a N-(3-dodecyloxypropyl)carbamoyl group, a N-octadecylcarbamoyl group, a N-{3-(2,4-tert-pentylphenoxy)propyl}carbamoyl group, a N-(2-hexyldecyl)carbamoyl group, a N-phenylcarbamoyl group, a N-(4-dodecyloxyphenyl)carbamoyl group, a N-(2-chloro-5-dodecyloxycarbonylphenyl)carbamoyl group, a N-naphthylcarbamoyl group, a N-3-pyridylcarbamoyl group and a N-benzylcarbamoyl group.

The acyl group represented by $R^1$ in the general formula (I) has preferably 1 to 50 carbon atoms and more preferably 6 to 40 carbon atoms. Specific examples of the acyl group include a formyl group, a acetyl group, a 2-methylpropanoyl group, a cyclohexylcarbonyl group, an octanoyl group, a 2-hexyldecanoyl group, a dodecanoyl group, a chloroacetyl group, a trifluoroacetyl group, a benzoyl group, a 4-dodecyloxybenzoyl group and a 2-hydroxymethylbenzoyl group.

The alkoxycarbonyl group represented by $R^1$ in the general formula (I) has preferably 2 to 50 carbon atoms and more preferably 6 to 40 carbon atoms. Specific examples of the alkoxycarbonyl group include a methoxycarbonyl group, an ethoxycarbonyl group, an isobutyloxycarbonyl group, a cyclohexyloxycarbonyl group, a dodecyloxycarbonyl group and a benzyloxycarbonyl group.

The aryloxycarbonyl group represented by $R^1$ in the general formula (I) has preferably 7 to 50 carbon atoms and more preferably 7 to 40 carbon atoms. Specific examples of the aryloxycarbonyl group include a phenoxycarbonyl group, a 4-octyloxyphenoxycarbonyl group, a 2-hydroxymethylphenoxycarbonyl group and a 4-dodecyloxyphenoxycarbonyl group.

The sulfonyl group represented by $R^1$ in the general formula (1) has preferably 1 to 50 carbon atoms and more preferably 6 to 40 carbon atoms. Specific examples of the sulfonyl group include a methylsulfonyl group, a butylsulfonyl group, an octylsulfonyl group, a 2-hexadecylsulfonyl group, a 3-dodecyloxypropylsulfonyl group, a 2-octyloxy-5-tert-octylphenylsulfonyl group and a 4-dodecyloxyphenylsulfonyl group.

The sulfamoyl group represented by $R^1$ in the general formula (I) has preferably 0 to 50 carbon atoms and more preferably 6 to 40 carbon atoms. Specific examples of the sulfamoyl group include an unsubstituted sulfamoyl group, a N-ethylsulfamoyl group, a N-(2-ethylhexyl)sulfamoyl group, a N-decylsulfamoyl group, a N-hexadecylsulfamoyl group, a N-{3-(2-ethylhexyloxy)propyl}sulfamoyl group, a N-(2-chloro-5-dodecyloxycarbonylphenyl)sulfamoyl group and a N-(2-tetradecyloxyphenyl)sulfamoyl group.

The group represented by $R^1$ in the general formula (I) may have at least one of a group as a substituient at substitutable positions thereof. Examples of the substituent include the examples of the substituent for the aforementioned $Q^1$, which is a five- to seven-membered unsaturated ring. When the group represented by $R^1$ has two or more substituents, these substituents may be the same or different from each other.

Among the compounds represented by the general formula (I), compounds wherein $Q^1$ is five- or six-membered unsaturated ring are preferable. More preferable compounds are compounds wherein $Q^1$ is a benzene ring, pyrimidine ring, 1,2,3-triazole ring, 1,2,4-triazole ring, tetrazole ring, 1,3,4-thiadiazole ring, 1,2,4-thiadiazole ring, 1,3,4-oxadiazole ring, 1,2,4-oxadiazole ring, thiazole ring, oxazole ring, isothiazole ring, isooxazole ring or rings obtained by condensing these rings with a benzene ring or an unsaturated hetero ring. A particularly preferable $Q^1$ is a quinazoline ring. It is also preferable that $Q^1$ has at least one electron attractive substituent. Preferable examples of the electron attracive substituent include fluoroalkyl groups (e.g., a trifluoromethyl group, pentafluoroethyl group, 1,1-difluoroethyl group, difluoromethyl group, fluoromethyl group, heptafluoropropyl group, pentafluorophenyl group), a cyano group, halogen atoms (fluoro, chloro, bromo and iodo groups), acyl group, alkoxycarbonyl group, carbamoyl group, alkylsulfonyl group and arylsulfonyl group. The trifluoromethyl group is particularly preferable.

In the general formula (I), $R^1$ is preferably a carbamoyl group. $R^1$ is more preferably a substituted carbamoyl group represented by —CO—NH—$R^{1'}$, and $R^1$ is most preferably the substituted carbamoyl group wherein $R^{1'}$ is an alkyl group having 1 to 10 carbon atoms or an aryl group.

Specific examples of the reducing compound represented by the general formula (I) will be shown below. However, these examples are not intended to limit the scope of the invention.

1-1

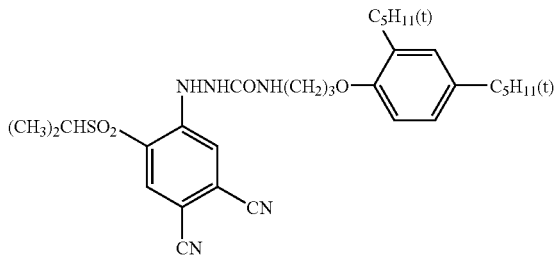

1-2

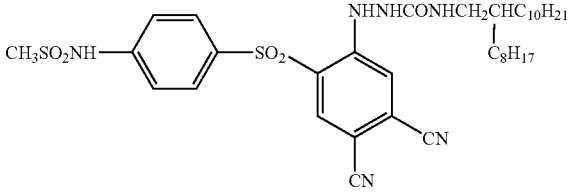

-continued
1-3
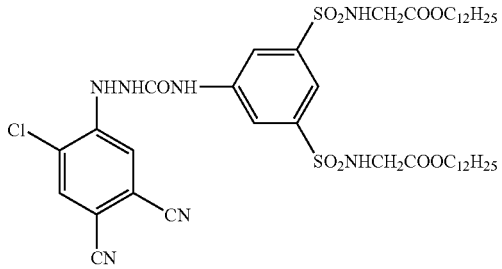
1-4
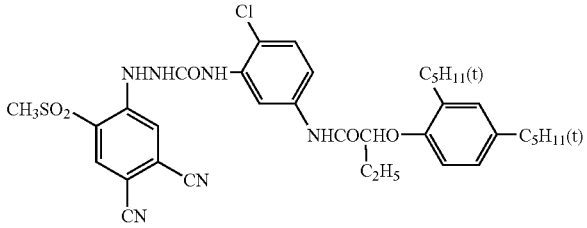
1-5
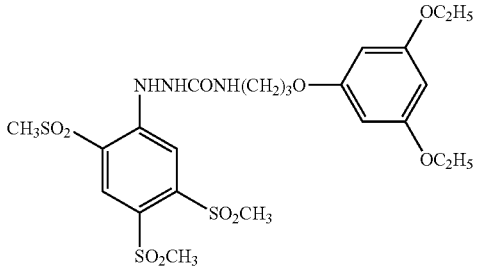
1-6
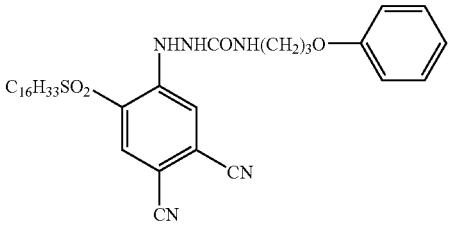
1-7
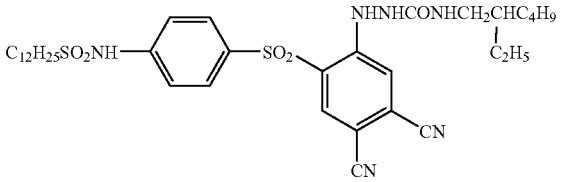
1-8
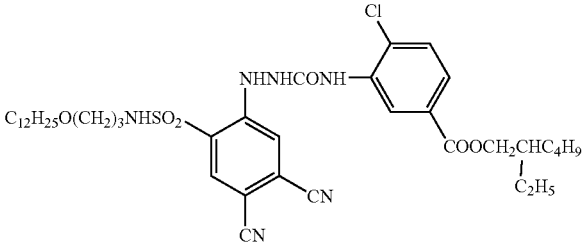
1-9
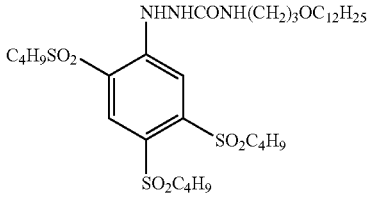
1-10
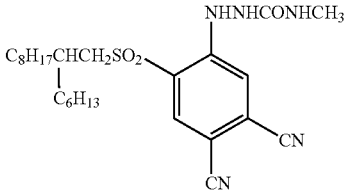
1-11
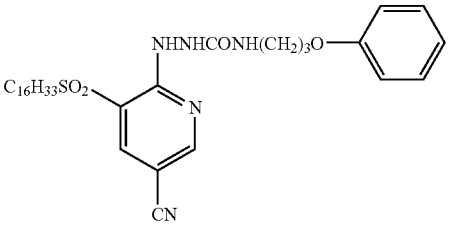
1-12
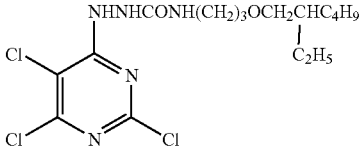
1-13
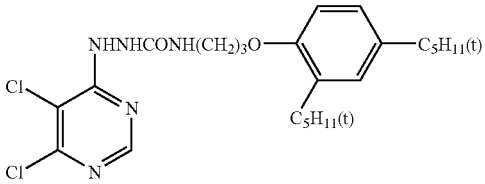
1-14
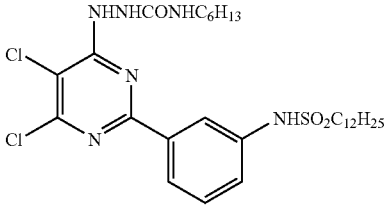

-continued
1-15
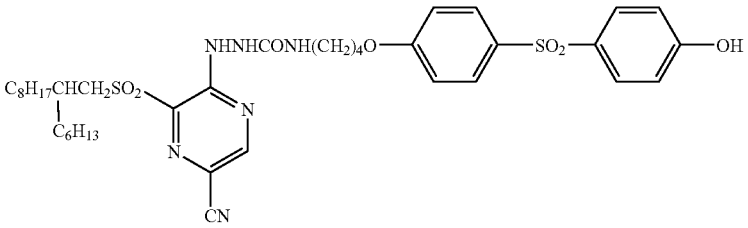
1-16
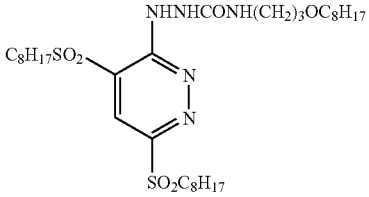
1-17
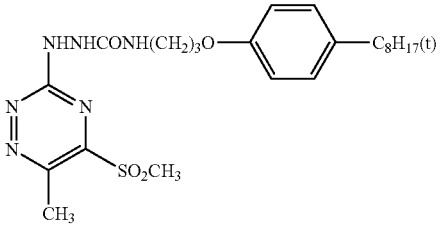
1-18
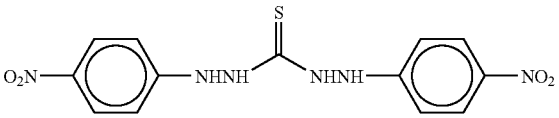
1-19
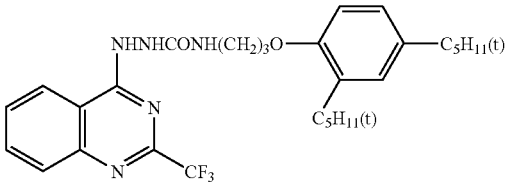
1-20
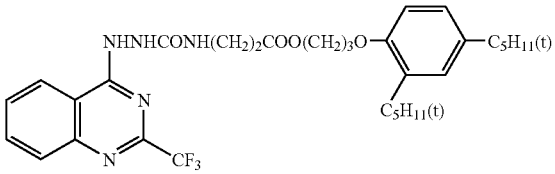
1-21
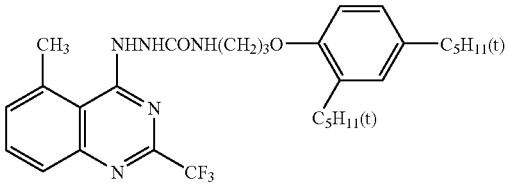
1-22
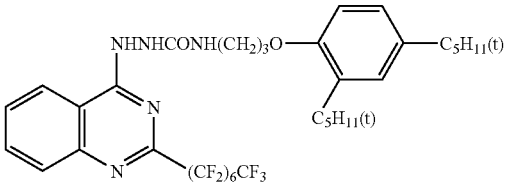
1-23
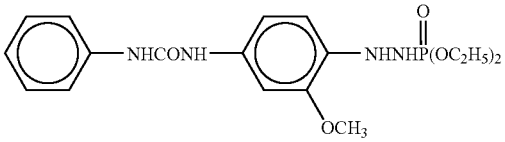
1-24
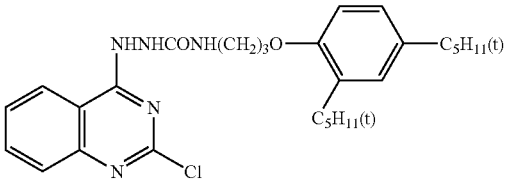
1-25
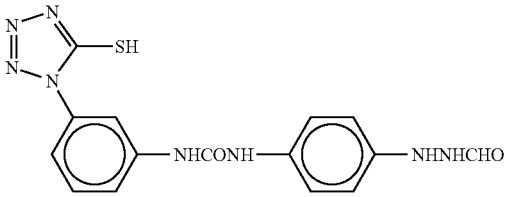
1-26
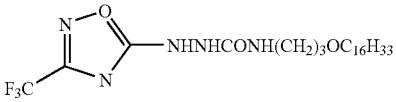
1-27
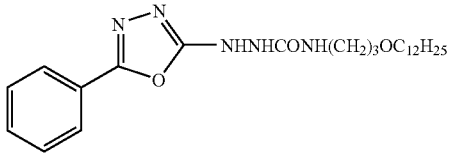

-continued
1-28
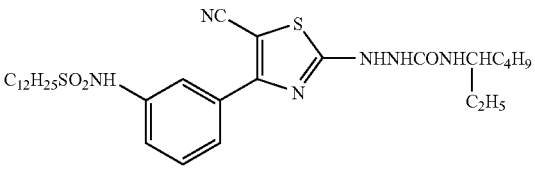
1-29
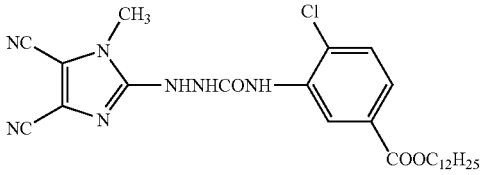
1-30
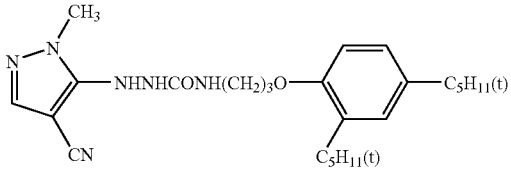
1-31
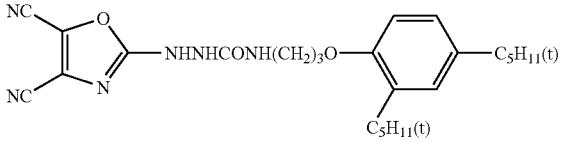
1-32
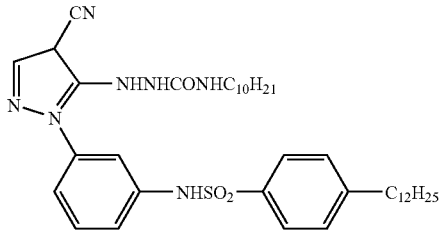
1-33
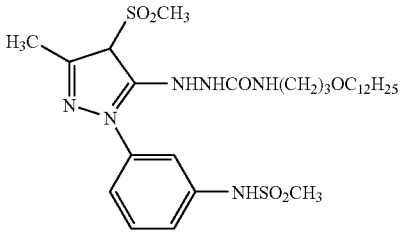
1-34
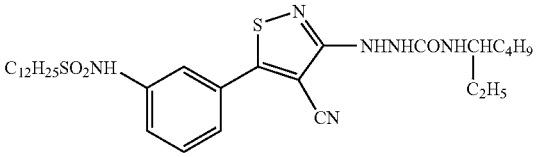
1-35
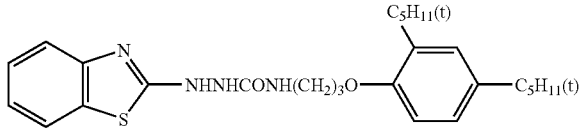
1-36
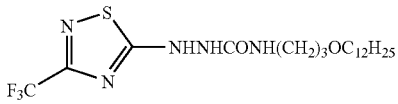
1-37
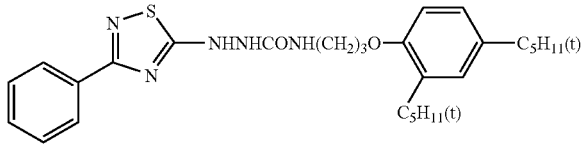
1-38
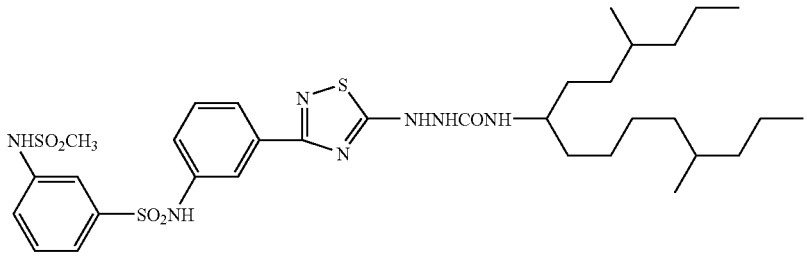
1-39
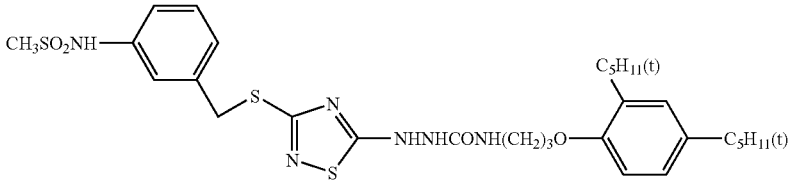

-continued
1-40
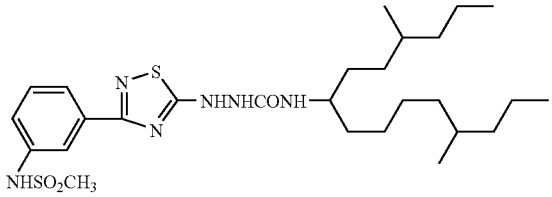
1-41
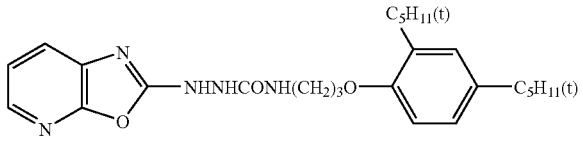
1-42
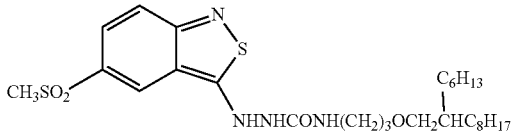
1-43
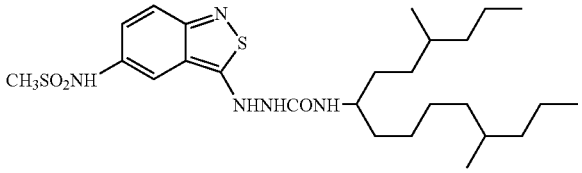
1-44
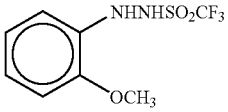
1-45
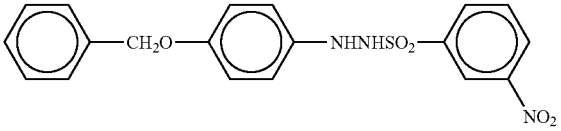
1-46
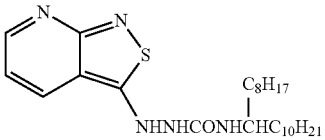
1-47
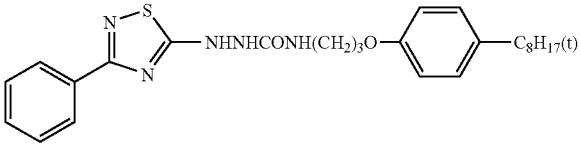
1-48
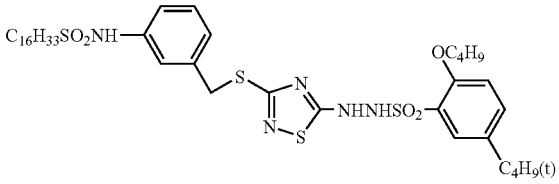
1-49
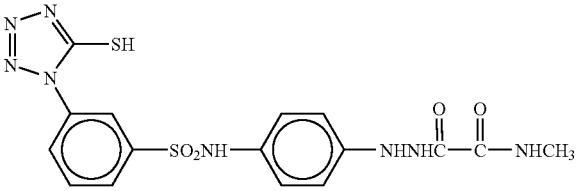
1-50
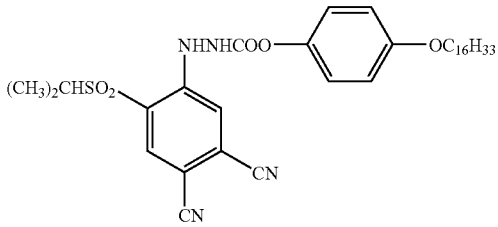
1-51
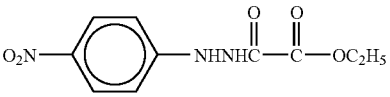
1-52
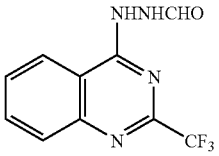
1-53
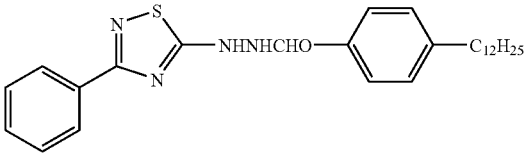

-continued
1-54
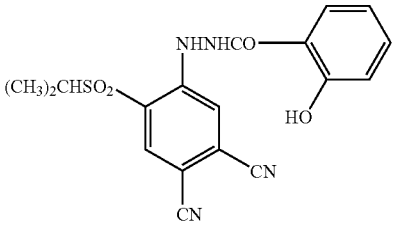
TABLE 1
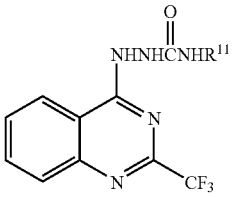
| Compound No. | $R^{11}$ |
|---|---|
| 1-55 | $CH_3$ |
| 1-56 | $C_2H_5$ |
| 1-57 | $(n)C_3H_7$ |
| 1-58 | $(i)C_3H_7$ |
| 1-59 | $(n)C_4H_9$ |
| 1-60 | $(i)C_4H_9$ |
| 1-61 | $sec\text{-}C_4H_9$ |
| 1-62 | $(t)C_4H_9$ |
| 1-63 | $(n)C_5H_{11}$ |
| 1-64 | $(t)C_5H_{11}$ |
| 1-65 | $(n)C_6H_{13}$ |
| 1-66 | 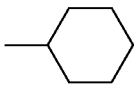 |
| 1-67 | $(n)C_8H_{17}$ |
| 1-68 | $(t)C_8H_{17}$ |
| 1-69 | 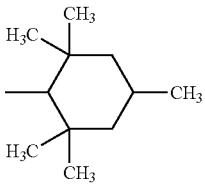 |
| 1-70 | 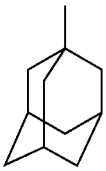 |
TABLE 2
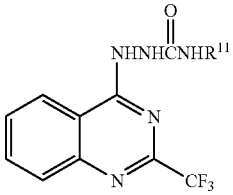
| Compound No. | $R^{11}$ |
|---|---|
| 1-71 | 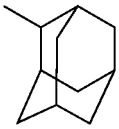 |
| 1-72 | 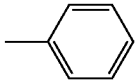 |
| 1-73 | 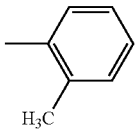 |
| 1-74 | 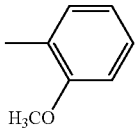 |
| 1-75 | 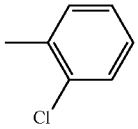 |
| 1-76 | 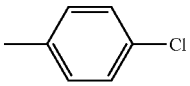 |
| 1-77 | 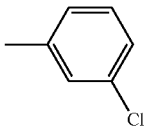 |

TABLE 2-continued
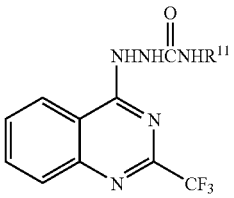
| Compound No. | $R^{11}$ |
|---|---|
| 1-78 | 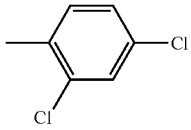 |
TABLE 3
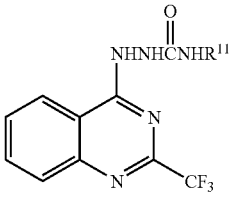
| Compound No. | $R^{11}$ |
|---|---|
| 1-79 | 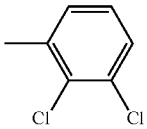 |
| 1-80 | 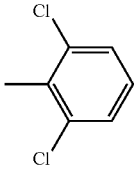 |
| 1-81 | 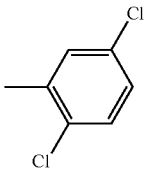 |
| 1-82 | 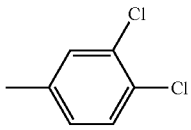 |
| 1-83 | 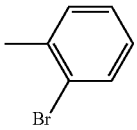 |
TABLE 3-continued
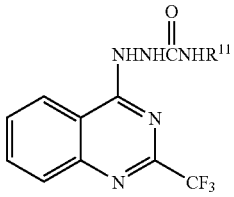
| Compound No. | $R^{11}$ |
|---|---|
| 1-84 | 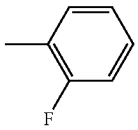 |
| 1-85 | 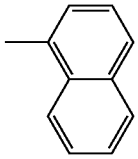 |
TABLE 4
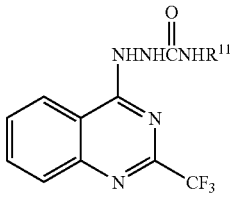
| Compound No. | $R^{11}$ |
|---|---|
| 1-86 | 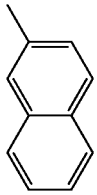 |
| 1-87 | 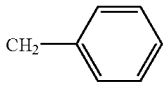 |
| 1-88 | 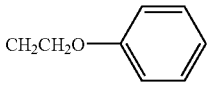 |
| 1-89 | $CH_2CH_2OCH_2CH_3$ |
| 1-90 | $CH_2CH_2OCH_3$ |
| 1-91 | 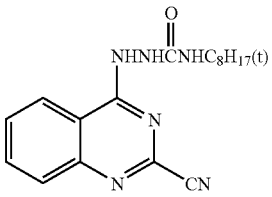 |

TABLE 4-continued
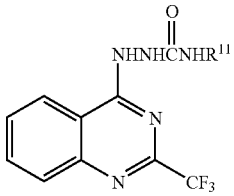
| Compound No. | $R^{11}$ |
|---|---|
| 1-92 | 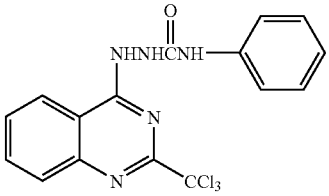 |
| 1-93 | 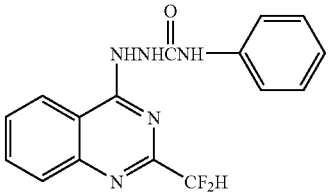 |
| 1-94 | 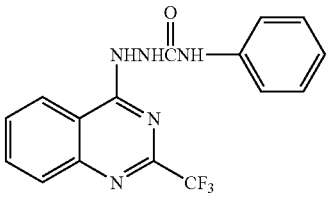 |
| 1-95 | 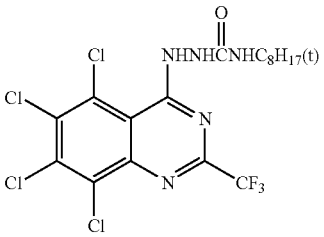 |
| 1-96 | 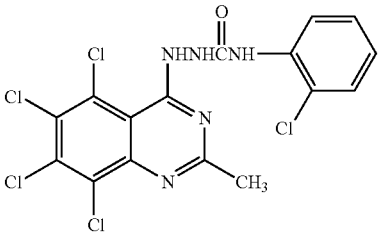 |
| 1-97 | 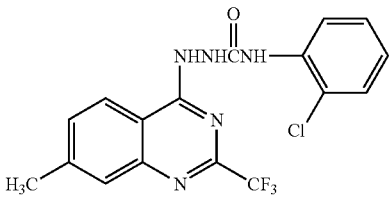 |
TABLE 4-continued
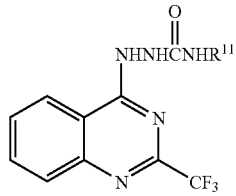
| Compound No. | $R^{11}$ |
|---|---|
| 1-98 | 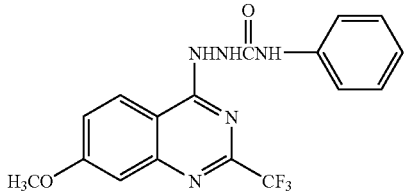 |
| 1-99 | 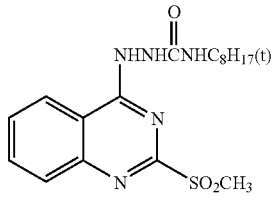 |
| 1-100 | 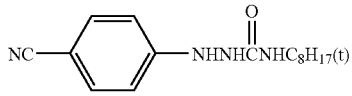 |
| 1-101 | 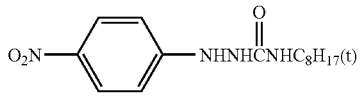 |
| 1-102 | 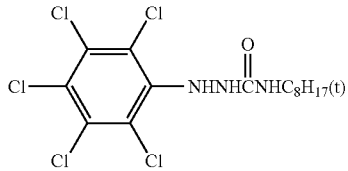 |
| 1-103 | 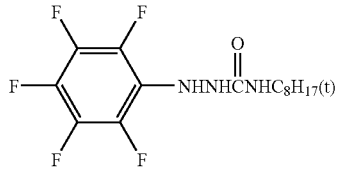 |
| 1-104 | 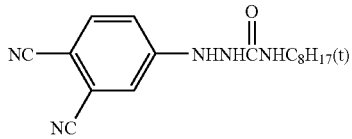 |
| 1-105 | 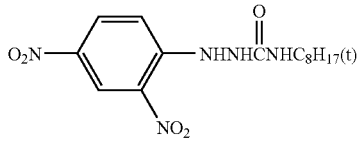 |

TABLE 4-continued

| Compound No. | $R^{11}$ |
|---|---|
| 1-106 | 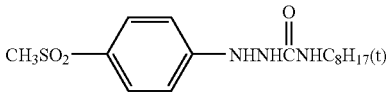 |

The reducing compound represented by the general formula (I) may be synthesized according to the methods described in JP-A Nos. 9-152702, 8-286340, 9-152700, 9-152701, 9-152703, 9-152704 and the like.

Although there is a wide range to be added, it is preferable that 0.01 to 100 mol times of the reducing compound with respect to 1 mol of silver ion is added, and more preferably 0.1 to 10 mol times the amount is added.

The reducing compound represented by the general formula (I) may be added to the coating solution in any form such as a solution, a powder, a solid fine particle dispersion, an emulsion and an oil-protected dispersion. Particularly, when the reducing compound is used together with the latex according to the invention, it is preferably added in the form of a solid fine particle. The solid fine particles are dispersed using a known means for forming a fine particle (e.g., a ball mill, vibration ball mill, sand mill, colloid mill, jet mill and roller mill). Also, a dispersing assistant may be used when preparing the solid fine particle dispersion.

Compounds represented by the general formula (II) or (III) will be explained.

In the formulae (II) and (III), $X^2$ and $X^3$ each independently represent a hydrogen atom or a substituent. Examples of the substituent represented by $X^2$ and $X^3$ include halogen atoms (e.g., a fluorine atom, chlorine atom, bromine atom and iodine atom), aryl groups (preferably those having 6 to 30 carbon atoms, more preferably 6 to 20 carbon atoms and most preferably 6 to 12 carbon atoms, for example, phenyl, p-methylphenyl and naphthyl), alkoxy groups (preferably those having 1 to 20 carbon atoms, more preferably 1 to 12 carbon atoms and most preferably 1 to 8 carbon atoms, for example, methoxy, ethoxy and butoxy), aryloxy groups (preferably those having 6 to 20 carbon atoms, more preferably 6 to 16 carbon atoms and most preferably 6 to 12 carbon atoms, for example, phenyloxy and 2-naphthyloxy), alkylthio groups (preferably those having 1 to 20 carbon atoms, more preferably 1 to 16 carbon atoms and most preferably 1 to 12 carbon atoms, for example, methylthio, ethylthio and butylthio), arylthio groups (preferably those having 6 to 20 carbon atoms, more preferably 6 to 16 carbon atoms and most preferably 6 to 12 carbon atoms, for example, phenylthio and naphthylthio), acyloxy groups (preferably those having 1 to 20 carbon atoms, more preferably 2 to 16 carbon atoms and most preferably 2 to 10 carbon atoms, for example, acetoxy and benzoyloxy), acylamino groups (preferably those having 2 to 20 carbon atoms, more preferably 2 to 16 carbon atoms and most preferably 2 to 10 carbon atoms, for example, N-methylacetylamino and benzoylamino), sulfonylamino groups (preferably those having 1 to 20 carbon atoms, more preferably 1 to 16 carbon atoms and most preferably 1 to 12 carbon atoms, for example, methanesulfonylamino and benzenesulfonylamino), carbamoyl groups (preferably those having 1 to 20 carbon atoms, more preferably 1 to 16 carbon atoms and most preferably 1 to 12 carbon atoms, for example, carbamoyl, N,N-diethylcarbamoyl and N-phenylcarbamoyl), acyl groups (preferably those having 2 to 20 carbon atoms, more preferably 2 to 16 carbon atoms and most preferably 2 to 12 carbon atoms, for example, acetyl, benzoyl, formyl and pivaloyl), alkoxycarbonyl groups (preferably those having 2 to 20 carbon atoms, more preferably 2 to 16 carbon atoms and most preferably 2 to 12 carbon atoms, for example, a methoxycarbonyl group), a sulfo group, sulfonyl groups (preferably those having 1 to 20 carbon atoms, more preferably 1 to 16 carbon atoms and most preferably 1 to 12 carbon atoms, for example, mesyl and tosyl), sulfonyloxy groups (preferably those having 1 to 20 carbon atoms, more preferably 1 to 16 carbon atoms and most preferably 1 to 12 carbon atoms, for example, methanesulfonyloxy and benzenesulfonyloxy), azo groups, heterocyclic groups, heterocyclic mercapto groups and a cyano group. The heterocyclic groups meant here represent saturated or unsaturated heterocyclic groups. Examples of the heterocyclic group include a pyridyl group, quinolyl group, quinoxalinyl group, pyrazinyl group, benzotriazolyl group, pyrazolyl group, imidazolyl group, benzoimidazolyl group, tetrazolyl group, hydantoin-1-yl group, succinimide group and phthalimide group.

The substituent represented by $X^2$ or $X^3$ in the formulae (II) and (III) is more preferably an alkoxy group or aryloxy group. The substituent represented by $X^2$ or $X^3$ may be further substituted with another substituent, which may be any generally known substituent, as far as it does not impair the photographic performance of the compound.

In the formulae (II) and (III), $R^{21}$, $R^{31}$ and $R^{32}$ each independently represent a hydrogen atom or a substituent, m and p each independently denote an integer from 0 to 4 and n denotes an integer from 0 to 2. As the substituent represented by $R^{21}$, $R^{31}$ or $R^{32}$, any substituent may be used insofar as it does not adversely affect the photographic characteristics. Examples of the substituent include halogen atoms (e.g., a fluorine atom, chlorine atom, bromine atom and iodine atom), straight-chain, branched or cyclic alkyl groups or mixtures of these alkyl groups (preferably those having 1 to 20 carbon atoms, more preferably 1 to 16 carbon atoms and most preferably 1 to 13 carbon atoms, for example, methyl, ethyl, n-propyl, isopropyl, sec-butyl, tert-butyl, tert-octyl, n-amyl, tert-amyl, n-dodecyl, n-tridecyl and cyclohexyl), alkenyl groups (preferably those having 2 to 20 carbon atoms, more preferably 2 to 16 carbon atoms and most preferably 2 to 12 carbon atoms, for example, vinyl, allyl, 2-butenyl and 3-pentenyl), aryl groups (preferably those having 6 to 30 carbon atoms, more preferably 6 to 20 carbon atoms and most preferably 6 to 12 carbon atoms, for example, phenyl, p-methylphenyl and naphthyl), alkoxy groups (preferably those having 1 to 20 carbon atoms, more preferably 1 to 16 carbon atoms and most preferably 1 to 12 carbon atoms, for example, methoxy, ethoxy, propoxy and butoxy), aryloxy groups (preferably those having 6 to 30 carbon atoms, more preferably 6 to 20 carbon atoms and most preferably 6 to 12 carbon atoms, for example, phenyloxy and 2-naphthyloxy), acyloxy groups (preferably those having 2 to 20 carbon atoms, more preferably 2 to 16 carbon atoms and most preferably 2 to 12 carbon atoms, for example, acetoxy and benzoyloxy), amino groups (preferably those having 0 to 20 carbon atoms, more preferably 1 to 16 carbon atoms and most preferably 1 to 12 carbon atoms, for example, a dimethylamino group, a diethylamino group, a dibutylamino group and an anilino group), acylamino groups (preferably those having 2 to 20 carbon atoms, more preferably 2 to 16 carbon atoms and most preferably 2 to 13 carbon atoms, for example, acetylamino, tridecanoylamino and benzoylamino), sulfonylamino groups (preferably those having 1 to 20 carbon atoms, more preferably 1 to 16 carbon atoms and most preferably 1 to 12 carbon atoms, for example, methanesulfonylamino, butanesulfonylamino and benzenesulfonylamino), ureide groups (preferably those having 1 to 20 carbon atoms, more preferably 1 to 16 carbon atoms and most preferably 1 to 12 carbon atoms, for example, ureide, methylureide and phenylureide), carbamate groups (preferably those having 2 to 20 carbon atoms, more preferably 2 to 16 carbon atoms and most preferably 2 to 12 carbon atoms, for example, methoxycarbonylamino and phenyloxycarbonylamino), a carboxyl group, carbamoyl groups (preferably those having 1 to 20 carbon atoms, more preferably 1 to 16 carbon atoms and most preferably 1 to 12 carbon atoms, for example, carbamoyl, N,N-diethylcarbamoyl, N-dodecylcarbamoyl and N-phenylcarbamoyl), alkoxycarbonyl groups (preferably those having 2 to 20 carbon atoms, more preferably 2 to 16 carbon atoms and most preferably 2 to 12 carbon atoms, for example, methoxycarbonyl, ethoxycarbonyl and butoxycarbonyl), acyl groups (preferably those having 2 to 20 carbon atoms, more preferably 2 to 16 carbon atoms and most preferably 2 to 12 carbon atoms, for example, acetyl, benzoyl, formyl and pivaloyl), a sulfo group, sulfonyl groups (preferably those having 1 to 20 carbon atoms, more preferably 1 to 16 carbon atoms and most preferably 1 to 12 carbon atoms, for example, mesyl and tosyl), sulfamoyl groups (preferably those having 0 to 20 carbon atoms, more preferably 0 to 16 carbon atoms and most preferably 0 to 12 carbon atoms, for example, sulfamoyl, methylsulfamoyl, dimethylsulfamoyl and phenylsulfamoyl), a cyano group, nitro group, hydroxyl group, mercapto group, alkylthio groups (preferably those having 1 to 20 carbon atoms, more preferably 1 to 16 carbon atoms and most preferably 1 to 12 carbon atoms, for example, methylthio and butylthio) and heterocyclic groups (preferably those having 2 to 20 carbon atoms, more preferably 2 to 16 carbon atoms and most preferably 2 to 12 carbon atoms, for example, pyridyl, imidazolyl and pyrrolidyl). These substituents may be further substituted with other substituents.

Among the aforementioned examples, preferable examples of the substituent represented by $R^{21}$, $R^{31}$ and $R^{32}$ in the general formula (II) and (III) include halogen atoms, alkyl groups, aryl groups, alkoxy groups, aryloxy groups, acyloxy groups, anilino groups, acylamino groups, sulfonylamino groups, carboxyl group, carbamoyl groups, acyl groups, a sulfo group, sulfonyl groups, sulfamoyl groups, a cyano group, hydroxyl group, mercapto group, alkylthio groups and heterocyclic groups.

Here, the compound represented by the general formula (II) preferably has at the 2-position thereof a carbamoyl group (preferably those having 1 to 20 carbon atoms, more preferably 1 to 16 carbon atoms and most preferably 1 to 12 carbon atoms, for example, a carbamoyl, a N,N-diethylcarbamoyl, a N-dodecylcarbamoyl, a N-phenylcarbamoyl, a N-(2-chlorophenyl)carbamoyl, a N-(4-chlorophenyl)carbamoyl, a N-(2,4-dichlorophenyl)carbamoyl and a N-(3,4-dichlorophenyl)carbamoyl). More preferably, the compound represented by the general formula (II) has at the 2-position thereof an arylcarbamoyl group (preferably those having 7 to 20 carbon atoms, more preferably 7 to 16 carbon atoms and most preferably 7 to 12 carbon atoms, for example, N-phenylcarbamoyl, N-(2-chlorophenyl)carbamoyl, N-(4-chlorophenyl)carbamoyl, N-(2,4-dichlorophenyl)carbamoyl and N-(3,4-dichlorophenyl)carbamoyl).

Specific examples of the compound represented by the general formula (III) will be hereinafter explained. However, these examples are not intended to limit the scope of the present invention.

(3-1)

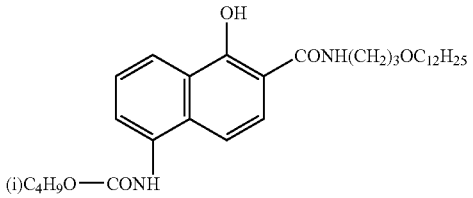

(3-2)

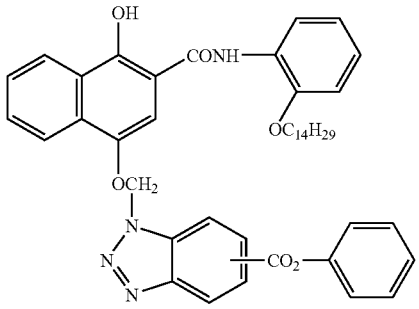

(3-3)

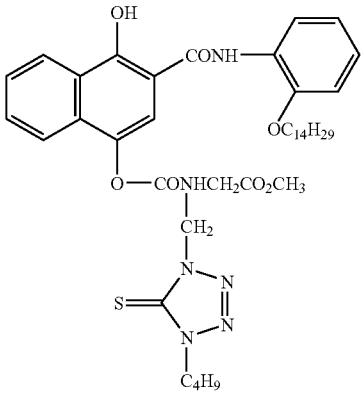

(3-4)

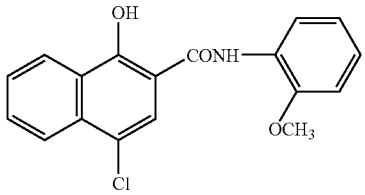

-continued
(3-5)
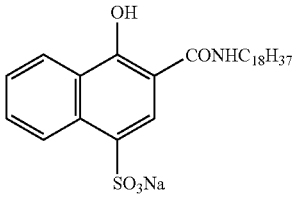
(3-6)
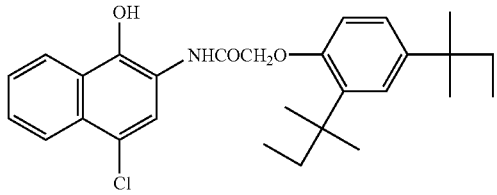
(3-7)
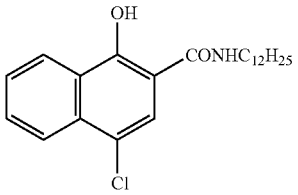
(3-8)
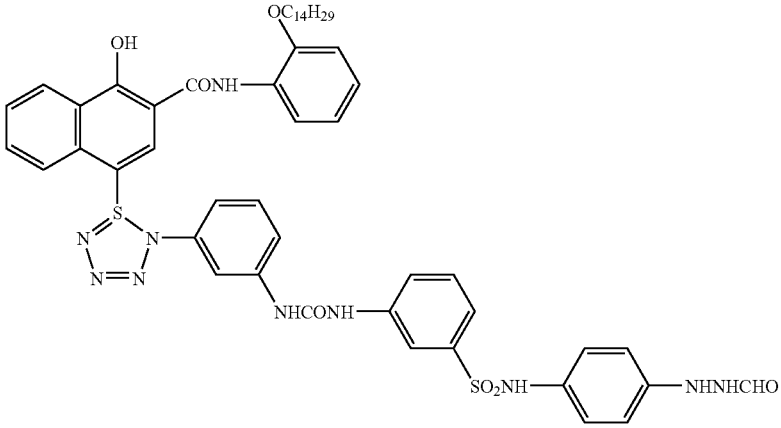
(3-9)
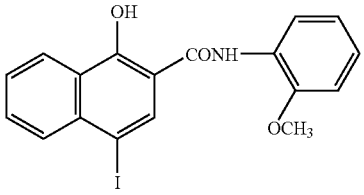
(3-10)
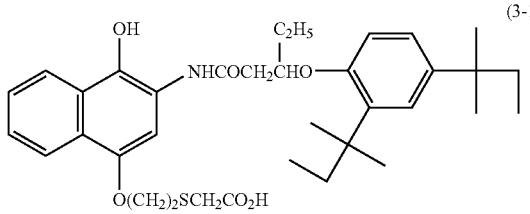
(3-11)
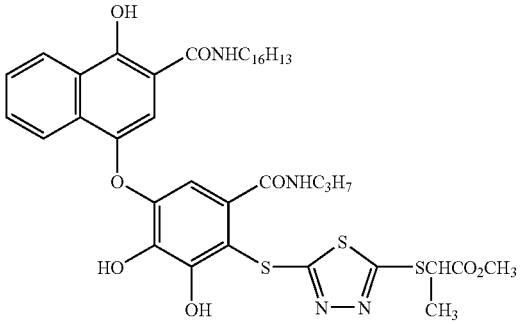

The compounds represented by the aforementioned general formulae (II) and (III) may be easily synthesized by a method known in the photographic field.

The compounds represented by the general formulae (II) and (III) may be dissolved, when they are used, in water or a proper organic solvent such as alcohols (e.g., methanol, ethanol, propanol and fluoroalcohol), ketones (e.g., acetone and methyl ethyl ketone), dimethylformamide, dimethylsulfoxide and methyl cellosolve.

Alternatively, when the compound is used, the compound may be dissolved using an oil such as dibutyl phthalate, tricresyl phosphate, glyceryl triacetate and diethyl phthalate, or an auxiliary solvent such as ethyl acetate or cyclohexane, to make an emulsion dispersion mechanically according to an emulsion dispersing method that is already known. Or when the compound is used, a powder of the compound may be dispersed in water by using a ball mill, colloid mill, sand grinder mill, munton gorlin, microfluidizer or ultrasonic wave according to a well-known solid dispersing method.

The compound represented by the general formula (II) or (III) may be added to any layer provided on the support as long as the compound is added to the same plane and/or layer which comprises the photosensitive silver halide and the reducible silver salt. However, the compound is preferably added to a layer containing the silver halide or to a layer adjacent to the layer.

The amount of the compound represented by the general formula (II) and (III) to be added is preferably 0.2 to 200 mmol, more preferably 0.3 to 100 mmol and most preferably 0.5 to 30 mmol per one mol of silver. The compounds represented by the formulae (II) and (III) maybe used singly or in combinations of two or more.

It is particularly preferable that the compound of the general formula (I) is used in combination with the compound of the general formula (III).

The compounds represented by the general formula (II) are preferably compounds represented by the general formula (IV) or (V).

General formula (IV)

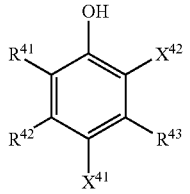

General formula (V)

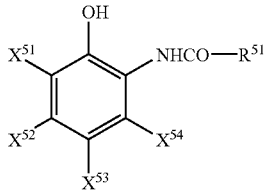

In the general formula (IV), $R^{41}$, $R^{42}$, $R^{43}$, $X^{41}$ and $X^{42}$ each independently represent a substituent connected to a benzene ring through a hydrogen atom, halogen atom, carbon atom, oxygen atom, nitrogen atom, sulfur atom or phosphorous atom in the substituent. At least one of $X^{41}$ and $X^{42}$ is a group represented by —$NR^{44}R^{45}$. $R^{44}$ and $R^{45}$ each independently represent a hydrogen atom, an alkyl group, an alkenyl group, an alkinyl group, an aryl group, a heterocyclic group or a group represented by —C(═O)—R, —C(═O)—C(═O)—R, —$SO_2$—R, —SO—R, —P(═O)$(R)^2$ or —C(═NR')—R. R and R' are each independently a group selected from a hydrogen atom, an alkyl group, an aryl group, a heterocyclic group, an amino group, an alkoxy group and an aryloxy group. These substituents may form a ring, which is formed by the bonding of those groups adjacent to each other.

In the general formula (V), $X^{51}$ represents a substituent, $X^{52}$ to $X^{54}$ each independently represent a hydrogen atom or a substituent. $X^{51}$ to $X^{54}$ do not represent a hydroxy group and $X^{53}$ does not represent a sulfonamide group. The substituents represented by $X^{51}$ to $X^{54}$ may be combined with each other to form a ring. $R^{51}$ represents a hydrogen atom, an alkyl group, an aryl group, a heterocyclic group, an amino group or an alkoxy group.

The developing accelerator represented by the general formula (IV) will be explained below.

In the general formula (IV), $R^{41}$ to $R^{43}$ each independently represent a substituent connected to a benzene ring of the accelerator through a hydrogen atom, halogen atom, carbon atom, oxygen atom, nitrogen atom, sulfur atom or phosphorous atom. Specific examples of the substituent connected to a benzene ring through a carbon atom include straight-chain, branched or cyclic alkyl groups (e.g., methyl, ethyl, iso-propyl, tert-butyl, n-octyl, tert-amyl, 1,3-tetramethylbutyl and cyclohexyl), alkenyl groups (e.g., vinyl, allyl, 2-butenyl and 3-pentenyl), alkinyl groups (e.g., a propargyl group and 3-pentinyl group), aryl groups (e.g., phenyl, p-methylphenyl and naphthyl), acyl groups (e.g., acetyl, benzoyl, formyl and pivaloyl), alkoxycarbonyl groups (e.g., methoxycarbonyl and ethoxycarbonyl), aryloxycarbonyl groups (e.g., phenoxycarbonyl), carbamoyl groups (e.g., carbamoyl, diethylcarbamoyl and phenylcarbamoyl), a cyano group, a carboxyl group and heterocyclic groups (e.g., a 3-pyrazolyl group).

Specific examples of the substituent connected to a benzene ring through an oxygen atom include a hydroxyl group, alkoxy groups (e.g., methoxy, ethoxy and butoxy), aryloxy groups (e.g., phenyloxy and 2-naphthyloxy), heterocyclic oxy groups (e.g., a 4-pyridyloxy group) and acyloxy groups (e.g., acetoxy and benzoyloxy). Unlimited specific examples of the substituent connected to a benzene ring through a nitrogen atom include amino groups (e.g., amino, methylamino, dimethylamino, diethylamino and dibenzylamino), a nitro group, a hydrazino group, heterocyclic groups (e.g., 1-imidazolyl and morpholyl), acylamino groups (e.g., acetylamino and benzoylamino), alkoxycarbonylamino groups (e.g., methoxycarbonylamino), aryloxycarbonylamino groups (e.g., phenyloxycarbonylamino), sulfonylamino groups (e.g., methanesulfonylamino and benzenesulfonylamino), sulfamoyl groups (e.g., sulfamoyl, methylsulfamoyl, dimethylsulfamoyl and phenylsulfamoyl), ureide groups (e.g., ureide, methylureide and phenylureide), phosphorylamino groups (e.g., diethylphosphorylamino) and imide groups (e.g., succinimide, phthalimide and trifluoromethanesulfonimide). Unlimited specific examples of the substituent connected to a benzene ring through a sulfur atom include a mercapto group, a disulfide group, a sulfo group, a sulfino group, a sulfonylthio group, a thiosulfonyl group, alkylthio groups (e.g., methylthio and ethylthio), arylthio groups (e.g., phenylthio), sulfonyl groups (e.g., mesyl, tosyl and phenylsulfonyl), sulfinyl groups (e.g., methanesulfinyl and benzenesulfinyl) and heterocyclic thio groups (e.g., 2-imidazolylthio group). Unlimited specific examples of the substituent connected to a benzene ring through a phosphorous atom include phosphates (e.g., diethylphosphoric acid and diphenylphosphoric acid).

Preferable examples of $R^{41}$ to $R^{43}$ in the general formula (IV) include a hydrogen atom, halogen atoms, straight-chain, branched or cyclic alkyl groups, aryl groups, acyl groups, alkoxycarbonyl groups, aryloxycarbonyl groups, a cyano group, a carboxyl group, heterocyclic groups, a hydroxyl group, alkoxy groups, aryloxy groups, heterocyclic oxy groups, acyloxy groups, amino groups, nitro group heterocyclic groups, acylamino groups, alkoxycarbonylamino groups, aryloxycarbonylamino groups, sulfonylamino groups, imide groups, sulfamoyl groups, carbamoyl groups, ureide groups, a mercapto group, disulfide groups, sulfo groups, sulfino groups, alkylthio groups, arylthio groups, sulfonyl groups, sulfinyl groups and heterocyclic thio groups.

More preferable examples of $R^{41}$ to $R^{43}$ in the general formula (IV) include a hydrogen atom, halogen atoms, straight-chain, branched or cyclic alkyl groups, aryl groups, acyl groups, alkoxycarbonyl groups, aryloxycarbonyl groups, a cyano group, carboxyl groups, heterocyclic groups, a hydroxyl group, alkoxy groups, aryloxy groups, acyloxy groups, amino groups, nitro group, heterocyclic groups, acylamino groups, alkoxycarbonylamino groups, aryloxycarbonylamino groups, sulfonylamino groups, imide groups, carbamoyl groups, mercapto groups, sulfo groups, alkylthio groups, arylthio groups and sulfonyl groups.

Particularly preferable examples of $R^{41}$ to $R^{43}$ in the general formula (IV) include a hydrogen atom, halogen atoms, straight-chain, branched or cyclic alkyl groups, aryl groups, acyl groups, alkoxycarbonyl groups, aryloxycarbonyl groups, cyano group, carboxyl groups, acyloxy groups, acylamino groups, alkoxycarbonylamino groups, aryloxycarbonylamino groups, sulfonylamino groups, carbamoyl groups, sulfo groups, alkylsulfonyl groups and arylsulfonyl groups.

In the general formula (IV), $X^{41}$ and $X^{42}$ respectively represent a substituent connected to a benzene ring through a hydrogen atom, a halogen atom, a carbon atom, a oxygen atom, a nitrogen atom, a sulfur atom or a phosphorous atom comprised therein. Specific examples of the substituent connected to a benzene ring through a carbon atom include straight-chain, branched or cyclic alkyl groups (e.g., methyl, ethyl, iso-propyl, tert-butyl, n-octyl, tert-amyl, 1,3-tetramethylbutyl and cyclohexyl), alkenyl groups (e.g., vinyl, allyl, 2-butenyl and 3-pentenyl), alkinyl groups (e.g., a propargyl group and 3-pentinyl group), aryl groups (e.g., phenyl, p-methylphenyl and naphthyl), acyl groups (e.g., acetyl, benzoyl, formyl and pivaloyl), alkoxycarbonyl groups (e.g., methoxycarbonyl and ethoxycarbonyl), aryloxycarbonyl groups (e.g., phenoxycarbonyl), a cyano group, carboxyl groups, heterocyclic groups (e.g., a 3-pyrazolyl group) and carbamoyl groups (e.g., carbamoyl, diethylcarbamoyl and phenylcarbamoyl).

Unlimited Specific examples of the substituent connected to a benzene ring through an oxygen atom in the general formula (IV) include a hydroxyl group, alkoxy groups (e.g., methoxy, ethoxy and butoxy), aryloxy groups (e.g., phenyloxy and 2-naphthyloxy), heterocyclic oxy groups (e.g., a 4-pyridyloxy group) and acyloxy groups (e.g., acetoxy and benzoyloxy).

Specific examples of the substituent connected to a benzene ring through a nitrogen atom in the general formula (IV) include amino groups (e.g., amino, methylamino, dimethylamino, diethylamino and dibenzylamino), a nitro group, hydroxam groups, hydrazino groups, heterocyclic groups (e.g., 1-imidazolyl and morpholyl), acylamino groups (e.g., acetylamino and benzoylamino), alkoxycarbonylamino groups (e.g., methoxycarbonylamino), aryloxycarbonylamino groups (e.g., phenyloxycarbonylamino), sulfonylamino groups (e.g., methanesulfonylamino and benzenesulfonylamino), sulfamoyl groups (e.g., sulfamoyl, methylsulfamoyl, dimethylsulfamoyl and phenylsulfamoyl) and phosphorylamino groups (e.g., diethylphosphorylamino).

Specific examples of the substituent connected to a benzene ring through a sulfur atom in the general formula (IV) include mercapto groups, disulfide groups, sulfo groups, sulfino groups, sulfonylthio groups, thiosulfonyl groups, alkylthio groups (e.g., methylthio and ethylthio) arylthio groups (e.g., phenylthio), sulfonyl groups (e.g., mesyl, tosyl and phenylsulfonyl), sulfinyl groups (e.g., methanesulfinyl and benzenesulfinyl) and heterocyclic thio groups (e.g., a 2-imidazolylthio group).

Unlimited specific examples of the substituent connected to a benzene ring through a phosphorous atom include phosphate groups (e.g., diethylphosphoric acid and diphenylphosphoric acid).

Preferable examples of $X^{41}$ and $X^{42}$ in the general formula (IV) include a hydrogen atom, halogen atoms, straight-chain, branched or cyclic alkyl groups, aryl groups, acyl groups, alkoxycarbonyl groups, aryloxycarbonyl groups, cyano groups, carboxyl groups, heterocyclic groups, hydroxyl group, alkoxy groups, aryloxy groups, heterocyclic oxy groups, acyloxy groups, amino groups, nitro groups, heterocyclic groups, acylamino groups, alkoxycarbonylamino groups, aryloxycarbonylamino groups, sulfonylamino groups, imide groups, sulfamoyl groups, carbamoyl groups, ureide groups, mercapto groups, disulfide groups, sulfo groups, alkylthio groups, arylthio groups, sulfonyl groups, heterocyclic thio groups.

More preferable examples of $X^{41}$ and $X^{42}$ in the general formula (IV) include a hydrogen atom, halogen atoms, straight-chain, branched or cyclic alkyl groups, aryl groups, acyl groups, alkoxycarbonyl groups, aryloxycarbonyl groups, cyano groups, carboxyl groups, a hydroxyl group, alkoxy groups, aryloxy groups, acyloxy groups, amino groups, acylamino groups, alkoxycarbonylamino groups, aryloxycarbonylamino groups, sulfonylamino groups, imide groups, carbamoyl groups, sulfo groups and arylsulfonyl groups.

Particularly preferable examples of $X^{41}$ and $X^{42}$ in the general formula (IV) include a hydrogen atom, halogen atoms, straight-chain, branched or cyclic alkyl groups, aryl groups, acyl groups, alkoxycarbonyl groups, aryloxycarbonyl groups, cyano groups, carboxyl groups, alkoxy groups, aryloxy groups, acyloxy groups, acylamino groups, alkoxycarbonylamino groups, aryloxycarbonylamino groups, sulfonylamino groups, carbamoyl groups, mercapto groups and alkylthio groups.

At least one of $X^{41}$ and $X^{42}$ is a group represented by $—NR^{44}R^{45}$. $R^{44}$ and $R^{45}$ each independently represent a hydrogen atom, an alkyl group, an alkenyl group, an alkinyl group, an aryl group, a heterocyclic group or a group represented by —C(=O)—R, —C(=O)—C(=O)—R, $—SO_2—R$, —SO—R, $—P(=O)(R)_2$ or —C(=NR')—R. R and R' are respectively a group selected from a hydrogen atom, an alkyl group, an aryl group, a heterocyclic group, an amino group, an alkoxy group and an aryloxy group.

When $R^{44}$ and $R^{45}$ each independently represent a hydrogen atom, an alkyl group, an alkenyl group, an alkinyl group, an aryl group or a heterocyclic group, they each independently represent, for example, a straight-chain, branched or cyclic alkyl group (e.g., methyl, ethyl, iso-propyl, tert-butyl, n-octyl, tert-amyl, 1,3-tetramethylbutyl or cyclohexyl), an alkenyl group (e.g., vinyl, allyl, 2-butenyl or 3-pentenyl), an alkinyl group (e.g., a propargyl group or 3-pentenyl group), an aryl group (e.g., phenyl, p-methylphenyl or naphthyl) or a heterocyclic group (e.g., a 2-imidazolyl group or 1-pyrazolyl group).

When $R^{44}$ and $R^{45}$ each independently represent a group represented by —C(=O)—R, —C(=O)—C(=O)—R, —$SO_2$—R, —SO—R, —P(═O)$(R)_2$ or —C(═NR')—R, R and R' each independently represent a hydrogen atom, an alkyl group (e.g., methyl, ethyl, iso-propyl, tert-butyl, n-octyl, tert-amyl, 1,3-tetramethylbutyl or cyclohexyl), an aryl group (e.g., phenyl, p-methylphenyl or naphthyl), a heterocyclic group (e.g., 4-pyridyl, 2-thienyl or 1-methyl-2-pyrrolyl), an amino group (e.g., amino, dimethylamino, diphenylamino, phenylamino or 2-pyridylamino), an alkoxy group (e.g., methoxy, ethoxy or cyclohexyloxy) or an aryloxy group (e.g., phenoxy or 2-naphthoxy).

Preferable examples of $R^{44}$ and $R^{45}$ in the general formula (IV) include a hydrogen atom, straight-chain, branched or cyclic alkyl groups, aryl groups, acyl groups, alkoxycarbonyl groups, aryloxycarbonyl groups, sulfamoyl groups, carbamoyl groups, sulfonyl groups and sulfinyl groups. More preferable examples of $R^{44}$ and $R^{45}$ include a hydrogen atom, straight-chain, branched or cyclic alkyl groups, aryl groups, acyl groups and sulfonyl groups. Also, a particularly preferable combination of $R^{44}$ and $R^{45}$ is the case where one of $R^{44}$ and $R^{45}$ is a hydrogen atom and another one is an alkylsulfonyl group or an arylsulfonyl group. These substituents may be further substituted with the substituents described above. If these substituents has a highly acidic hydrogen atom, its proton may be dissociated to form a salt. As its counter cation to form the salt, a metal ion, an ammonium ion or a phosphonium ion may be used. The state in which an active hydrogen is dissociated in this manner is effective for the case where a problem concerning the diffusibility of a compound during developing arises. Adjacent groups among $R^{41}$, $R^{42}$, $R^{43}$, $X^{41}$ and $X^{42}$ may be combined to each other to form a ring.

Specific examples of the compound represented by the general formula (IV) will be shown below. However, the compounds which are represented by the general formula (IV) are not limited to these examples.

4-1

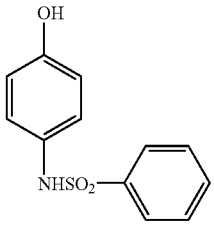

4-2

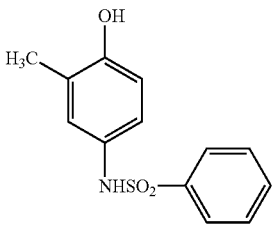

4-3

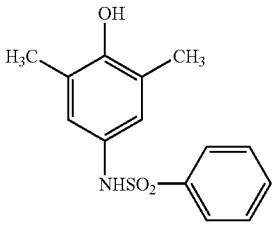

-continued 4-4

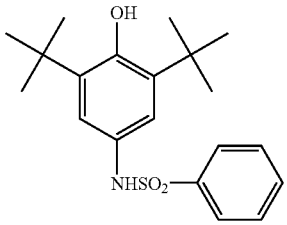

4-5

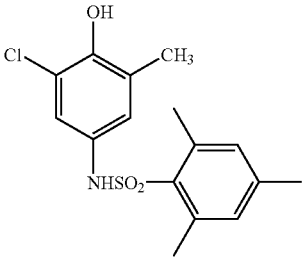

4-6

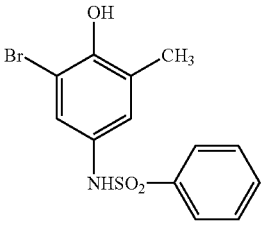

4-7

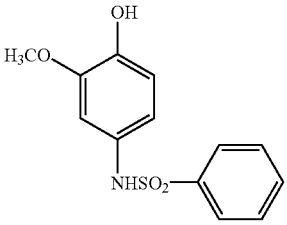

4-8

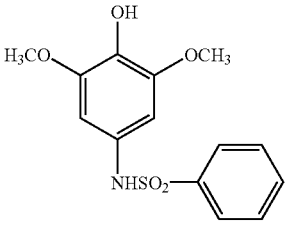

4-9

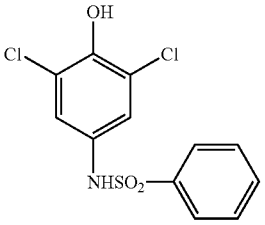

-continued
4-10
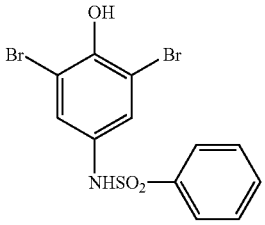
4-11
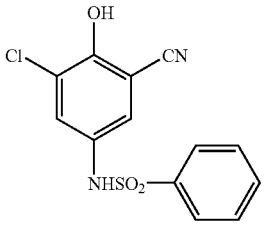
4-12
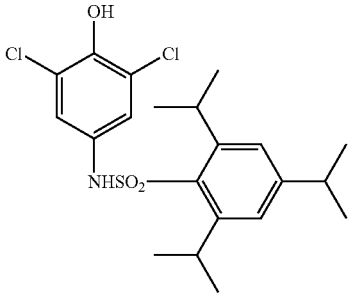
4-13
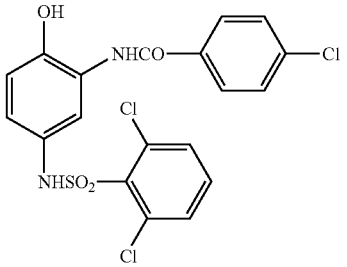
4-14
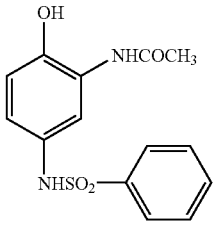
4-15
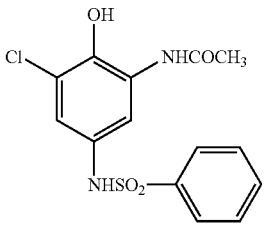
-continued
4-16
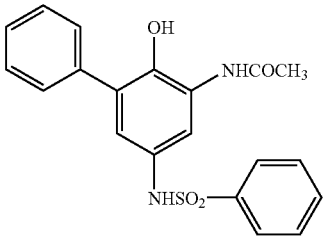
4-17
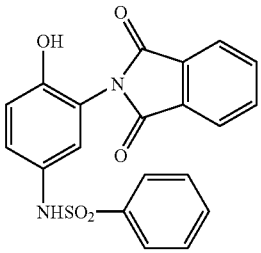
4-18
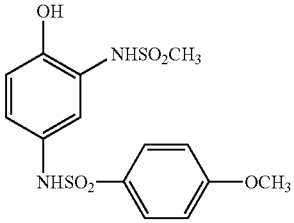
4-19
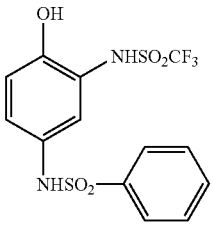
4-20
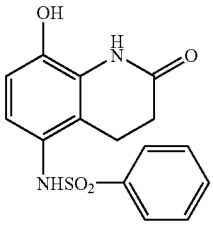
4-21
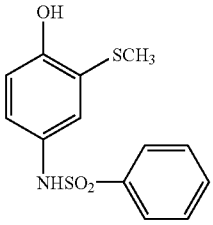

-continued
4-22
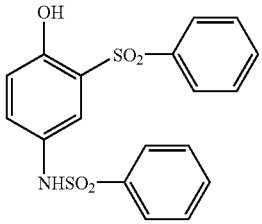
4-23
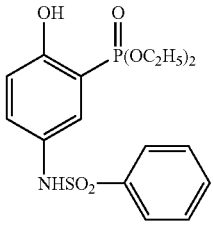
4-24
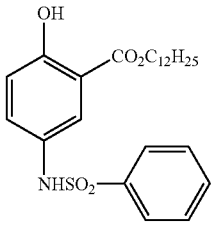
4-25
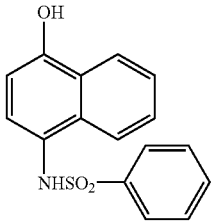
4-26
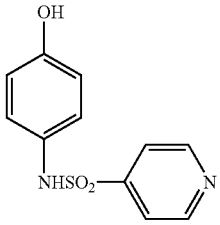
4-27
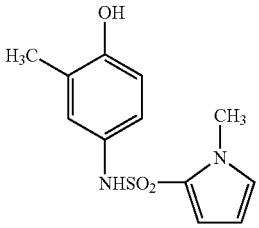
-continued
4-28
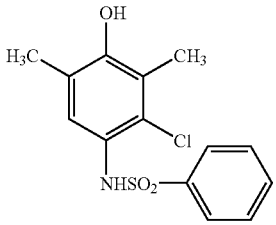
4-29
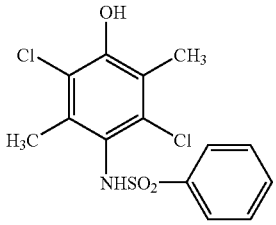
4-30
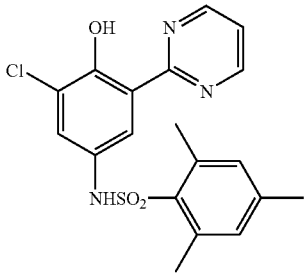
4-31
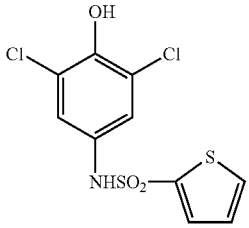
4-32
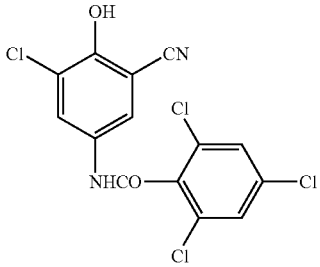
4-33
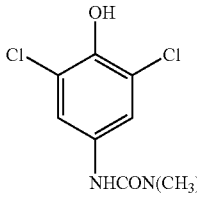

-continued
4-34
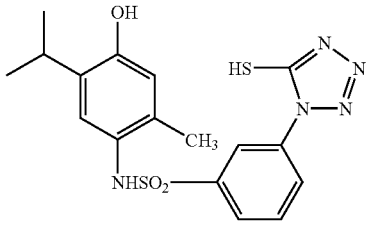
4-35
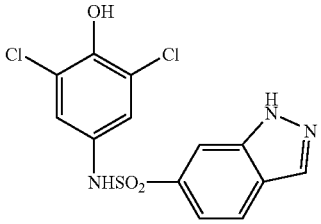
4-36
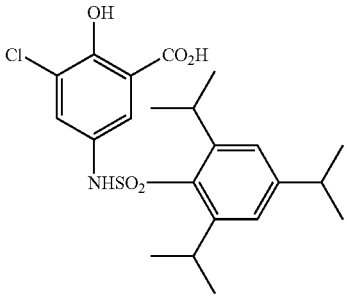
4-37
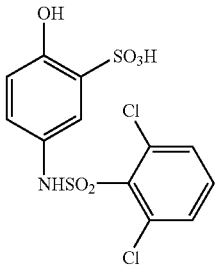
4-38
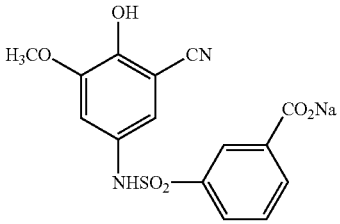
4-39
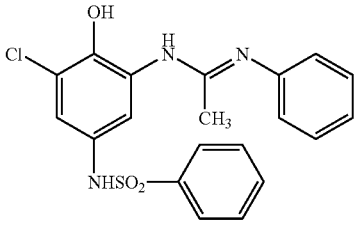
-continued
4-40
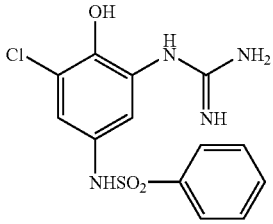
4-41
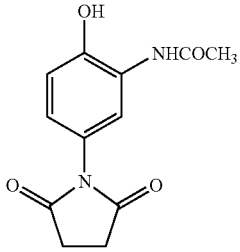
4-42
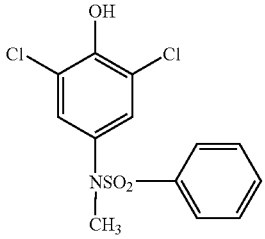
4-43
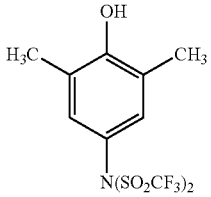
4-44
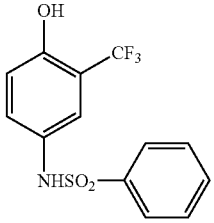
4-45
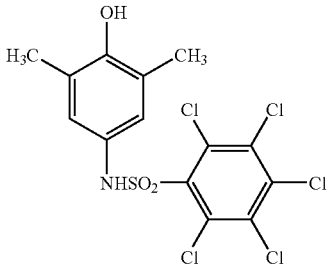

-continued
4-46
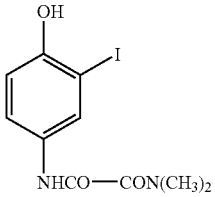
4-47
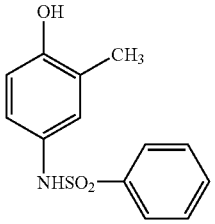
4-48
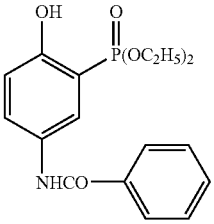
4-49
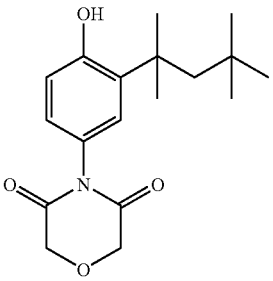
4-50
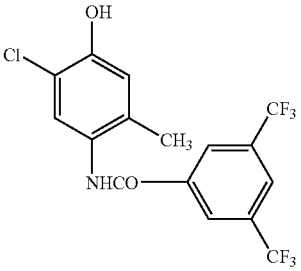
4-51
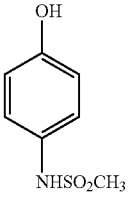
-continued
4-52
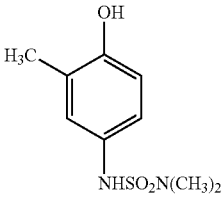
4-53
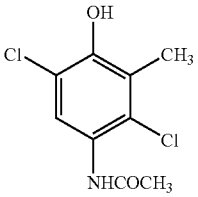
4-54
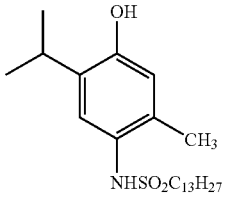
4-55
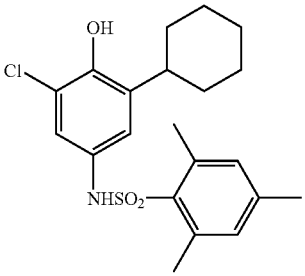
4-56
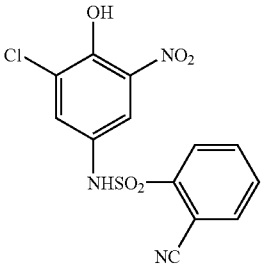
4-57
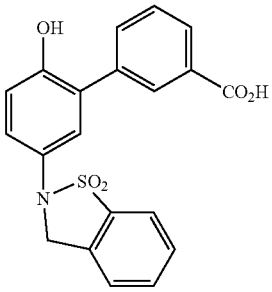

-continued
4-58
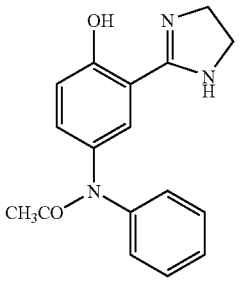
4-59
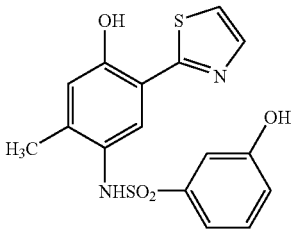
4-60
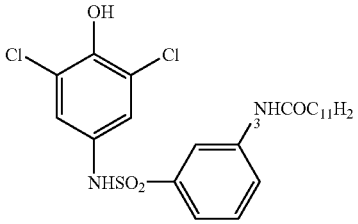
4-61
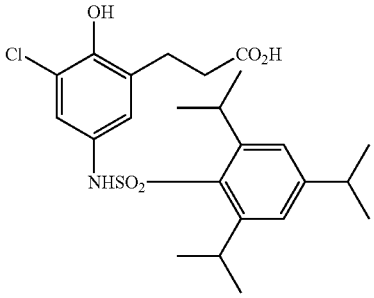
4-62
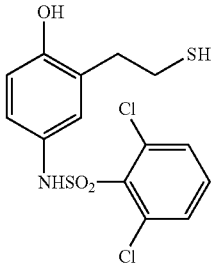
4-63
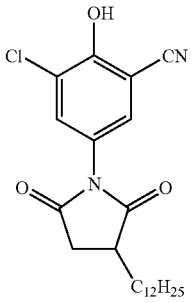
-continued
4-64
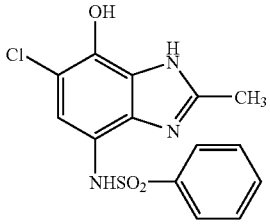
4-65
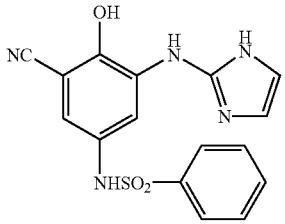
4-66
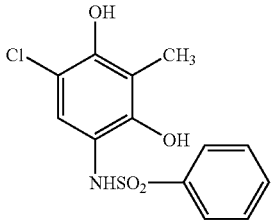
4-67
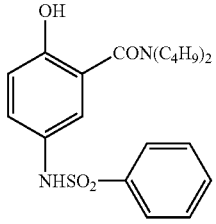
4-68
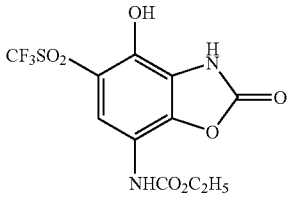
4-69
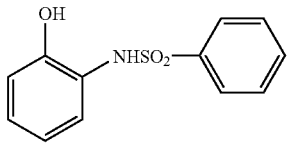
4-70
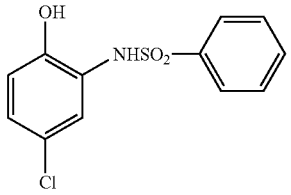

-continued
4-71
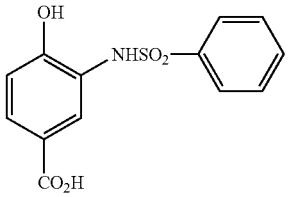
4-72
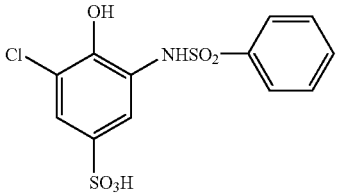
4-73
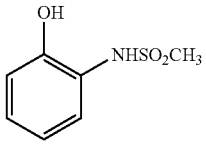
4-74
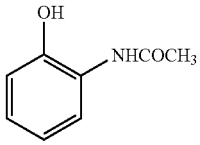
4-75
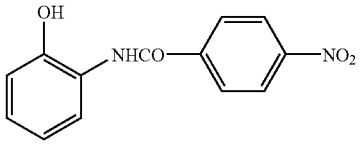
4-76
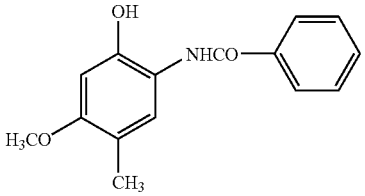
4-77
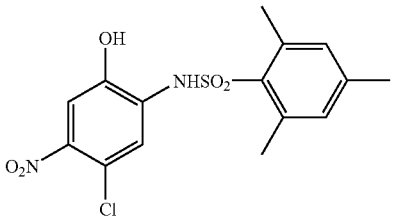
4-78
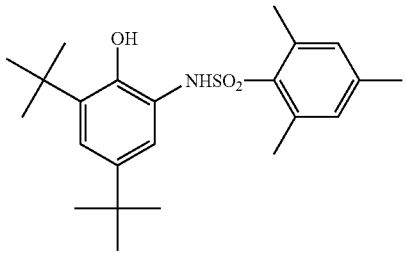
-continued
4-79
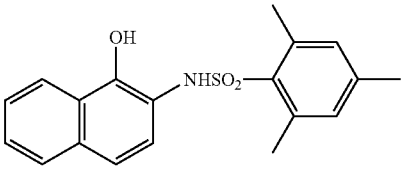
4-80
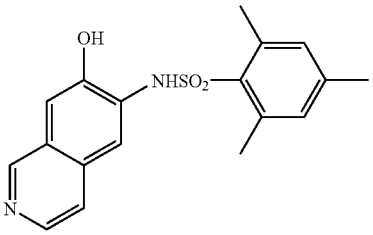
4-81
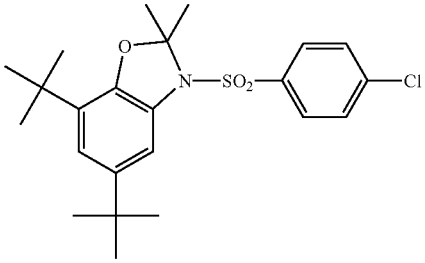
4-82
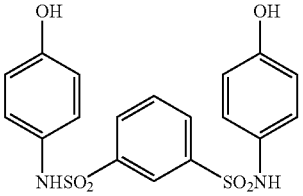
4-83
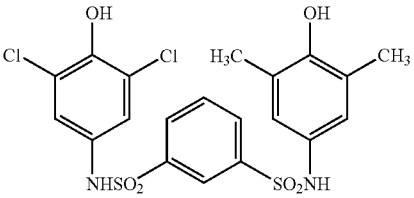
4-84
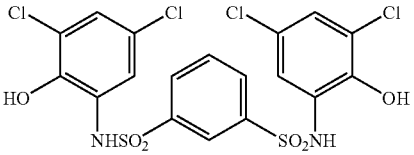
4-85
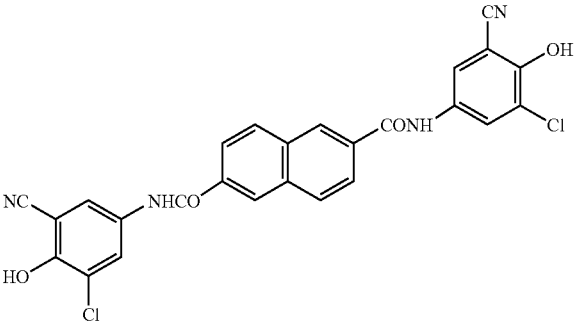

-continued 4-86

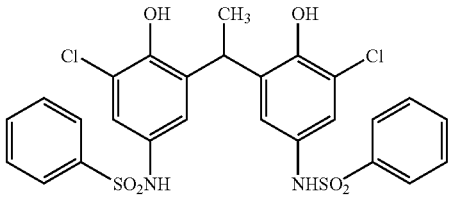

4-87

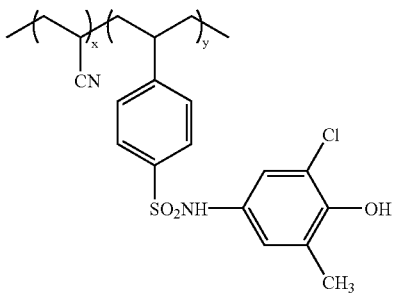

4-88

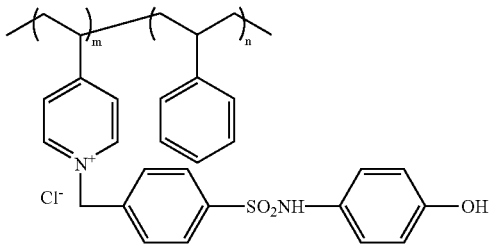

4-89

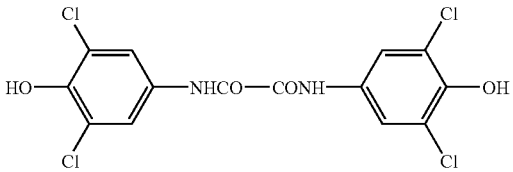

The developing accelerator represented by the general formula (V) will be explained below.

In the general formula (V), $X^{51}$ represents a substituent (the substituent can be substituted on a benzene ring and is not a hydrogen atom). $X^{51}$ is not a hydroxyl group. Specific examples of the substituent include halogen atoms, alkyl groups (the alkyl groups include cycloalkyl groups and bicycloalkyl groups), alkenyl groups (the alkenyl groups include cycloalkenyl groups and bicycloalkenyl groups), alkinyl groups, aryl groups, heterocyclic groups, a cyano group, a nitro group, a carboxyl group, alkoxy groups, aryloxy groups, silyloxy groups, heterocyclic oxy groups, acyloxy groups, carbamoyloxy groups, alkoxycarbonyloxy groups, aryloxycarbonyloxy groups, acylamino groups, aminocarbonylamino groups, alkoxycarbonylamino groups, aryloxycarbonylamino groups, sulfamoylamino groups, alkyl and arylsulfonylamino groups, a mercapto group, alkylthio groups, arylthio groups, heterocyclic thio groups, sulfamoyl groups, sulfo groups, alkyl and arylsulfinyl groups, alkyl and arylsulfonyl groups, acyl groups, aryloxycarbonyl groups, alkoxycarbonyl groups, carbamoyl groups, aryl and heterocyclic azo groups, imide groups, phosphino groups, phosphinyl groups, phosphinyloxy groups, phosphinylamino groups and silyl groups.

Specific examples of the substituent $X^{51}$ are described below. Examples of the halogen atoms include a fluorine atom, chlorine atom, bromine atom and iodine atom), and examples of the alkyl groups include alkyl groups which are straight-chain, branched and cyclic substituted and unsubstituted alkyl groups. Examples of those alkyl groups include alkyl groups (alkyl groups preferably having 1 to 30 carbon atoms, such as a methyl group, ethyl group, n-propyl group, isopropyl group, tert-butyl group, n-octyl group, eicosyl group, 2-chloroethyl group, 2-cyanoethyl group and 2-ethylhexyl group), cycloalkyl groups (substituted or unsubstituted cycloalkyl groups preferably having 3 to 30 carbon atoms, such as a cyclohexyl group, cyclopentyl group and 4-n-dodecylcyclohexyl group), bicycloalkyl groups (substituted or unsubstituted bicycloalkyl groups preferably having 5 to 30 carbon atoms, namely, those that are monovalent groups obtained by excluding one hydrogen atom from bicycloalkanes having 5 to 30 carbon atoms, such as a bicyclo[1,2,2]heptane-2-yl group and bicyclo[2,2,2]octane-3-yl group) and those having a tricyclo structure having a larger cyclic structure. Alkyl groups included in a substituent explained below (for example, an alkyl group in an alkylthio group) also represent those alkyl group having the same concept as mentioned above. Examples of the alkenyl groups include straight-chain, branched or cyclic substituted or unsubstituted alkenyl groups. Examples of those alkenyl groups include alkenyl groups (substituted or unsubstituted alkenyl groups preferably having 2 to 30 carbon atoms, such as a vinyl group, allyl group, pulenyl group, geranyl group and oleyl group), cycloalkenyl groups (substituted or unsubstituted cycloalkenyl groups preferably having 3 to 30 carbon atoms, namely, those that are monovalent groups obtained by excluding one hydrogen atom from cycloalkenes having 3 to 30 carbon atoms, such as a 2-cyclopentene-1-yl group and 2-cyclohexene-1-yl group), bicycloalkenyl groups (substituted or unsubstituted bicycloalkenyl groups preferably having 5 to 30 carbon atoms, namely those that are monovalent groups obtained by excluding one hydrogen atom from bicycloalkenes having one double bond, such as a bicyclo[2,2,1]hepto-2-ene-1-yl group and bicyclo[2,2,2]oct-2-ene-4-yl group)), and alkinyl groups (substituted or unsubstituted alkinyl groups preferably having 2 to 30 carbon atoms, such as an ethynyl group, propargyl group and trimethylsilylethynyl group). Examples of the aryl groups include substituted or unsubstituted aryl groups preferably having 6 to 30 carbon atoms, such as a phenyl group, p-tolyl group, naphthyl group, m-chlorophenyl group and o-hexadecanoylaminophenyl group. Examples of the heterocyclic groups include monovalent groups which are preferably obtained by excluding one hydrogen atom from five- or six-membered substituted or unsubstituted aromatic or non-aromatic heterocyclic compounds, and more preferably the heterocyclic groups are five- or six-membered aromatic heterocyclic groups having 3 to 30 carbon atoms, such as a 2-furyl group, 2-thienyl group, 2-pyrimidinyl group and 2-benzothiazolyl group. The cyano group, the nitro group, the carboxyl group are also exemplified as specific examples of the substituent $X^{51}$. Examples of the alkoxy groups include substituted or unsubstituted alkoxy groups preferably having 1 to 30 carbon atoms, such as a methoxy group, ethoxy group, isopropoxy group, tert-butoxy group, n-octyloxy group and 2-methoxyethoxy group. Examples of the aryloxy groups include substituted or unsubstituted aryloxy groups preferably having 6 to 30 carbon atoms, such as a phenoxy group, 2-methylphenoxy group, 4-tert-butylphenoxy group, 3-nitrophenoxy group and 2-tetradecanoylaminophenoxy group.

Examples of the silyloxy groups include silyloxy groups preferably having 3 to 20 carbon atoms, such as a trimethylsilyloxy group and tert-butyldimethylsilyloxy group). Examples of the heterocyclic oxy groups include substituted or unsubstituted heterocyclic oxy groups preferably having 2 to 30 carbon atoms, such as a 1-phenylnatrazole-5-oxy group and 2-tetrahydropyranyloxy group. Preferabe examples of the acyloxy group include formyloxy groups, substituted or unsubstituted alkylcarbonyloxy groups having 2 to 30 carbon atoms and substituted or unsubstituted arylcarbonyloxy groups having 6 to 30 carbon atoms, such as a formyloxy group, acetyloxy group, pivaloyloxy group, stearoyloxy group, benzoyloxy group and p-methoxyphenylcarbonyloxy group. Examples of the carbamoyloxy groups include substituted or unsubstituted carbamoyloxy groups preferably having 1 to 30 carbon atoms, such as a N,N-dimethylcarbamoyloxy group, N,N-diethylcarbamoyloxy group, morpholinocarbonyloxy group, N,N-di-n-octylaminocarbonyloxy group and N-n-octylcarbamoyloxy group. Examples of the alkoxycarbonyloxy groups include substituted or unsubstituted alkoxycarbonyloxy groups preferably having 2 to 30 carbon atoms, such as a methoxycarbonyloxy group, ethoxycarbonyloxy group, tert-butoxycarbonyloxy group and n-octylcarbonyloxy group. Examples of the aryloxycarbonyloxy groups include substituted or unsubstituted aryloxycarbonyloxy groups preferably having 7 to 30 carbon atoms, such as a phenoxycarbonyloxy group, p-methoxyphenoxycarbonyloxy group and p-n-hexadecyloxyphenoxycarbonyloxy group. Preferable examples of the acylamino groups include formylamino groups, substituted or unsubstituted alkylcarbonylamino groups having 1 to 30 carbon atoms and substituted or unsubstituted arylcarbonylamino groups having 6 to 30 carbon atoms, such as a formylamino group, acetylamino group, pivaloylamino group, lauroylamino group, benzoylamino group and 3,4,5-tri-n-octyloxyphenylcarbonylamino group. Examples of the aminocarbonylamino groups include substituted or unsubstituted aminocarbonylamino groups preferably having 1 to 30 carbon atoms, such as a carbamoylamino group, N,N-dimethylaminocarbonylamino group, N,N-diethylaminocarbonylamino group and morpholinocarbonylamino group. Examples of the alkoxycarbonylamino groups include substituted or unsubstituted alkoxycarbonylamino groups preferably having 2 to 30 carbon atoms, such as a methoxycarbonylamino group, ethoxycarbonylamino group, tert-butoxycarbonylamino group, n-octadecyloxycarbonylamino group and N-methyl-methoxycarbonylamino group. Examples of the aryloxycarbonylamino groups include substituted or unsubstituted aryloxycarbonylamino groups preferably having 7 to 30 carbon atoms, such as a phenoxycarbonylamino group, p-chlorophenoxycarbonylamino group and m-n-octyloxyphenoxycarbonylamino group. Examples of the sulfamoylamino groups include substituted or unsubstituted sulfamoylamino groups preferably having 0 to 30 carbon atoms, such as a sulfamoylamino group, N,N-dimethylaminosulfonylamino group and N-n-octylaminosulfonylamino group. Examples of the alkyl or arylsulfonylamino groups include substituted or unsubstituted alkylsulfonylamino groups preferably having 1 to 30 carbon atoms and substituted or unsubstituted arylsulfonylamino groups preferably having 6 to 30 carbon atoms, such as a methylsulfonylamino group, butylsulfonylamino group, phenylsulfonylamino group, 2,3,5-trichlorophenylsulfonylamino group and p-methylphenylsulfonylamino group. The mercapto group is also included in the examples for the substituent. Examples of the alkylthio groups include substituted or unsubstituted alkylthio groups preferably having 1 to 30 carbon atoms, such as a methylthio group, ethylthio group and n-hexadecylthio group. Examples of the arylthio groups include substituted or unsubstituted arylthio groups preferably having 6 to 30 carbon atoms, such as a phenylthio group, p-chlorophenylthio group and m-methoxyphenylthio group. Examples of the heterocyclic thio groups include substituted or unsubstituted heterocyclic thio groups preferably having 2 to 30 carbon atoms, such as a 2-benzothiazolylthio group and 1-phenyltetrazole-5-ylthio group. Examples of the sulfamoyl groups include substituted or unsubstituted sulfamoyl groups preferably having 0 to 30 carbon atoms, such as a N-ethylsulfamoyl group, N-(3-dodecyloxypropyl)sulfamoyl group, N,N-dimethylsulfamoyl group, N-acetylsulfamoyl group, N-benzoylsulfamoyl group and N-(N'-phenylcarbamoyl)sulfamoyl group. The sulfo group is also included in the examples of the substituent. Examples of the alkyl or arylsulfinyl groups include substituted or unsubstituted alkylsulfinyl groups preferably having 1 to 30 carbon atoms and substituted or unsubstituted arylsulfinyl groups preferably having 6 to 30 carbon atoms, such as a methylsulfinyl group, ethylsulfinyl group, phenylsulfinyl group and p-methylphenylsulfinyl group. Examples of the alkyl or arylsulfonyl groups include substituted or unsubstituted alkylsulfonyl groups preferably having 1 to 30 carbon atoms and substituted or unsubstituted arylsulfonyl groups preferably having 6 to 30 carbon atoms, such as a methylsulfonyl group, ethylsulfonyl group, phenylsulfonyl group and p-methylphenylsulfonyl group. Preferable examples of the acyl groups include formyl groups, substituted or unsubstituted alkylcarbonyl groups having 2 to 30 carbon atoms, substituted or unsubstituted arylcarbonyl groups having 7 to 30 carbon atoms and substituted or unsubstituted heterocyclic carbonyl groups which have 4 to 30 carbon atoms and wherein a hetero ring is connected through a carbon atom to a carbonyl group, such as an acetyl group, pivaloyl group, 2-chloroacetyl group, stearoyl group, benzoyl group, p-n-octyloxyphenylcarbonyl group, 2-pyridylcarbonyl group and 2-furylcarbonyl group. Examples of the aryloxycarbonyl groups include substituted or unsubstituted aryloxycarbonyl groups preferably having 7 to 30 carbon atoms, such as a phenoxycarbonyl group, o-chlorophenoxycarbonyl group, m-nitrophenoxycarbonyl group and p-tert-butylphenoxycarbonyl group. Examples of the alkoxycarbonyl groups include substituted or unsubstituted alkoxycarbonyl groups preferably having 2 to 30 carbon atoms, such as a methoxycarbonyl group, ethoxycarbonyl group, tert-butoxycarbonyl group and n-octadecyloxycarbonyl group. Examples of the carbamoyl groups include substituted or unsubstituted carbamoyl groups preferably having 1 to 30 carbon atoms, such as carbamoyl group, N-methylcarbamoyl group, N,N-dimethylcarbamoyl group, N,N-di-n-octylcarbamoyl group and N-(methylsulfonyl)carbamoyl group. Examples of the aryl or heterocyclic azo groups include substituted or unsubstituted arylazo groups preferably having 6 to 30 carbon atoms and substituted or unsubstituted heterocyclic azo groups preferably having 3 to 30 carbon atoms, such as a phenylazo group, p-chlorophenylazo group, 5-ethylthio-1,3,4-thiadiazole-2-ylazo group. Preferable examples of the imide groups include a N-succinimide group and N-phthalimide group. Examples of the phosphino groups include substituted or unsubstituted phosphino groups preferably having 2 to 30 carbon atoms, such as a dimethylphosphino group, diphenylphosphino group and methylphenoxyphosphino group. Examples of the phosphinyl group include substituted or unsubstituted phosphinyl groups preferably having 2 to 30 carbon atoms such as a phosphinyl group, dioctyloxyphosphinyl group and diethoxyphosphinyl group. Examples of the phosphinyloxy groups include substituted or unsubstituted phosphinyloxy groups preferably having 2 to 30 carbon atoms, such as a diphenoxyphosphinyloxy group and dioctyloxyphosphinyloxy group. Examples of the phosphinylamino group include substituted or unsubstituted phosphinylamino groups preferably having 2 to 30 carbon atoms, such as a dimethoxyphosphinylamino group and dimethylaminophosphinylamino group. Examples of the silyl groups include substituted or unsubstituted silyl groups preferably having 3 to 30 carbon atoms, such as a trimethylsilyl group, tert-butyldimethylsilyl group and phenyldimethylsilyl group.

Preferable examples of the substituent represented by $X^{51}$ in the general formula (V) include halogen atoms (a fluorine atom, chlorine atom, bromine atom and iodine atom and preferably a chlorine atom and bromine atom), acylamino groups (the acylamino groups have preferably 1 to 20 carbon atoms, more preferably 1 to 14 carbon atoms, and most preferably 1 to 8 carbon atoms, and examples thereof include a formylamino group, acetylamino group and benzoylamino group), alkyl groups (the alkyl groups have preferably 1 to 20 carbon atoms, more preferably 1 to 14 carbon atoms and most preferably 1 to 8 carbon atoms, and examples thereof include a methyl group, ethyl group, isopropyl group and cyclohexyl group), aryl groups (the aryl groups have preferably 6 to 20 carbon atoms, more preferably 6 to 14 carbon atoms and most preferably 6 to 8 carbon atoms, and examples thereof include a phenyl group, naphthyl group and p-methylphenyl group), alkoxy groups (the alkoxy group have preferably 1 to 20 carbon atoms, more preferably 1 to 14 carbon atoms and particularly preferably 1 to 8 carbon atoms, and examples thereof include a methoxy group and ethoxy group), aryloxy groups (the aryloxy group have preferably 6 to 20 carbon atoms, more preferably 6 to 14 carbon atoms and most preferably 6 to 8 carbon atoms, and examples thereof include a phenoxy group and 2-naphthyloxy group), acyloxy groups (the acyloxy group have preferably 1 to 20 carbon atoms, more preferably 1 to 14 carbon atoms and most preferably 1 to 8 carbon atoms, and examples thereof include acetoxy group and benzoyloxy group), sulfonylamino groups (the sulfonylamino groups have preferably 1 to 20 carbon atoms, more preferably 1 to 14 carbon atoms and most preferably 1 to 8 carbon atoms, and examples thereof include a methanesulfonylamino group and benzenesulfonylamino group), carbamoyl groups (the carbamoyl group have preferably 1 to 20 carbon atoms, more preferably 1 to 14 carbon atoms and particularly preferably 1 to 8 carbon atoms, and examples thereof include a carbamoyl group, N,N-dimethylcarbamoyl group and N-phenylcarbamoyl group), acyl groups (the acyl groups have preferably 1 to 20 carbon atoms, more preferably 1 to 14 carbon atoms and most preferably 1 to 8 carbon atoms, and examples thereof include a formyl group, acetyl group and benzoyl group), alkoxycarbonyl groups (the alkoxycarbonyl groups have preferably 2 to 20 carbon atoms, more preferably 2 to 16 carbon atoms and most preferably 2 to 12 carbon atoms, and examples thereof include a methoxycarbonyl group, ethoxycarbonyl group and butoxycarbonyl group), aryloxycarbonyl groups (the aryloxycarbonyl groups have preferably 6 to 20 carbon atoms, more preferably 6 to 16 carbon atoms and most preferably 6 to 12 carbon atoms, and examples thereof include a phenoxycarbonyl group and 2-naphthyloxycarbonyl group), a cyano group and a nitro group. More preferably, the substituent represented by $X^{51}$ is one of halogen atoms, acylamino groups or alkyl groups, and most preferably the substituent is a chlorine atom or a bromine atom.

$X^{53}$s in the general formula (V) each independently represent a hydrogen atom or a substituent. However, $X^{53}$s are respectively neither a hydroxyl group nor a sulfonamide group. Specific examples of the substituent include the substituents exemplified above as the examples of $X^{51}$ (a sulfonamide group is excluded from them). Preferable examples of $X^{53}$ include a hydrogen atom, halogen atoms (a fluorine atom, chlorine atom, bromine atom, iodine atom and preferably a chlorine atom and bromine atom), acylamino groups (the acylamino groups have preferably 1 to 20 carbon atoms, more preferably 1 to 14 carbon atoms and most preferably 1 to 8 carbon atoms, and the examples thereof include a formylamino group, acetylamino group and benzoylamino group), alkyl groups (the alkyl groups have preferably 1 to 20 carbon atoms, more preferably 1 to 14 carbon atoms and most preferably 1 to 8 carbon atoms, and the examples thereof include a methyl group, ethyl group, isopropyl group and cyclohexyl group), aryl groups (the aryl group have preferably 6 to 20 carbon atoms, more preferably 6 to 14 carbon atoms and most preferably 6 to 8 carbon atoms, and the examples thereof include a phenyl group, naphthyl group and p-methylphenyl group), alkoxy groups (the alkoxy group have preferably 1 to 20 carbon atoms, more preferably 1 to 14 carbon atoms and most preferably 1 to 8 carbon atoms, and the examples thereof include a methoxy group and ethoxy group), aryloxy groups (the aryloxy groups have preferably 6 to 20 carbon atoms, more preferably 6 to 14 carbon atoms and most preferably 6 to 8 carbon atoms, and the examples thereof include a phenoxy group and 2-naphthyloxy group), acyloxy groups (the acyloxy groups have preferably 1 to 20 carbon atoms, more preferably 1 to 14 carbon atoms and most preferably 1 to 8 carbon atoms, and the examples thereof include an acetoxy group and benzoyloxy group), carbamoyl groups (the carbamoyl groups have preferably 1 to 20 carbon atoms, more preferably 1 to 14 carbon atoms and most preferably 1 to 8 carbon atoms, and the examples thereof include a carbamoyl group, N,N-dimethylcarbamoyl group and N-phenylcarbamoyl group), acyl groups (the acyl groups have preferably 1 to 20 carbon atoms, more preferably 1 to 14 carbon atoms and most preferably 1 to 8 carbon atoms, and the examples thereof include a formyl group, acetyl group and benzoyl group), alkoxycarbonyl groups (the alkoxycarbonyl groups have preferably 2 to 20 carbon atoms, more preferably 2 to 16 carbon atoms and most preferably 2 to 12 carbon atoms, and the examples thereof include a methoxycarbonyl group, ethoxycarbonyl group and butoxycarbonyl group), aryloxycarbonyl groups (the aryloxycarbonyl groups have preferably 6 to 20 carbon atoms, more preferably 6 to 16 carbon atoms and most preferably 6 to 12 carbon atoms, and the examples thereof include a phenoxycarbonyl group and 2-naphthyloxycarbonyl group), cyano groups and nitro groups. More preferably, the substituent is one of halogen atoms, acylamino groups or alkyl groups, and most preferably a chlorine atom or a bromine atom.

In the general formula (V), at least one of the substituents represented by $X^{51}$ and $X^{53}$ is preferably an electron attracting group. The electron attracting group means substituents having a positive Hammett's substituent constant value $\sigma\rho$. Specific examples of the substituents include halogen atoms, a cyano group, a nitro group, alkoxycarbonyl groups, aryloxycarbonyl groups, imino groups, imino groups substituted with a N atom, thiocarbonyl groups, perfluoroalkyl groups, sulfonamide groups, formyl groups, phosphoryl groups, a carboxyl group, carbamoyl groups, acyl groups, sulfo groups (or their salts), alkylsulfonyl groups, arylsulfonyl groups, sulfamoyl groups, acyloxy groups, acylthio groups, sulfonyloxy groups, heterocyclic groups or aryl groups substituted with these electron attractive groups. Both of $X^{51}$ and $X^{53}$ are preferably electron attracting groups, more preferably halogen atoms and most preferably both substituents are chlorine atoms or bromine atoms.

In the general formula (V), $X^{52}$ and $X^{54}$ each independently represent a hydrogen atom or a substituent. However, neither $X^{52}$ nor $X^{54}$ is a hydroxyl group. Specific examples of the substituent include the substituents exemplified above as the examples of $X^{51}$. Preferable examples of $X^{52}$ and $X^{54}$ include a hydrogen atom, halogen atoms (a fluorine atom, chlorine atom, bromine atom and iodine atom and preferably a chlorine atom and bromine atom), acylamino groups (the acylamino groups have preferably 1 to 20 carbon atoms, more preferably 1 to 14 carbon atoms and most preferably 1 to 8 carbon atoms, and examples thereof include a formylamino group, acetylamino group and benzoylamino group), alkyl groups (the alkyl groups have preferably 1 to 20 carbon atoms, more preferably 1 to 14 carbon atoms and most preferably 1 to 8 carbon atoms, and examples thereof include a methyl group, ethyl group, isopropyl group and cyclohexyl group), aryl groups (the aryl groups have preferably 6 to 20 carbon atoms, more preferably 6 to 14 carbon atoms and most preferably 6 to 8 carbon atoms, and examples thereof include a phenyl group, naphthyl group and p-methylphenyl group), alkoxy groups (the alkoxy groups have preferably 1 to 20 carbon atoms, more preferably 1 to 14 carbon atoms and most preferably 1 to 8 carbon atoms, and examples thereof include a methoxy group and ethoxy group), aryloxy groups (the aryloxy groups have preferably 6 to 20 carbon atoms, more preferably 6 to 14 carbon atoms and most preferably 6 to 8 carbon atoms, and examples thereof include a phenoxy group and 2-naphthyloxy group), acyloxy groups (the acyloxy groups have preferably 1 to 20 carbon atoms, more preferably 1 to 14 carbon atoms and most preferably 1 to 8 carbon atoms, and examples thereof include an acetoxy group and benzoyloxy group), sulfonylamino groups (the sulfonylamino groups have preferably 1 to 20 carbon atoms, more preferably 1 to 14 carbon atoms and most preferably 1 to 8 carbon atoms, and examples thereof include a methanesulfonylamino group and benzenesulfonylamino group), carbamoyl groups (the carbamoyl groups have preferably 1 to 20 carbon atoms, more preferably 1 to 14 carbon atoms and most preferably 1 to 8 carbon atoms, and examples thereof include a carbamoyl group, N,N-dimethylcarbamoyl group and N-phenylcarbamoyl group), acyl groups (the acyl groups have preferably 1 to 20 carbon atoms, more preferably 1 to 14 carbon atoms and most preferably 1 to 8 carbon atoms, and examples thereof include a formyl group, acetyl group and benzoyl group), alkoxycarbonyl groups (the alkoxycarbonyl groups have preferably 2 to 20 carbon atoms, more preferably 2 to 16 carbon atoms and most preferably 2 to 12 carbon atoms, and examples thereof include a methoxycarbonyl group, ethoxycarbonyl group and butoxycarbonyl group), aryloxycarbonyl groups (the aryloxycarbonyl groups have preferably 6 to 20 carbon atoms, more preferably 6 to 16 carbon atoms and most preferably 6 to 12 carbon atoms, and examples thereof include a phenoxycarbonyl group and 2-naphthyloxycarbonyl group), cyano groups and nitro groups. More preferably, the substituents each independently represent a hydrogen atom, alkyl groups, aryl groups, halogen atoms or acylamino groups, and most preferably the substituents each independently represent a hydrogen atom, methyl group or ethyl group.

In the general formula (V), $X^{51}$ to $X^{54}$ may be further substituted. Specific examples of the substituent which can be provided to $X^{51}$ to $X^{54}$ include the substituents exemplified above as the examples of $X^{51}$ in the above general formula (V). Also, $X^{51}$ to $X^{54}$ may be combined with each other to form a ring.

In the general formula (V), $R^{51}$ represents a hydrogen atom, alkyl group (the alkyl group have preferably 1 to 20 carbon atoms, more preferably 1 to 14 carbon atoms and most preferably 1 to 7 carbon atoms, and examples thereof include a methyl group, ethyl group, isopropyl group and cyclohexyl group), aryl group (the aryl group has preferably 6 to 20 carbon atoms, more preferably 6 to 14 carbon atoms and most preferably 6 to 8 carbon atoms, and examples thereof include a phenyl group, naphthyl group and p-methylphenyl group), heterocyclic group (e.g., a pyridyl group, imidazolyl group or pyrrolidyl group), amino group (the amino group has preferably 0 to 20 carbon atoms, more preferably 0 to 14 carbon atoms and most preferably 0 to 8 carbon atoms, and examples thereof include an amino group, methylamino group, N,N-dimethylamino group and N-phenylamino group) or alkoxy group (the alkoxy group having preferably 1 to 20 carbon atoms, more preferably 1 to 14 carbon atoms and most preferably 1 to 8 carbon atoms, and examples thereof include a methoxy group and an ethoxy group). Preferable examples of $R^{51}$ include a hydrogen atom, aryl groups, heterocyclic groups, amino groups, alkoxy groups and alkyl groups having 1 to 7 carbon atoms. More preferable examples include aryl groups and alkyl groups having 1 to 7 carbon atoms, and most preferable examples include aryl groups. $R^{51}$ may be further substituted with a substituent, and specific examples of substituent include the substituents exemplified above as the examples of $X^{51}$ in the general formula (V).

In the general formula (V), a combination of $X^{51}$ to $X^{54}$ and $R^{51}$ is preferable in the case in which at least one of $X^{51}$ and $X^{53}$ is a halogen atom, $X^{52}$ and $X^{54}$ are respectively a halogen atom or alkyl group and $R^{51}$ is an aryl group or an alkyl group having 1 to 7 carbon atoms. A more preferable combination thereof is the case in which both of $X^{51}$ and $X^{53}$ are chlorine atoms or bromine atoms, $X^{52}$ is a hydrogen atom or an alkyl group, $X^{54}$ is a hydrogen atom and $R^{51}$ is an aryl group.

The total molecular weight of the compound represented by the general formula (V) is preferably in a range of from 170 to 800, more preferably 220 to 650 and most preferably 220 to 500.

Specific examples of the compound represented by the general formula (V) will be given below; however the invention is not limited to these specific examples.

5-1

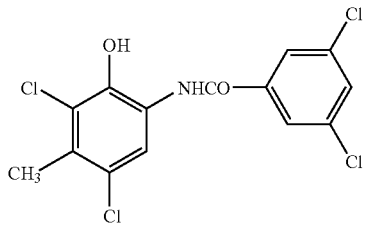

-continued
5-2
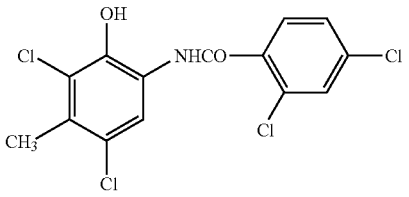
5-3
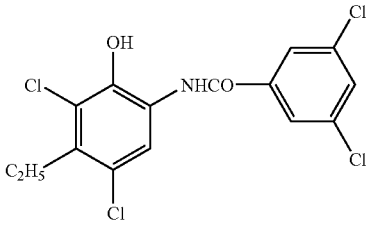
5-4
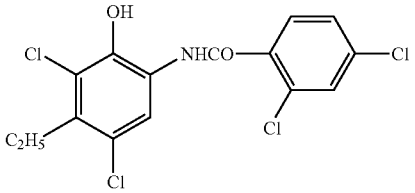
5-5
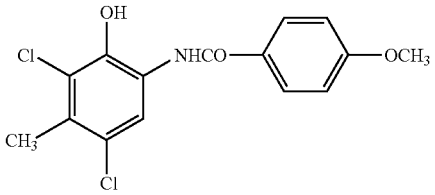
5-6
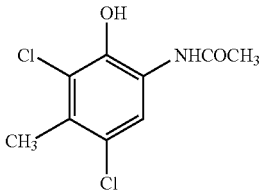
5-7
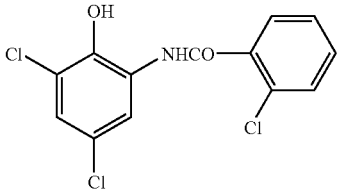
5-8
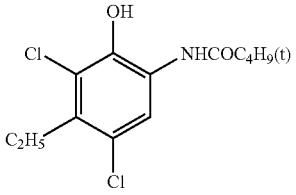
-continued
5-9
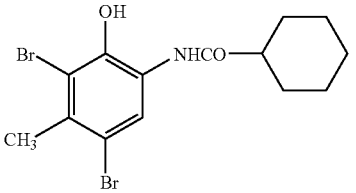
5-10
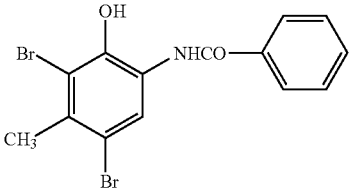
5-11
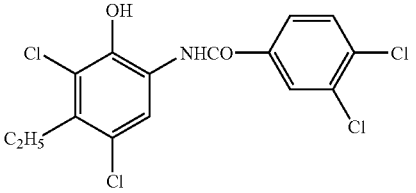
5-12
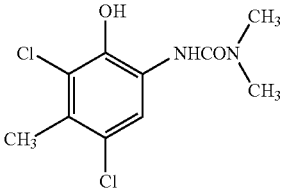
5-13
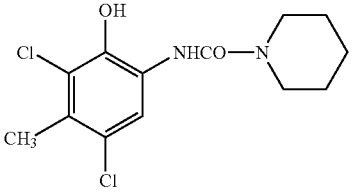
5-14
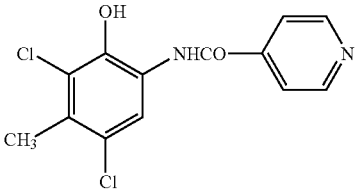
5-15
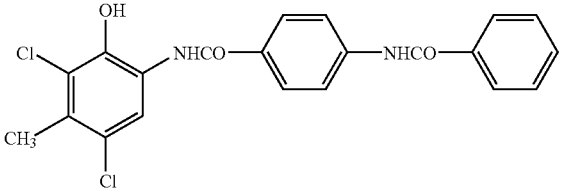

-continued
5-16
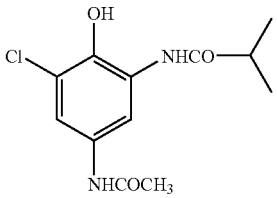
5-17
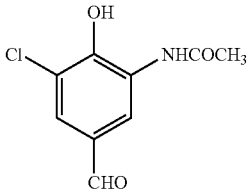
5-18
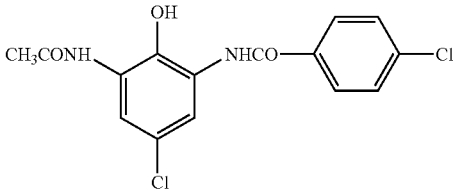
5-19
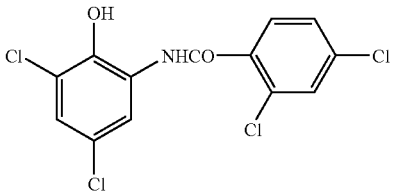
5-20
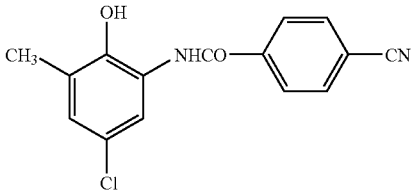
5-21
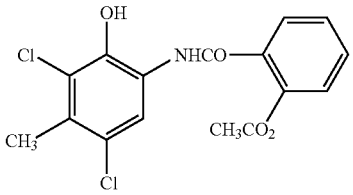
5-22
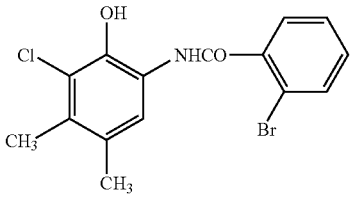
-continued
5-23
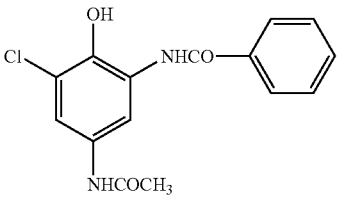
5-24
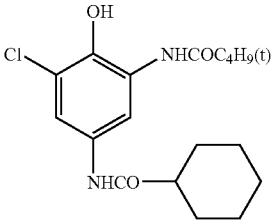
5-25
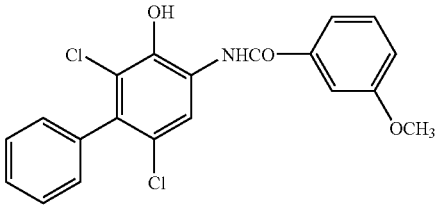
5-26
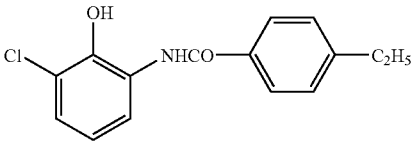
5-27
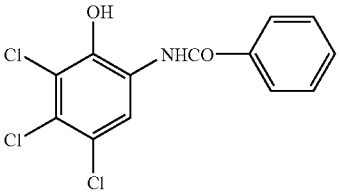
5-28
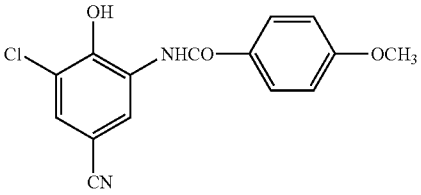
5-29
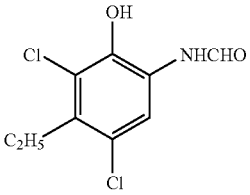

-continued
5-30
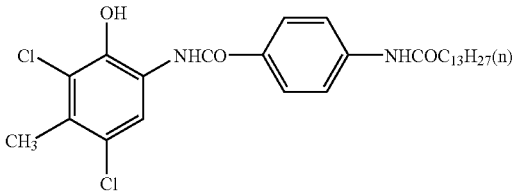
5-31
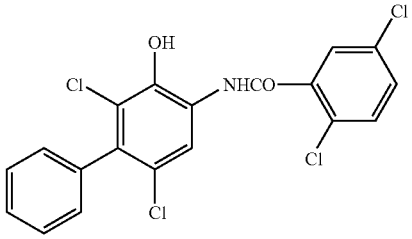
5-32
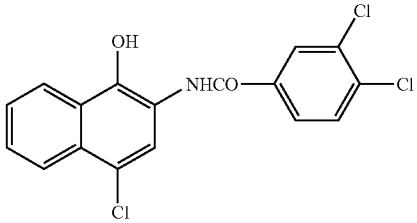
5-33
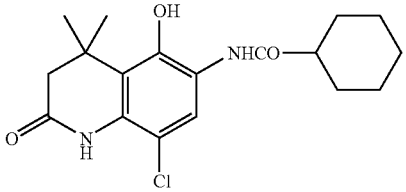
5-34
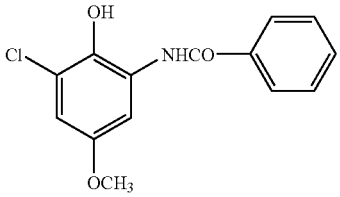
5-35
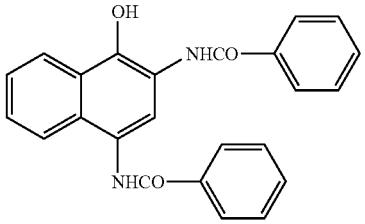
5-36
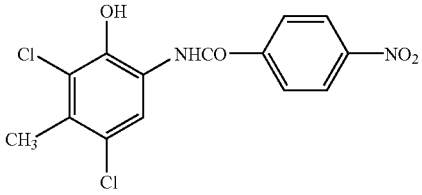
-continued
5-37
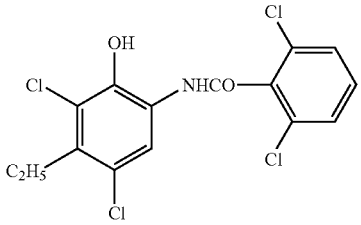
5-38
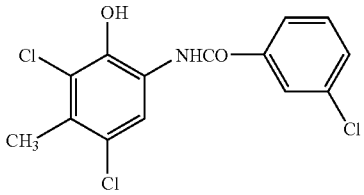
5-39
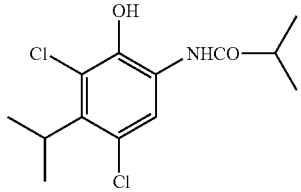
5-40
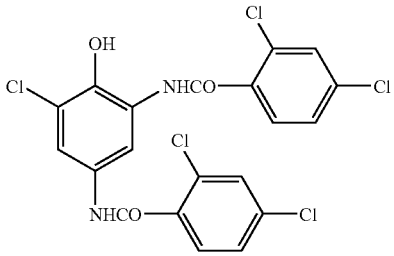
5-41
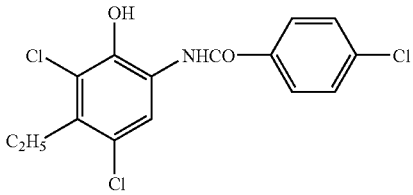
5-42
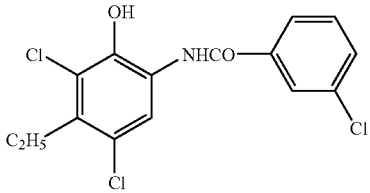
5-43
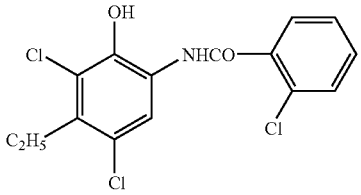

-continued
5-44
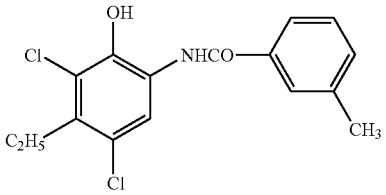
5-45
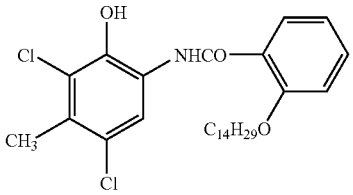
5-46
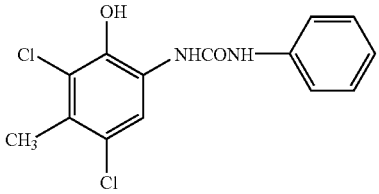
5-47
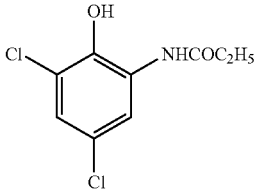
5-48
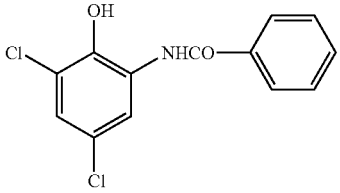
5-49
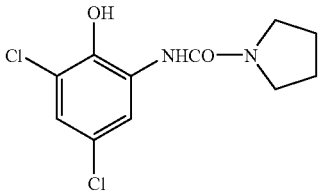
5-50
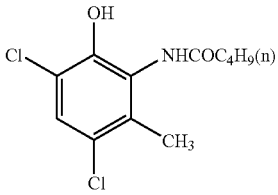
5-51
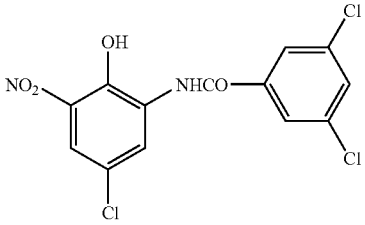
-continued
5-52
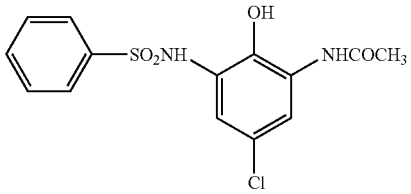
5-53
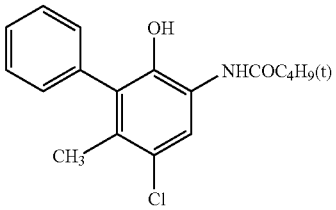
5-54
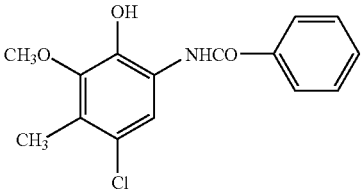
5-55
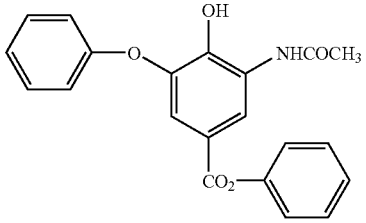
5-56
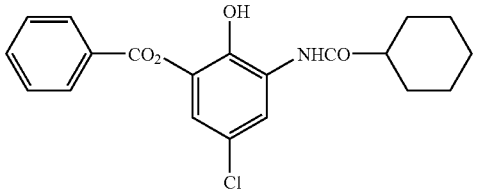
5-57
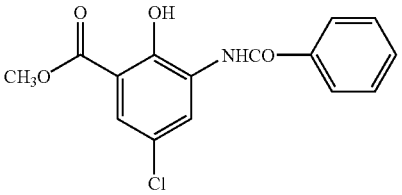
5-58
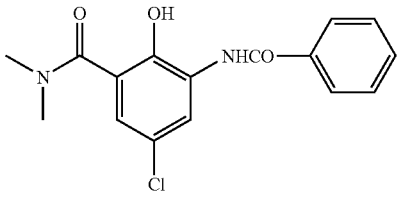

-continued
5-59
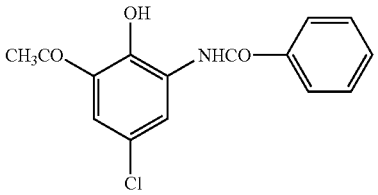
5-60
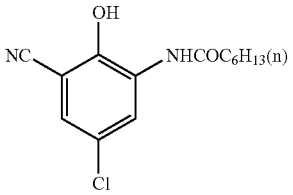
5-61
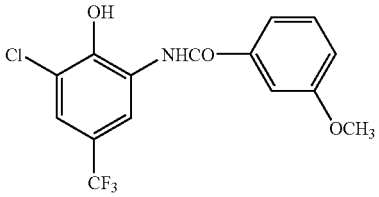
5-62
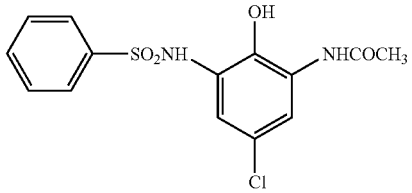
5-63
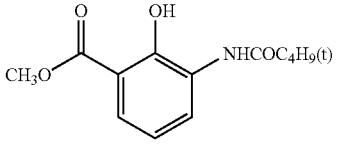
5-64
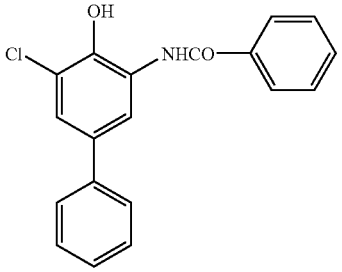
5-65
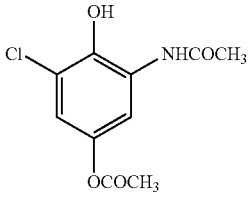
-continued
5-66
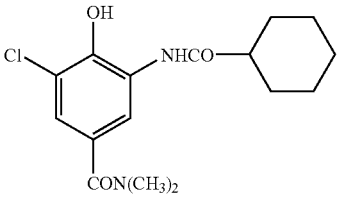
5-67
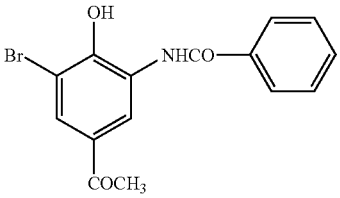
5-68
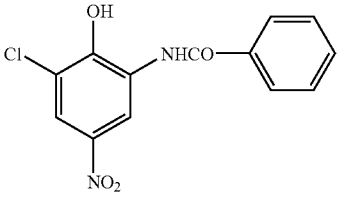
5-69
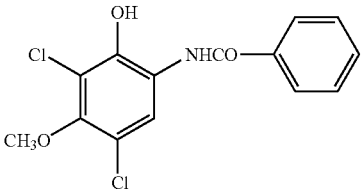
5-70
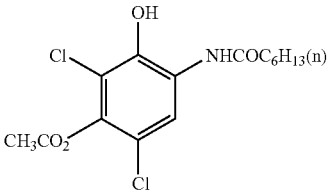
5-71
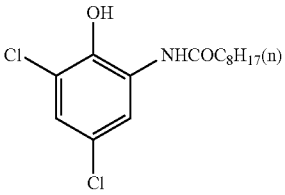
5-72
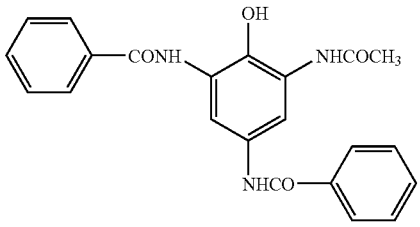

-continued 5-73

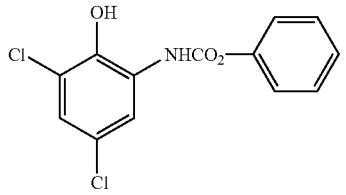

5-74

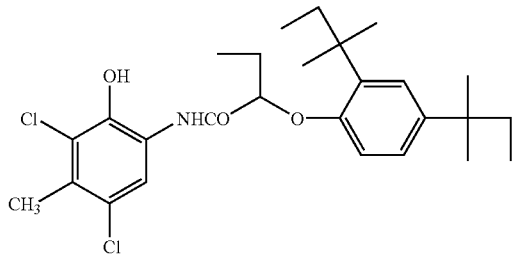

The compounds represented by the above general formula (III) are preferably compounds represented by the general formula (VI) shown below.

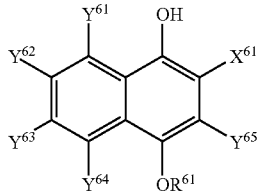

The compound represented by the general formula (VI) will be explained below.

In the general formula (VI), $R^{61}$ represents an alkyl group, an aryl group, an alkenyl group or an alkinyl group, and $X^{61}$ represents an acyl group, an alkoxycarbonyl group, a carbamoyl group, a sulfonyl group or a sulfamoyl group. $Y^{61}$ to $Y^{65}$ each independently represent a hydrogen atom or a substituent.

The alkyl groups represented by $R^{61}$ in the general formula (VI) are straight-chain, branched or cyclic alkyl groups preferably having 1 to 30, more preferably 1 to 16 and most preferably 1 to 13 carbon atoms or combinations of these alkyl groups. Examples of the alkyl group include methyl, ethyl, n-propyl, isopropyl, n-butyl, sec-butyl, t-butyl, n-hexyl, cyclohexyl, n-octyl, t-octyl, n-amyl, t-amyl, n-decyl, n-dodecyl, n-tridecyl, benzyl and phenethyl.

The aryl groups represented by $R^{61}$ in the general formula (VI) have preferably 6 to 30, more preferably 6 to 20 and most preferably 6 to 12 carbon atoms. Examples of these aryl groups include phenyl, 4-methylphenyl, 2-chlorophenyl, 4-chlorophenyl, 2,4-dichlorophenyl, 3,4-dichlorophenyl, 2-methoxyphenyl, 4-methoxyphenyl, 4-hexyloxyphenyl, 2-dodecyloxyphenyl and naphthyl.

The alkenyl groups represented by $R^{61}$ in the general formula (VI) have preferably 2 to 30, more preferably 2 to 20 and most preferably 2 to 12 carbon atoms. Examples of these alkenyl groups include vinyl groups, allyl groups, isopropenyl groups, butenyl groups and cyclohexenyl groups.

The alkinyl groups represented by $R^{61}$ in the general formula (VI) have preferably 2 to 30, more preferably 2 to 20 and still more preferably 2 to 12 carbon atoms. Examples of these alkinyl groups include ethynyl groups and propinyl groups.

$R^{61}$ in the general formula (VI) may further have a substituent. Preferable examples of the substituent include substituents represented by $Y^{61}$ to $Y^{65}$ in the compounds represented by the general formula (VI). The substituents will be explained later.

More preferably $R^{61}$ represents an alkyl group or aryl group and most preferably represents an alkyl group.

In the general formula (VI), $X^{61}$ represents an acyl group, alkoxycarbonyl group, carbamoyl group, sulfonyl group or sulfamoyl group.

The acyl group represented by $X^{6}$ in the general formula (VI) has preferably 2 to 20 carbon atoms, more preferably 2 to 16 carbon atoms and still more preferably 2 to 12 carbon atoms. Examples of the acyl group include acetyl, propionyl, butyryl, valeryl, hexanoyl, myristiryl, palmitoyl, stearyl, oleyl, acryloyl, cyclohexanecarbonyl, benzoyl, formyl and pivaloyl.

The alkoxycarbonyl group represented by $X^{61}$ in the general formula (VI) has preferably 2 to 20 carbon atoms, more preferably 2 to 16 carbon atoms and still more preferably 2 to 12 carbon atoms. Examples of the alkoxycarbonyl group include methoxycarbonyl, ethoxycarbonyl, butoxycarbonyl and phenoxycarbonyl.

The carbamoyl group represented by $X^{61}$ in the general formula (VI) has preferably 1 to 20 carbon atoms, more preferably 1 to 16 carbon atoms and most preferably 1 to 12 carbon atoms. Examples of the carbamoyl group include carbamoyl, N,N-diethylcarbamoyl, N-dodecylcarbamoyl, N-decylcarbamoyl, N-hexadecylcarbamoyl, N-phenylcarbamoyl, N-(2-chlorophenyl)carbamoyl, N-(4-chlorophenyl)carbamoyl, N-(2,4-dichlorophenyl)carbamoyl, N-(3,4-dichlorophenyl)carbamoyl, N-pentachlorophenylcarbamoyl, N-(2-methoxyphenyl)carbamoyl, N-(4-methoxyphenyl)carbamoyl, N-(2,4-dimethoxyphenyl)carbamoyl, N-(2-dodecyloxyphenyl)carbamoyl and N-(4-dodecyloxyphenyl)carbamoyl.

The sulfonyl group represented by $X^{61}$ in the general formula (VI) has preferably 1 to 20 carbon atoms, more preferably 1 to 16 carbon atoms and most preferably 1 to 12 carbon atoms. Examples of the sulfonyl group include mesyl, ethanesulfonyl, cyclohexanesulfonyl, benzenesulfonyl, tosyl and 4-chlorobenzenesulfonyl.

The sulfamoyl group represented by $X^{61}$ in the general formula (VI) has preferably 0 to 20 carbon atoms, more preferably 0 to 16 carbon atoms and still more preferably 0 to 12 carbon atoms. Examples of the sulfamoyl group include sulfamoyl, methylsulfamoyl and dimethylsulfamoyl.

In the general formula (IV), $X^{61}$ may further have a substituent. Preferable examples of the substituent include substituents represented by $Y^{61}$ to $Y^{65}$ in the compound of the general formula (I). The substituents will be explained later.

In the general formula (VI), $X^{61}$ preferably represents a carbamoyl group, more preferably an alkylcarbamoyl group or an arylcarbamoyl group and most preferably an arylcarbamoyl group.

In the general formula (VI), $Y^{61}$ to $Y^{65}$ each independently represent a hydrogen atom or a substituent.

Any substituent may be used as the substituent represented by $Y^{61}$ to $Y^{65}$ in so far as it does not adversely affect the photographic characteristics. Examples of the substituent include halogen atoms (e.g., a fluorine atom, chlorine atom, bromine atom and iodine atom), straight-chain, branched and cyclic alkyl groups and alkyl groups obtained by combining these alkyl groups (the alkyl groups have preferably 1 to 20 carbon atoms, more preferably 1 to 16 carbon atoms and most preferably 1 to 13 carbon atoms, and examples thereof include methyl, ethyl, n-propyl, isopropyl, sec-butyl, t-butyl, t-octyl, n-amyl, t-amyl, n-dodecyl, n-tridecyl and cyclohexyl), alkenyl groups (the alkenyl groups have preferably 2 to 20 carbon atoms, more preferably 2 to 16 carbon atoms and most preferably 2 to 12 carbon atoms, and examples thereof include vinyl, allyl, 2-butenyl and 3-pentenyl), aryl groups (the aryl groups have preferably 6 to 30 carbon atoms, more preferably 6 to 20 carbon atoms and most preferably 6 to 12 carbon atoms, and examples thereof include phenyl, p-methylphenyl and naphthyl), alkoxy groups (the alkoxy groups have preferably 1 to 20 carbon atoms, more preferably 1 to 16 carbon atoms and most preferably 1 to 12 carbon atoms, and examples thereof include methoxy, ethoxy, propoxy and butoxy), aryloxy groups (the aryloxy groups have preferably 6 to 30 carbon atoms, more preferably 6 to 20 carbon atoms and most preferably 6 to 12 carbon atoms, and examples thereof include phenyloxy and 2-naphthyloxy), acyloxy groups (the acyloxy groups have preferably 2 to 20 carbon atoms, more preferably 2 to 16 carbon atoms and most preferably 2 to 12 carbon atoms, and examples thereof include acetoxy and benzoyloxy), amino groups (the amino groups have preferably 0 to 20 carbon atoms, more preferably 1 to 16 carbon atoms and most preferably 1 to 12 carbon atoms, and examples thereof include a dimethylamino group, diethylamino group, dibutylamino group and anilino group), acylamino groups (the acylamino group have preferably 2 to 20 carbon atoms, more preferably 2 to 16 carbon atoms and most preferably 2 to 13 carbon atoms, and examples thereof include acetylamino, tridecanoylamino and benzoylamino), sulfonylamino groups (the sulfonylamino groups have preferably 1 to 20 carbon atoms, more preferably 1 to 16 carbon atoms and still more preferably 1 to 12 carbon atoms, and examples thereof include methanesulfonylamino, butanesulfonylamino and benzenesulfonylamino), ureide groups (the ureide groups have preferably 1 to 20 carbon atoms, more preferably 1 to 16 carbon atoms and most preferably 1 to 12 carbon atoms, and examples thereof include ureide, methylureide and phenylureide), carbamate groups (the carbamate groups have preferably 2 to 20 carbon atoms, more preferably 2 to 16 carbon atoms and most preferably 2 to 12 carbon atoms, and examples thereof include methoxycarbonylamino and phenyloxycarbonylamino) carboxyl groups, carbamoyl groups (the carbamoyl groups have preferably 1 to 20 carbon atoms, more preferably 1 to 16 carbon atoms and most preferably 1 to 12 carbon atoms, and examples thereof include carbamoyl, N,N-diethylcarbamoyl, N-dodecylcarbamoyl and N-phenylcarbamoyl), alkoxycarbonyl groups (the alkoxycarbonyl groups have preferably 2 to 20 carbon atoms, more preferably 2 to 16 carbon atoms and most preferably 2 to 12 carbon atoms, and examples thereof include methoxycarbonyl, ethoxycarbonyl and butoxycarbonyl), acyl groups (the acyl groups have preferably 2 to 20 carbon atoms, more preferably 2 to 16 carbon atoms and most 2 to 12 carbon atoms, and examples thereof include acetyl, benzoyl, formyl and pivaloyl), a sulfo groups, sulfonyl groups (the sulfonyl groups have preferably 1 to 20 carbon atoms, more preferably 1 to 16 carbon atoms and most preferably 1 to 12 carbon atoms, and examples thereof include mesyl and tosyl), sulfamoyl groups (the sulfamoyl groups have preferably 0 to 20 carbon atoms, more preferably 0 to 16 carbon atoms and most preferably 0 to 12 carbon atoms, and examples thereof include sulfamoyl, methylsulfamoyl, dimethylsulfamoyl and phenylsulfamoyl), a cyano group, a nitro group, a hydroxyl group, a mercapto group, alkylthio groups (the alkylthio groups have preferably 1 to 20 carbon atoms, more preferably 1 to 16 carbon atoms and most preferably 1 to 12 carbon atoms, and examples thereof include methylthio and butylthio) and heterocyclic groups (the heterocyclic groups have preferably 2 to 20 carbon atoms, more preferably 2 to 16 carbon atoms and most preferably 2 to 12 carbon atoms, and examples thereof include pyridyl, imidazolyl and pyrrolidyl). These substituents may be further substituted with other substituents.

Among the aforementioned examples, preferable examples of the substituents represented by $Y^{61}$ to $Y^{65}$ in the general formula (VI) include halogen atoms, alkyl groups, aryl groups, alkoxy groups, aryloxy groups, acyloxy groups, anilino groups, acylamino groups, sulfonylamino groups, carboxyl group, carbamoyl groups, acyl groups, sulfo groups, sulfonyl groups, sulfamoyl groups, a cyano group, a hydroxyl group, a mercapto group, alkylthio groups and heterocyclic groups.

In the general formula (VI), a combination in which $R^{61}$ is an alkyl group, $X^{61}$ is a carbamoyl group and $Y^{61}$ to $Y^{65}$ are respectively a hydrogen atom is preferable.

Specific examples of the compound represented by the general formula (VI) will be given below. However the invention is not limited to these examples.

TABLE 5

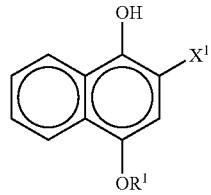

| Compound | $X^1$ | $R^1$ |
|---|---|---|
| 6-1 | —$CONHC_6H_5$ | —$CH_3$ |
| 6-2 | —$CONHC_6H_5$ | —$C_2H_5$ |
| 6-3 | —$CONHC_6H_5$ | —$C_3H_7$ |
| 6-4 | —$CONHC_6H_5$ | -i-$C_3H_7$ |
| 6-5 | —$CONHC_6H_5$ | —$C_4H_9$ |
| 6-6 | —$CONHC_6H_5$ | —$C_5H_{11}$ |
| 6-7 | —$CONHC_6H_5$ | —$C_6H_{13}$ |
| 6-8 | —$CONHC_6H_5$ | —C—$C_6H_{11}$ |
| 6-9 | —$CONHC_6H_5$ | —$C_{10}H_{21}$ |
| 6-10 | —$CONHC_6H_5$ | —$C_{12}H_{25}$ |
| 6-11 | —$CONHC_6H_5$ | —$C_{16}H_{33}$ |
| 6-12 | —$CONHC_6H_5$ | —$CH_2C_6H_5$ |
| 6-13 | —$CONHC_6H_5$ | —$(CH_2)_2C_6H_5$ |
| 6-14 | —$CONHC_6H_5$ | —$(CH_2)_2NHSO_2CH_3$ |
| 6-15 | —$CONHC_6H_5$ | —$(CH_2)_2OCH_2CH_3$ |
| 6-16 | —$CONHC_6H_5$ | —$(CH_2)_2O(CH_2)_2OH$ |
| 6-17 | —$CONHC_6H_5$ | —$(CH_2)_2OCH_2CO_2H$ |
| 6-18 | —$CONHC_6H_5$ | —$C_8H_{17}$ |
| 6-19 | —$CONHC_6H_5$ | —$(CH_2)_2SO_2CH_3$ |
| 6-20 | —$CONHC_6H_5$ | —$(CH_2)_2SO_2CH_2CH_3$ |
| 6-21 | —$CONHC_6H_5$ | —$(CH_2)_2O(CH_2)_2OCH_2CH_3$ |
| 6-22 | —$CONHC_6H_5$ | 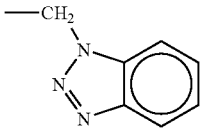 |

TABLE 6
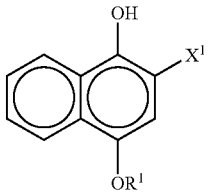
| Compound | $X^1$ | $R^1$ |
|---|---|---|
| 6-23 | $—CONHC_6H_5$ | 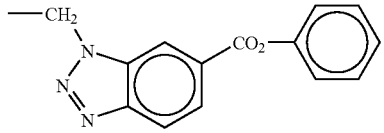 |
| 6-24 | $—CONHC_6H_5$ | $—C_6H_5$ |
| 6-25 | $—CONHC_6H_5$ | $-p-CH_2—C_6H_4$ |
| 6-26 | $—CONHC_6H_5$ | $-p-Cl—C_6H_4$ |
| 6-27 | $—CONHC_6H_5$ | 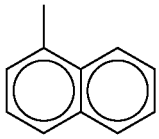 |
| 6-28 | $—CONHC_6H_5$ | 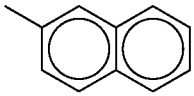 |
| 6-29 | $—CONH-2-Cl—C_6H_4$ | $—CH_3$ |
| 6-30 | $—CONH-2-Cl—C_6H_4$ | $—C_4H_9$ |
| 6-31 | $—CONH-2-Cl—C_6H_4$ | $—C_6H_{13}$ |
| 6-32 | $—CONH-2-Cl—C_6H_4$ | $—(CH_2)_2C_6H_5$ |
| 6-33 | $—CONH-2-Cl—C_6H_4$ | $—C_{12}H_{25}$ |
| 6-34 | $—CONH-4-Cl—C_6H_4$ | $—C_4H_9$ |
| 6-35 | $—CONH-4-Cl—C_6H_4$ | $—C_6H_{13}$ |
| 6-36 | $—CONH-4-Cl—C_6H_4$ | $—C_8H_{17}$ |
| 6-37 | $—CONH-4-Cl—C_6H_4$ | $—(CH_2)_2C_6H_5$ |
| 6-38 | $—CONH-4-Cl—C_6H_4$ | $—C_{10}H_{25}$ |
| 6-39 | 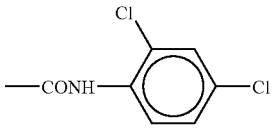 | $—CH_3$ |
TABLE 7
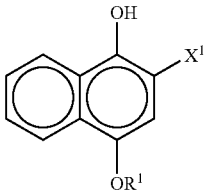
| Compound | $X^1$ | $R^1$ |
|---|---|---|
| 6-40 | 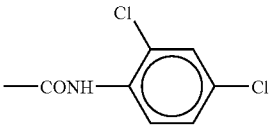 | $—C_4H_9$ |
TABLE 7-continued
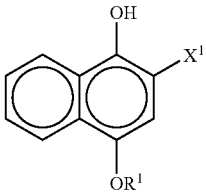
| Compound | $X^1$ | $R^1$ |
|---|---|---|
| 6-41 | 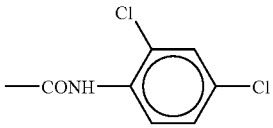 | $—C_6H_{13}$ |

TABLE 7-continued
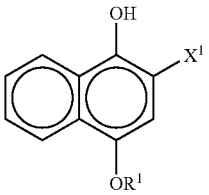
| Compound | $X^1$ | $R^1$ |
|---|---|---|
| 6-42 | 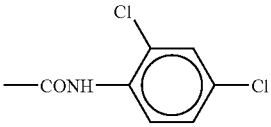 | $—C_8H_{17}$ |
| 6-43 | 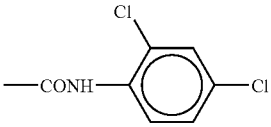 | $—(CH_2)_2C_6H_5$ |
| 6-44 | 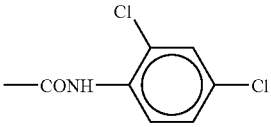 | $—C_{10}H_{21}$ |
| 6-45 | 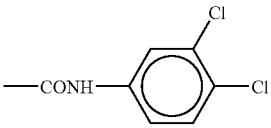 | $—CH{=}CHCH_3$ |
| 6-46 | 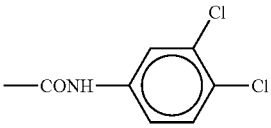 | $—C_4H_9$ |
| 6-47 | 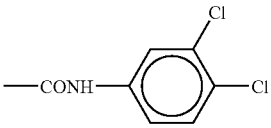 | $—C_6H_{13}$ |
| 6-48 | 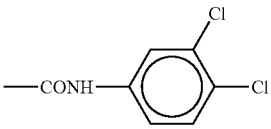 | $—C{\equiv}CH$ |
TABLE 8
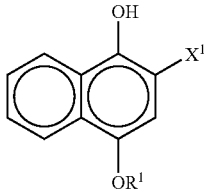
| Compound | $X^1$ | $R^1$ |
|---|---|---|
| 6-49 | 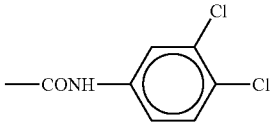 | $—C_8H_{17}$ |
| 6-50 | 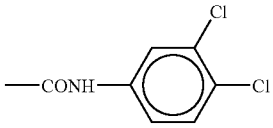 | $—(CH_2)_2C_6H_5$ |
| 6-51 | 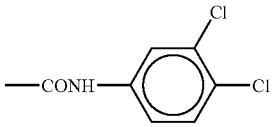 | $—CH_2C_6H_5$ |
| 6-52 | 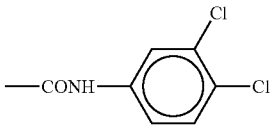 | $—C_6H_5$ |
| 6-53 | 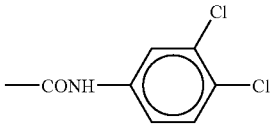 | $—(CH_2)_2SO_2CH_3$ |
| 6-54 | 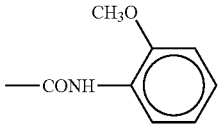 | $—C_6H_{13}$ |
| 6-55 | 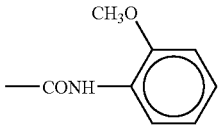 | $—(CH_2)_2C_6H_5$ |
| 6-56 | 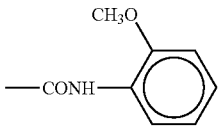 | $—C_4H_9$ |
| 6-57 | $—CONHCH_3$ | $—C_6H_{13}$ |
| 6-58 | $—CONHC_4H_9$ | $—C_6H_{13}$ |
| 6-59 | $—CONHC_6H_{13}$ | $—C_6H_{13}$ |
| 6-60 | $—CONHC_{10}H_{21}$ | $—C_6H_{13}$ |

TABLE 9
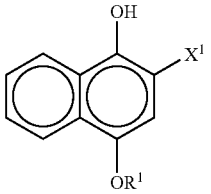
| Compound | $X^1$ | $R^1$ |
|---|---|---|
| 6-61 | —$CONHC_{12}H_{25}$ | —$C_6H_{13}$ |
| 6-62 | —$CONHC_{16}H_{33}$ | —$C_6H_{13}$ |
| 6-63 | 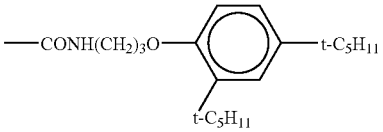 | —$C_6H_{13}$ |
| 6-64 | —$CONH(CH_2)_3OC_{12}H_{25}$ | —$C_6H_{13}$ |
| 6-65 | 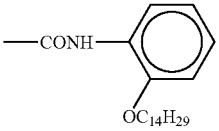 | —$C_6H_{13}$ |
| 6-66 | —$CONHCH_2C_6H_5$ | —$C_6H_{13}$ |
| 6-67 | 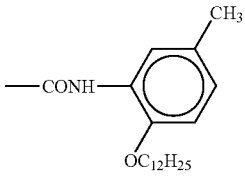 | —$C_6H_{13}$ |
| 6-68 | 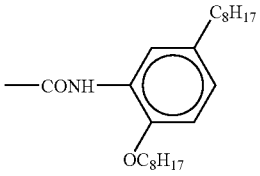 | —$C_6H_{13}$ |
| 6-69 | —CONH-t-$C_4H_9$ | —$C_6H_{13}$ |
| 6-70 | —CONH-t-$C_8H_{17}$ | —$C_6H_{13}$ |
| 6-71 | —$CON(C_2H_5)_2$ | —$C_6H_{13}$ |
| 6-72 | 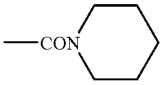 | —$C_6H_{13}$ |
| 6-73 | 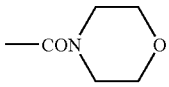 | —$C_6H_{13}$ |
| 6-74 | 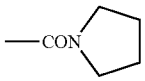 | —$C_6H_{13}$ |
TABLE 10
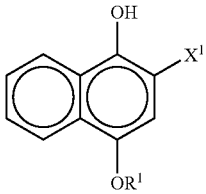
| Compound | $X^1$ | $R^1$ |
|---|---|---|
| 6-75 | —$CONHC_4H_9$ | —$(CH_2)_2C_6H_5$ |
| 6-76 | —$CONHC_{10}H_{21}$ | —$(CH_2)_2C_6H_5$ |
| 6-77 | —$CONHC_{12}H_{25}$ | —$(CH_2)_2C_6H_5$ |
| 6-78 | —CONH-t-$C_4H_9$ | —$(CH_2)_2C_6H_5$ |
| 6-79 | —CONH-t-$C_8H_{17}$ | —$(CH_2)_2C_6H_5$ |
| 6-80 | —$CONHCH_3$ | —$(CH_2)_2C_6H_5$ |
| 6-81 | 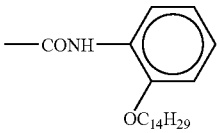 | —$(CH_2)_2C_6H_5$ |
| 6-82 | —$CON(C_2H_5)_2$ | —$(CH_2)_2C_6H_5$ |
| 6-83 | 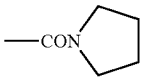 | —$(CH_2)_2C_6H_5$ |
| 6-84 | —$CONHCH_2C_6H_5$ | —$(CH_2)_2C_6H_5$ |
| 6-85 | 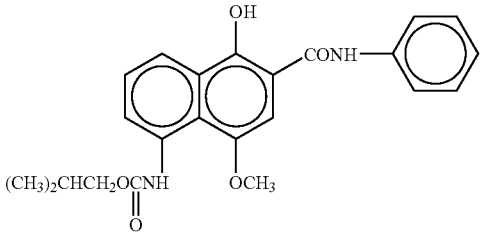 | |
| 6-86 | 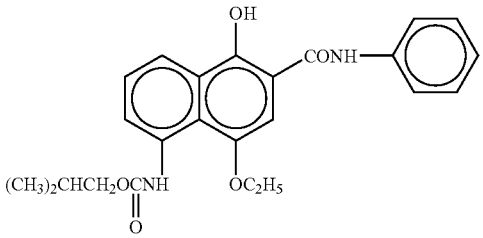 | |
| 6-87 | 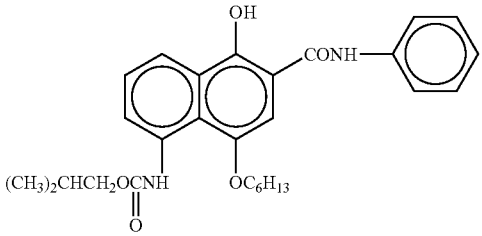 | |

TABLE 10-continued

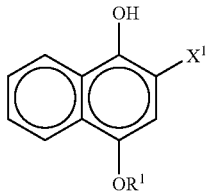

| Compound | $X^1$ | $R^1$ |
|---|---|---|
| 6-88 | 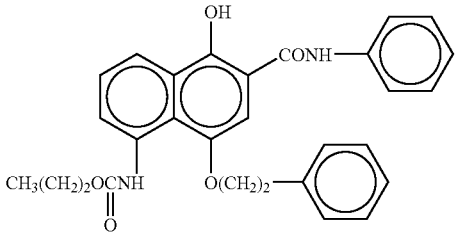 | |

TABLE 11

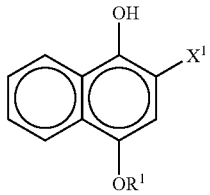

| Compound | $X^1$ | $R^1$ |
|---|---|---|
| 6-89 | —$COCH_3$ | —$C_6H_{13}$ |
| 6-90 | —$COC_2H_5$ | —$C_6H_{13}$ |
| 6-91 | —$COC_7H_{15}$ | —$C_6H_{13}$ |
| 6-92 | —$COC_{11}H_{23}$ | —$C_6H_{13}$ |
| 6-93 | —$COCH_3$ | —$(CH_2)_2C_6H_5$ |
| 6-94 | —$COC_2H_5$ | —$(CH_2)_2C_6H_5$ |
| 6-95 | —$COC_7H_{15}$ | —$(CH_2)_2C_6H_5$ |
| 6-96 | —$COC_{11}H_{23}$ | —$(CH_2)_2C_6H_5$ |
| 6-97 | —$COCH_3$ | —$CH_3$ |
| 6-98 | —$COCH_3$ | —$C_4H_9$ |
| 6-99 | —$COCH_3$ | —$C_6H_5$ |
| 6-100 | —$COCH_3$ | —$CH_2C_6H_5$ |
| 6-101 | —$COCH_3$ | —$C_{10}H_{21}$ |
| 6-102 | —$COCH_3$ | —$C_{12}H_{25}$ |
| 6-103 | —$COCH_3$ | —$C_{16}H_{33}$ |
| 6-104 | —$CO_2C_6H_5$ | —$C_6H_5$ |
| 6-105 | —$CO_2C_6H_5$ | —$CH_3$ |
| 6-106 | —$CO_2C_6H_5$ | —$C_2H_5$ |
| 6-107 | —$CO_2C_6H_5$ | —$C_4H_9$ |
| 6-108 | —$CO_2C_6H_5$ | —$C_6H_{13}$ |
| 6-109 | —$CO_2C_6H_5$ | —$C_{10}H_{21}$ |
| 6-110 | —$CO_2C_6H_5$ | —$CH_2C_6H_5$ |
| 6-111 | —$CO_2C_6H_5$ | —$(CH_2)_2C_6H_5$ |
| 6-112 | —$CO_2C_6H_5$ | —$C_{12}H_{25}$ |

TABLE 12

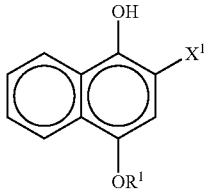

| Compound | $X^1$ | $R^1$ |
|---|---|---|
| 6-113 | —$CO_2C_6H_5$ | —$C_{16}H_{33}$ |
| 6-114 | —$CO_2C_6H_5$ | —$(CH_2)_2SO_2CH_3$ |
| 6-115 | —$CO_2C_6H_5$ | —$(CH_2)_2SO_2NHCH_3$ |
| 6-116 | —$CO_2C_6H_5$ | —$(CH_2)_2NHSO_2C_2H_5$ |
| 6-117 | —$CO_2CH_3$ | —$CH_3$ |
| 6-118 | —$CO_2CH_3$ | —$C_4H_9$ |
| 6-119 | —$CO_2C_2H_5$ | —$C_6H_{13}$ |
| 6-120 | —$CO_2C_2H_5$ | —$(CH_2)_2C_6H_5$ |
| 6-121 | —$CO_2C_2H_5$ | —$C_{12}H_{25}$ |
| 6-122 | —$CO_2C_{12}H_{25}$ | —$CH_3$ |
| 6-123 | —$CO_2C_{12}H_{25}$ | —$C_4H_9$ |
| 6-124 | —$CO_2C_{12}H_{25}$ | —$C_6H_{13}$ |
| 6-125 | —$CO_2C_{12}H_{25}$ | —$(CH_2)_2C_6H_5$ |
| 6-126 | —$CO_2C_{12}H_{25}$ | —$(CH_2)_2SO_2CH_3$ |
| 6-127 | —$CO_2C_{12}H_{25}$ | —$CH{=}CHCH_3$ |
| 6-128 | —$CO_2C_{12}H_{25}$ | —$CH_2CH{=}CH_2$ |
| 6-129 | —$CO_2C_{12}H_{25}$ | —$C{\equiv}CCH_3$ |
| 6-130 | —$CO_2C_{12}H_{25}$ | —$C{-}C_6H_{11}$ |
| 6-131 | —$CO_2C_{12}H_{25}$ | —$C_6H_5$ |
| 6-132 | —$SO_2CH_3$ | —$C_4H_9$ |
| 6-133 | —$SO_2CH_3$ | —$C_6H_{13}$ |
| 6-134 | —$SO_2CH_3$ | —$C_6H_5$ |
| 6-135 | —$SO_2CH_3$ | —$CH_3$ |
| 6-136 | —$SO_2CH_3$ | —$(CH_2)_2C_6H_5$ |

TABLE 13

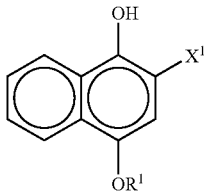

| Compound | $X^1$ | $R^1$ |
|---|---|---|
| 6-137 | —$SO_2CH_3$ | —$CH_2C_6H_5$ |
| 6-138 | —$SO_2C_6H_5$ | —$C_4H_9$ |
| 6-139 | —$SO_2C_6H_5$ | —$C_6H_{13}$ |
| 6-140 | —$SO_2C_6H_5$ | —$CH_3$ |
| 6-141 | —$SO_2C_6H_5$ | —$(CH_2)_2C_6H_5$ |
| 6-142 | —$SO_2C_6H_5$ | —$C_{12}H_{25}$ |
| 6-143 | —$SO_2NHC_6H_5$ | —$C_6H_5$ |
| 6-144 | —$SO_2NHCH_3$ | —$C_6H_5$ |
| 6-145 | —$SO_2NHC_2H_5$ | —$C_6H_5$ |
| 6-146 | —$SO_2NHC_6H_{13}$ | —$C_6H_5$ |
| 6-147 | —$SO_2NHC_4H_9$ | —$C_6H_5$ |
| 6-148 | —$SO_2NH$-t-$C_4H_9$ | —$C_6H_5$ |
| 6-149 | —$SO_2NH$-t-$C_8H_{17}$ | —$C_6H_5$ |
| 6-150 | —$SO_2NHC_6H_5$ | —$C_6H_{13}$ |
| 6-151 | —$SO_2NHCH_3$ | —$C_6H_{13}$ |
| 6-152 | —$SO_2NHC_2H_5$ | —$C_6H_{13}$ |
| 6-153 | —$SO_2NHC_4H_9$ | —$C_6H_{13}$ |
| 6-154 | —$SO_2NH$-t-$C_4H_9$ | —$C_6H_{13}$ |
| 6-155 | —$SO_2NH$-t-$C_8H_{17}$ | —$C_6H_{13}$ |
| 6-156 | —$SO_2NHC_6H_{13}$ | —$(CH_2)_2C_6H_5$ |
| 6-157 | —$SO_2NHC_6H_5$ | —$(CH_2)_2C_6H_5$ |
| 6-158 | —$SO_2NHCH_3$ | —$(CH_2)_2C_6H_5$ |
| 6-159 | —$SO_2NH$-t-$C_8H_{17}$ | —$(CH_2)_2C_6H_5$ |

The reducing compounds represented by the above general formulae (I) to (VI) can be added to the coating solution as powder flux, solid fine particle dispersion, emulsion and oil-protected dispersion using any method. When the reducing compound is used together with the latex according to the invention, the reducing compound is preferably added in the form of a solid fine particle. The solid fine particle dispersion may be made using a known fine particles forming apparatuses (e.g., a ball mill, vibration ball mill, sand mill, colloid mill, jet mill or roller mill). Among these apparatuses, the sand mill is preferable. Also, a dispersing aid may be used when the solid fine particle dispersion is prepared.

The nonphotonsensitive organic silver salt used in the present invention will be explained below.

A nonphotonsensitive organic silver salt (may be simply referred to as an "organic silver salt" as the case may be hereinafter) is contained in the heat-developable photosensitive material of the present invention. Organic silver salts are relatively stable to light and can form a silver image in the case where they are heated at temperatures of 80° C. or more in the presence of an exposed photocatalyst (e.g., a latent image of a photosensitive silver halide) and a reducing agent. The organic silver salt may be an optional organic material containing a source capable of reducing a silver ion. For examples, such a nonphotonsensitive organic silver salt is described in JP-A No. 10-62899, paragraphs nos. 0048 and 0049; European Patent Application Laid-Open No. 0803764A1, page 18, line 24 to page 19, line 37; European Patent Application Laid-Open No. 0962812A1; JP-A Nos. 11-349591, 2000-7683 and 2000-72711. Silver salts of organic acids, and particularly silver salts of long-chain aliphatic carboxylic acids (having 10 to 30 carbon atoms and preferably 15 to 28 carbon atoms) are preferable. Preferable examples of fatty acid salts include silver behenate, silver arachidate, silver stearate, silver oleate, silver laurate, silver caproate, silver myristate, silver palmitate and mixtures of these salts. In the invention, among these fatty acid salts, fatty acid salts which contains behenic acid in an amount of 50 mol % or more is preferable, and those containing 80 mol % or more are more preferable and those containing 90 mol % or more are most preferable.

There is no particular limitation with respect to the shape of the organic silver salt usable in the invention. For example, any of a needle form, bar form, tabular form and scale form may be used. Among these forms, a scale form is preferable.

Silver salt particles (grains) having a form which has the ratio of the major axis to the minor axis thereof of 5 or less, such as a short needle form, rectangular parallelopiped, cubic, and potato-like undefined particles are also preferably used. These organic silver particles having such a ratio have the characteristics that they can reduce fogging during heat developing as compared with long needle particles having the ratio of the major axis to the minor axis at 5 or more.

In the present invention, the scale-like organic silver salt is defined as follows. An organic acid silver salt is observed using an electron microscope, and the shape of the organic acid silver salt grain is made to closely resemble a rectangular parallelopiped. Namely, the grain is supposed to have a rectangular parallelopiped form. When each sides of the rectangular parallelopiped is defined as a, b and c from the smallest side to the bigger side (c may be the same as b), x is calculated in the following manner by using the smallest value a and the value b.

$$x=b/a$$

Each x of 200 particles is calculated to obtain x (average) which is an average of xs. When the particles (grains) satisfy the relation of x (average)≧1.5, the particles are determined to have a scale form. A preferable scale form is 30≧x (average)≧1.5 and more preferable is 20≧x (average)≧2.0. Incidentally, the needle form satisfies the relation of 1≦x (average)<1.5.

In a scale form particle, "a" may be realized as the thickness of a tabular particle having a primary plane defined by the sides b and c. The average of "a" is preferably 0.01 μm or more and 0.23 μm or less and more preferably 0.1 μm or more and 0.20 μm or less. The average of c/b is preferably 1 or more and 6 or less, more preferably 1.05 or more and 4 or less, still more preferably 1.1 or more and 3 or less and most preferably 1.1 or more and 2 or less.

The particle size distribution of the organic silver salt is preferably a monodispersion. Here, the monodispersion means that the percentages, which are determined by dividing each standard deviation of the lengths of the minor axis and major axis of grains by each length of the minor axis and major axis of grains, are preferably 100% or less, more preferably 80% or less and most preferably 50% or less. As a method for determining the shape of the organic silver salt, the shape can be found from the image obtained by using a transmission type electron microscope and a dispersion of the organic silver salt. As another method for determining monodispersibility of the organic silver salt, there is a method in which the standard deviation of the volume weighted average diameter of silver salt is measured. In the method, the percentage (coefficient of variation), which is obtained by dividing the standard deviation by the volume weight average diameter, is 100% or less, preferably 80% or less and most preferably 50% or less. As a method for the measurement of the volume weight average diameter, for example, the particle size (the volume weight average diameter) can be determined such that the organic silver salt dispersed in a solution is irradiated with laser light in order to determine the autocorrelation of a fluctuation of a scattered light obtained by the laser light with respect to a change in time.

Any known methods may be applied to the production of the organic acid silver used in the invention and to the method for dispersing the organic acid silver. For example, methods described in the aforementioned JP-A No. 10-62899, European Patent Application Laid-Open Nos. 0803763A1, 09628121A1, JP-A Nos. 11-349591, 2000-7683, 2000-72711, Japanese Patent Applications Nos. 11-348228 to 11-348230 and 11-203413, 2000-90093, 2000-195621, 2000-191226, 2000-213813, 2000-214155 and 2000-191226 can be used as reference.

If a photosensitive silver salt is made to coexist when the organic silver salt is dispersed, fogging tends to increase and sensitivity tends to decrease. Therefore it is preferable to substantially exclude the photosensitive silver salt during the dispersion of the organic silver salt. In the invention, the amount of the photosensitive silver salt comprised in a water dispersion in which the organic silver salt is dispersed is preferably 1 mol % or less and more preferably 0.1 mol % or less based on 1 mol of the organic acid silver salt in the dispersion. It is still more preferable that the photosensitive silver salt is not positively added to the dispersion.

In the invention, it is possible to produce the photosensitive material by mixing a water dispersion of the organic silver salt with a water dispersion of the photosensitive silver salt. The mixing ratio of the organic silver salt and the photosensitive silver salt may be selected according to the purpose. However, the proportion of the photosensitive silver salt to the organic silver salt is preferably in a range of from 1 to 30 mol %, more preferably from 2 to 20 mol % and most preferably from 3 to 15 mol %. A method in which two or more water dispersions of the organic silver salt are mixed with two or more water dispersions of the photosensitive silver salt is preferably used for controlling the photographic characteristics.

The organic silver salt can be used in a desired amount in the present invention. When the desired amount is represented as the amount of silver, the amount of the organic silver salt represented as the amount of silver is preferably 0.1 to 5 g/m$^2$, more preferably 0.3 to 3 g/m$^2$, and most preferably 0.5 to 2 g/m$^2$.

<Reducing Agent>

The reducing agent, which can be used in the present invention, is explained hereinafter.

The heat-developable photosensitive material of the invention contains at least one of a reducing agent. The reducing agent may be any optional material (preferably an organic material) which reduces a silver ion to metal silver. Such a reducing agent is described in JP-A No. 11-65021, paragraphs No. 0043 to No. 0045 and European Patent Application Laid-Open No. 0803764A1, page 7, line 34 to page 18, line 12.

As the reducing agent in the invention, a so-called hindered type phenolic reducing agent having a substituent at the ortho-position of a phenolic hydroxyl group or a bisphenole type reducing agent are preferable, and compounds represented by the following general formula (VII) are more preferable.

General Formula (VII)

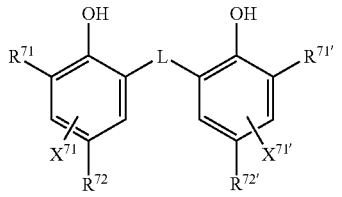

In the general formula (VII), $R^{71}$ and $R^{71'}$ each independently represents an alkyl group having 1 to 20 carbon atoms. $R^{72}$ and $R^{72'}$ each independently represents a hydrogen atom or a substituent with which a benzene ring may be substituted. L represents group either —S— or —$CHR^{73}$—. $R^{73}$ represents a hydrogen atom or an alkyl group having 1 to 20 carbon atoms. $X^{71}$ and $X^{71'}$ each independently represent a hydrogen atom or a substituent with which a benzene ring may be substituted.

The general formula (VII) will be explained in detail below.

In the general formula (VII), $R^{71}$ and $R^{71'}$ may have a substituent. Preferable examples of the substituent include, though the substituent is not particularly limited to, aryl groups, a hydroxy group, alkoxy groups, aryloxy groups, alkylthio groups, arylthio groups, acylamino groups, sulfonamide groups, sulfonyl groups, phosphoryl groups, acyl groups, carbamoyl groups, ester groups, ureide groups, urethane groups and halogen atoms.

As $R^{71}$ and $R^{71'}$ in the general formula (VII), secondary or tertiary alkyl groups having 3 to 15 carbon atoms are preferable and tertiary alkyl groups having 4 to 12 carbon atoms are more preferable. Specific examples thereof include an isopropyl group, an isobutyl group, a t-butyl group, a t-amyl group, a t-octyl group, a cyclohexyl group, a cyclopentyl group, a 1-methylcyclohexyl group and a 1-methylcyclopropyl group. Among these examples, a t-butyl group, a t-amyl group and a 1-methylcyclohexyl group are preferable and a t-butyl groups are more preferable.

In the general formula (VII), $R^{72}$ and $R^{72'}$ each independently represent a hydrogen atom or a substituent with which a benzene ring can be substituted, and $X^{71}$ and $X^{71'}$ also each independently represent a hydrogen atom or a substituent with which a benzene ring may be substituted. As the group with which a benzene ring is substituted, alkyl groups, aryl groups, halogen atoms, alkoxy groups and acylamino groups are preferable.

As $R^{72}$ and $R^{72'}$ in the general formula (VII), alkyl groups having 1 to 20 carbon atoms are preferable. Specific examples thereof include a methyl group, ethyl group, propyl group, butyl group, isopropyl group, t-butyl group, t-amyl group, cyclohexyl group, 1-methylcyclohexyl group, benzyl group, methoxymethyl group, methoxyethyl group. The methyl group, ethyl group, propyl group, isopropyl group and t-butyl group are more preferable as $R^{72}$ and $R^{72'}$.

As $X^{71}$ and $X^{71'}$ in the general formula (VII), a hydrogen atom, halogen atoms and alkyl groups are preferable and a hydrogen atom is more preferable.

In the general formula (VII), L represents —S— or a —$CHR^{73}$—, and preferably L represents —$CHR^{73}$—.

As the $R^{73}$, a hydrogen atom and alkyl groups having 1 to 15 carbon atoms are preferable. Specific examples thereof include a hydrogen atom, methyl group, ethyl group, propyl group, isopropyl group, 2,4,4-trimethylpentyl group. Among them, a hydrogen atom, methyl group, propyl group and isopropyl group are more preferable.

When $R^{73}$ is a hydrogen atom, each of $R^{72}$ and $R^{72'}$ is preferably an alkyl group having 2 to 5 carbon atoms, more preferably an ethyl group and propyl group and most preferably an ethyl group.

When $R^{73}$ is a primary or secondary alkyl group having 1 to 8 carbon atoms, each of $R^{72}$ and $R^{72'}$ is preferably a methyl group. In this case, as the primary or secondary alkyl group having 1 to 8 carbon atoms represented by $R^{73}$, a methyl group, ethyl group, propyl group and isopropyl group are preferable and a methyl group, ethyl group and propyl group are more preferable.

When all of $R^{71}$, $R^{71'}$, $R^{72}$ and $R^{72'}$ are methyl groups, $R^{73}$ is preferably a secondary alkyl group. In this case, as the secondary alkyl group of $R^{73}$, an isopropyl group, isobutyl group and 1-ethylpentyl group are preferable and an isopropyl group is more preferable.

The reducing agent can change heat developing ability and developed silver color tone depending on the combination of $R^{71}$, $R^{71'}$, $R^{72}$, $R^{72'}$ and $R^{73}$. Further, these characteristics can also be regulated by combining two or more reducing agents. Therefore it is preferable to combine two or more reducing agents according to the purpose when the reducing agent is used.

Specific examples of the compound represented by the general formula (VII), the compound being the reducing agent according to the invention, are shown below; however, these examples are not intended to be limiting the scope of the invention.

(7-1)
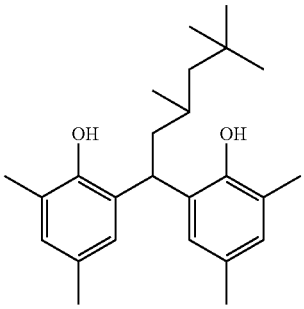
(7-2)
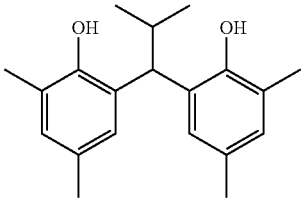
(7-3)
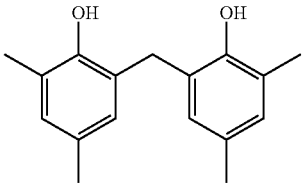
(7-4)
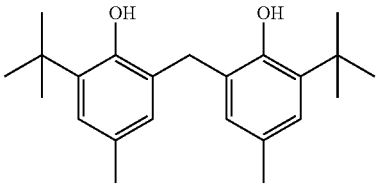
(7-5)
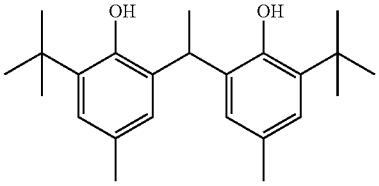
(7-6)
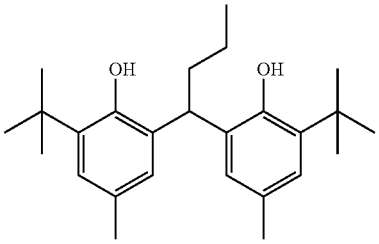
(7-7)
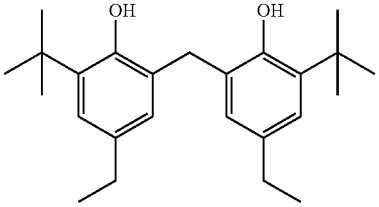
-continued
(7-8)
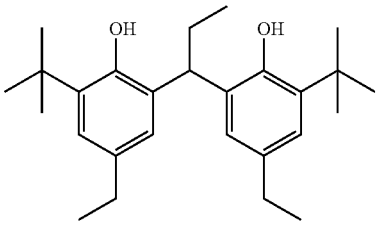
(7-9)
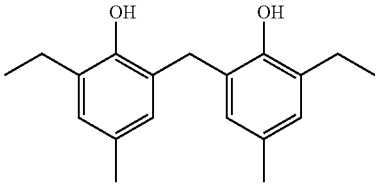
(7-10)
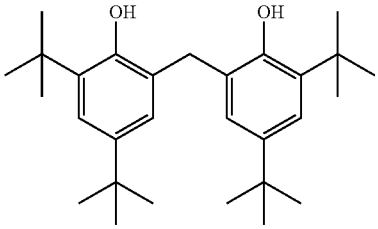
(7-11)
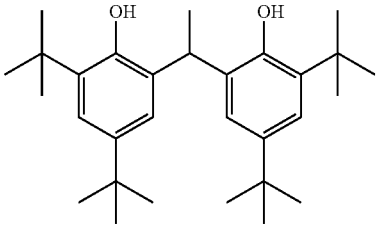
(7-12)
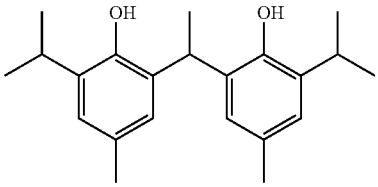
(7-13)
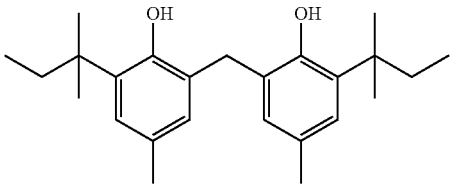
(7-14)
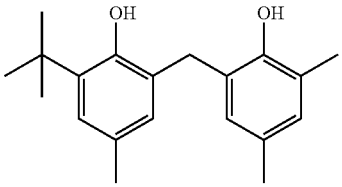

-continued
(7-15)
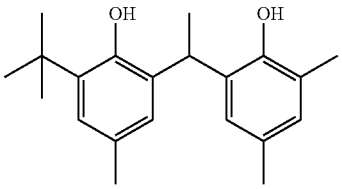
(7-16)
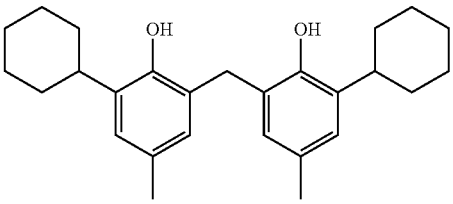
(7-17)
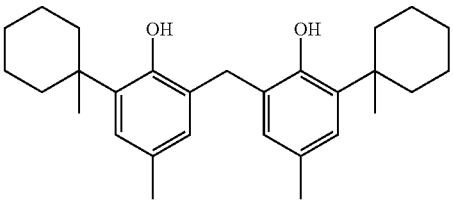
(7-18)
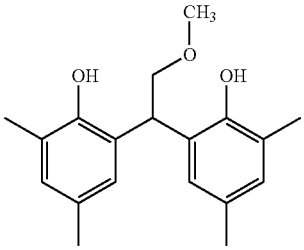
(7-19)
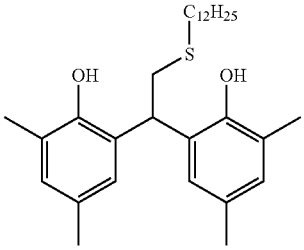
(7-20)
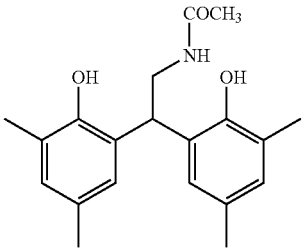
(7-21)
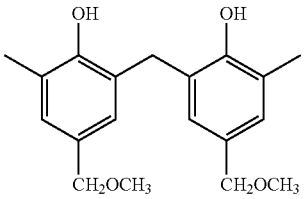
-continued
(7-22)
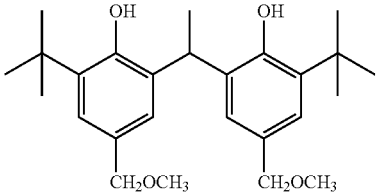
(7-23)
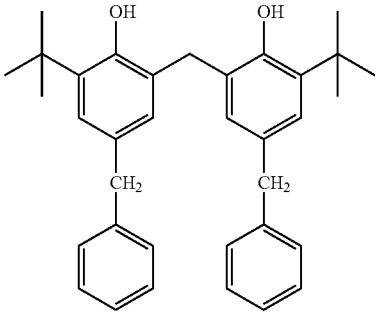
(7-24)
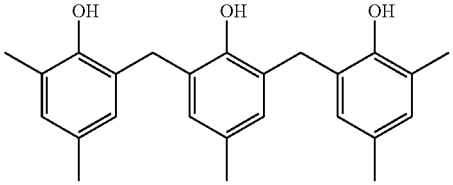
(7-25)
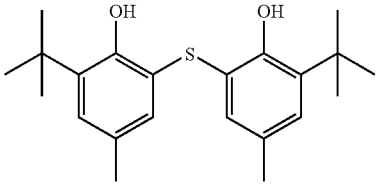
(7-26)
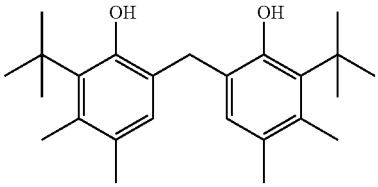
(7-27)
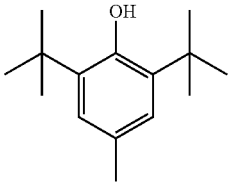
(7-28)
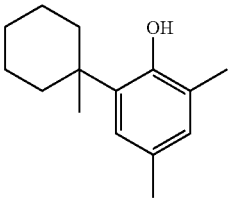

-continued (7-29)

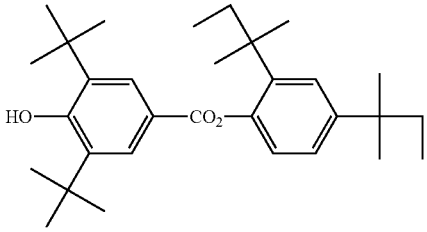

(7-30)

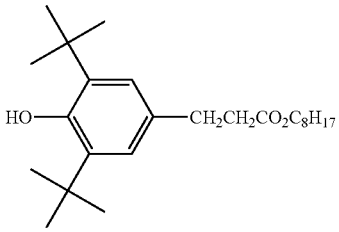

(7-31)

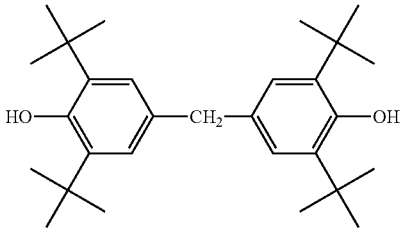

(7-32)

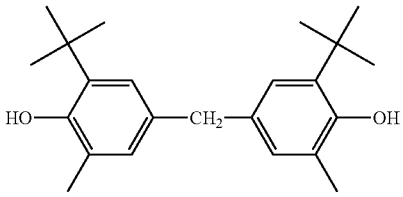

(7-33)

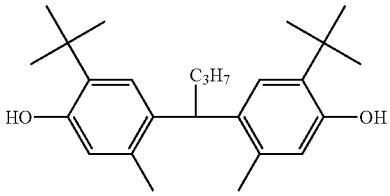

(7-34)

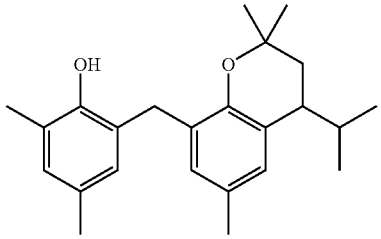

In the present invention, the amount of the reducing agent is preferably 0.1 to 3.0 g/m$^2$, more preferably 0.2 to 1.5 g/m$^2$ and most preferably 0.3 to 1.0 g/m$^2$. Also, the reducing agent is preferably contained in the image forming layer in an amount of 5 to 50% mol, more preferably 8 to 30% mol and most preferably 10 to 20 mol % based on one mol of silver comprised in the image forming layer.

Also, the reducing agent is preferably contained in the image forming layer.

The reducing agent may be contained in the coating solution in any form such as a solution form, emulsifying dispersion form and solid fine particle dispersion form before the coating solution is added to the photosensitive material.

As a known emulsifying dispersion method, methods in which the reducing agent is dissolved using an oil such as dibutyl phthalate, tricresyl phosphate, glyceryl triacetate and diethyl phthalate, and an auxiliary solvent such as ethyl acetate and cyclohexanone to make an emulsifying dispersion mechanically are exemplified.

As a method for dispersing solid fine particles, a method in which a powder of the reducing agent is dispersed in a proper solvent such as water by using a ball mill, colloid mill, vibration ball mill, sand mill, jet mill, roller mill or ultrasonic wave to make a solid dispersion is exemplified. At this time, a protective colloid (e.g., polyvinyl alcohol) and surfactants (e.g., anionic surfactants such as sodium triisopropylnaphthalenesulfonate (a mixture of compounds wherein each position of three isopropyl groups is different from each other)) may be used.

In the aforementioned mills, beads such as zirconia are normally used as the dispersion medium, and there is a case where Zr and the like eluted from these beads are mingled in the dispersion medium. The amount of Zr mingled in the dispersion medium is in a range from 1 ppm to 1000 ppm, though it depends on the condition of the dispersion. When Zr is mingled in the heat-sensitive recording material, the amount of Zr of 0.5 mg or less per 1 g of silver is allowable for practical use.

It is desirable to include an antiseptic (e.g., benzoisothiazolinone sodium salt) in the water dispersion.

These developing accelerators described above are preferably used in an amount of from 0.1 to 20 mol %, more preferably from 0.5 to 10 mol % and most preferably from 1 to 5 mol % based on the reducing agent. As a method of introducing the developing accelerator into the heat-developable photosensitive material, the same methods as in the case of the reducing agent are exemplified. However, the developing accelerator is preferably added as a solid dispersion or emulsion.

When the developing accelerator is added as an emulsion, it is preferable that the emulsion is added as an emulsion prepared such that emulsification is carried out using a high-boiling point solvent that is a solid at ordinary temperature and a low-boiling point auxiliary solvent, or that emulsification is carried without using high-boiling point solvent to form a so-called oilless emulsion dispersion.

When the reducing agent of the present invention has a hydroxyl group (—OH) bonding to an aromatic group, particularly when the reducing agent is selected from the aforementioned bisphenols, it is preferably used in combination with a non-reducing compound having a group capable of forming a hydrogen bond together with the hydroxyl group. Examples of the group forming a hydrogen bond together with the hydroxyl group or amino group include a phosphoryl group, a sulfoxide group, a sulfonyl group, a carbonyl group, an amide group, an ester group, an urethane group, an ureide group, a tertiary amino group and a nitrogen-containing aromatic group. Among thees compounds, compounds having a group such as a phosphoryl group, sulfoxide group, amide group (the amide group does not comprises a >N—H group, and is blocked with Ra as shown by the general formula >N—Ra (Ra is a substituent, and is not H)), urethane group (the urethane group does not comprises a >N—H group, and is blocked with Ra as shown by the general formula >N—Ra (Ra is a substituent, and is not H) and ureide group (the ureide group does not comprises a >N—H group, and is blocked with Ra as shown by the general formula >N—Ra (Ra is a substituent, and is not H) are preferable.

In the invention, particularly preferable hydrogen-bondable compounds are those represented by the general formula (VIII).

General Formula (VIII)

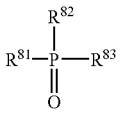

In the general formula (VIII), $R^{81}$ to $R^{83}$ each independently represent an alkyl group, an aryl group, an alkoxy group, an aryloxy group, an amino group or a heterocyclic group, and these groups may be unsubstituted or substituted with a substituent. Examples of the substituent include halogen atoms, alkyl groups, aryl groups, alkoxy groups, amino groups, acyl groups, acylamino groups, alkylthio groups, arylthio groups, sulfonamide groups, acyloxy groups, oxycarbonyl groups, carbamoyl groups, sulfamoyl groups, sulfonyl groups and phosphoryl groups. Preferable examples of the substituent include alkyl groups and aryl groups such as a methyl group, ethyl group, isopropyl group, t-butyl group, t-octyl group, phenyl group, 4-alkoxyphenyl group and 4-acyloxyphenyl group.

Examples of the alkyl group represented by $R^{81}$ to $R^{83}$ in the general formula (VIII) include a methyl group, ethyl group, butyl group, octyl group, dodecyl group, isopropyl group, t-butyl group, t-amyl group, t-octyl group, cyclohexyl group, 1-methylcyclohexyl group, benzyl group, phenethyl group and 2-phenoxypropyl group.

Examples of the aryl group represented by $R^{81}$ to $R^{83}$ in the general formula (VIII) include a phenyl group, cresyl group, xylyl group, naphthyl group, 4-t-butylphenyl group, 4-t-octylphenyl group, 4-anisidyl group and 3,5-dichlorophenyl group.

Examples of the alkoxy group represented by $R^{81}$ to $R^{83}$ in the general formula (VIII) include a methoxy group, ethoxy group, butoxygroup, octyloxygroup, 2-ethylhexyloxy group, 3,5,5-trimethylhexyloxy group, dodecyloxy group, cyclohexyloxy group, 4-methylcyclohexyloxy group and benzyloxy group.

Examples of the aryloxy group represented by $R^{81}$ to $R^{83}$ in the general formula (VIII) include a phenoxy group, cresyloxy group, isopropylphenoxy group, 4-t-butylphenoxy group, naphthoxy group and biphenyloxy group.

Examples of the amino group represented by $R^{81}$ to $R^{83}$ in the general formula (VIII) include a dimethylamino group, diethylamino group, dibutylamino group, dioctylamino group, N-methyl-N-hexylamino group, dicyclohexylamino group, diphenylamino group and N-methyl-N-phenylamino group.

As $R^{81}$ to $R^{83}$ in the general formula (VIII), alkyl groups, aryl groups, alkoxy groups and aryloxy groups are preferable. At least one of $R^{81}$ to $R^{83}$ is preferably an alkyl group or aryl group and two or more of $R^{81}$ to $R^{83}$ are more preferably alkyl groups or aryl groups from the viewpoint of the effect of the invention. Also, the case where $R^{81}$ to $R^{83}$ are the same groups is preferable from the viewpoint of availability at lower price.

Specific examples of the hydrogen-bondable compounds including the compounds of the general formula (VIII) in the present invention will be shown below. However these examples are not intended to limit the invention.

(8-1)

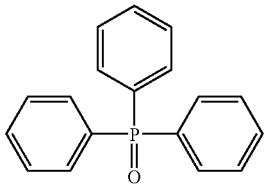

(8-2)

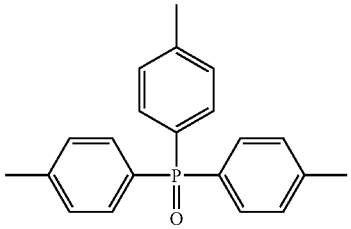

(8-3)

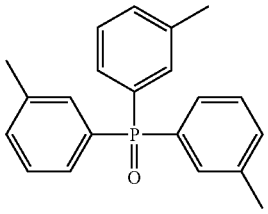

(8-4)

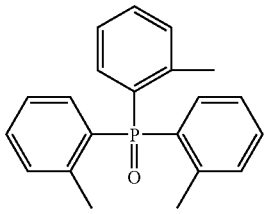

(8-5)

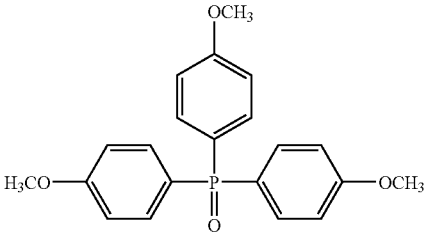

(8-6)

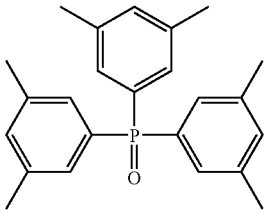

(8-7)

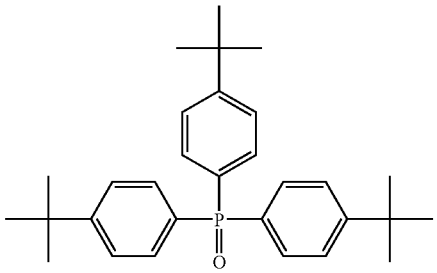

-continued (8-8)

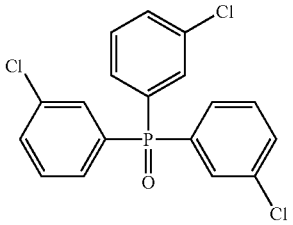

(8-9)

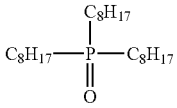

(8-10)

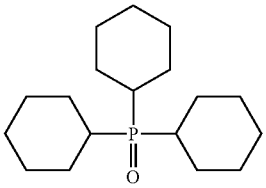

(8-11)

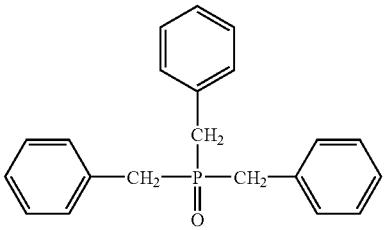

(8-12)

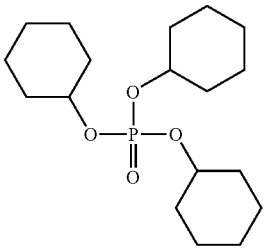

(8-13)

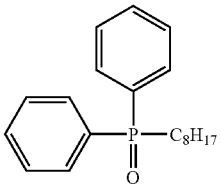

(8-14)

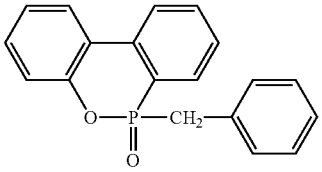

(8-15)

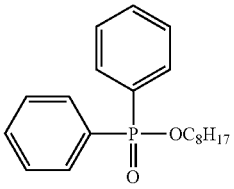

-continued (8-16)

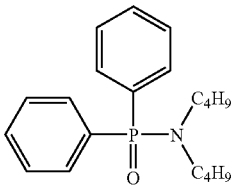

(8-17)

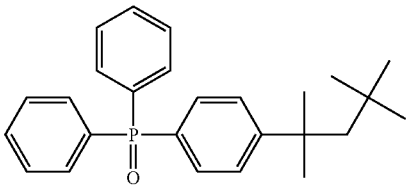

(8-18)

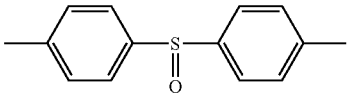

(8-19)

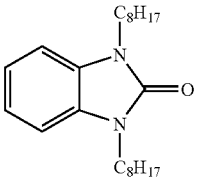

(8-20)

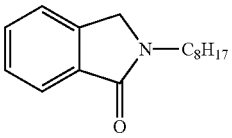

(8-21)

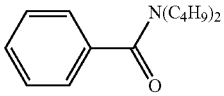

In addition to the foregoing examples, those compounds described in EP No. 1096310, Japanese Patent Application Nos. 2000-270498 and 2001-124796 are given as specific examples of the hydrogen-bondable compound.

The compound represented by the general formula (VIII) in the invention can be used in the same manner as the reducing agent. Namely, the compound represented by the general formula (VIII) can be contained in a coating solution in any form such as in the form of a solution, emulsion dispersion (emulsion) and solid fine particle dispersion. The coating solution is used for forming the photosensitive material. In the solution, the compound according to the invention forms a hydrogen-bondable complex in combination with a compound having a phenolic hydroxyl group and/or an amino group. Depending on a combination of the reducing agent and the compound of the general formula (VIII) of the invention, a complex obtained therefrom can be isolated in a crystal state. It is particularly preferable to use the powder of the crystal isolated as the solid-dispersed fine particle dispersion in order to obtain a stable performance. Also, a method in which fine particles of the reducing agent are mixed with fine particles of the compound of the general formula (VIII) in the invention, and then the complex that is formed during the mixture is dispersed using a proper dispersing agent by a disperser such as a sand grinder mill, may be preferably used.

The compound of the general formula (VIII) in the invention is preferably used in an amount ranging from 1 to 200 mol %, more preferably from 10 to 150 mol % and most preferably from 20 to 100 mol % based on the reducing agent.

Binder

The binder used in the invention will be explained below.

In the present invention, the binder which is contained a layer containing the organic silver salt may be any polymer. A desirable binder is a transparent or semitransparent and generally a colorless polymer. Examples of the binder include natural resins, natural polymers and natural copolymers, and synthetic resins, synthetic polymers and synthetic copolymers, and, other than the above compounds, media for forming films such as gelatins, rubbers, poly (vinyl alcohol)s, hydroxyethyl celluloses, cellulose acetates, cellulose acetate butylates, poly(vinylpyrrolidone)s, casein, starch, poly(acrylic acid)s, poly(methylmethacrylic acid)s, poly (vinyl chloride)s, poly(methacrylic acid)s, styrene-maleic anhydride copolymers, styrene-acrylonitrile copolymers, styrene-butadiene copolymers, poly(vinylacetal)s (for example, poly(vinylformal) and poly(vinylbutyral)), poly (ester)s, poly(urethane)s, phenoxy resins, poly(vinylidene chloride)s, poly(epoxide)s, poly(carbonate)s, poly(vinyl acetate)s, poly(olefin)s, cellulose esters and poly(amide)s. The binder may be formed as a film from water or an organic solvent or an emulsion.

In the invention, the glass transition temperature of the binder conprised in the layer containing the organic silver salt is preferably 10° C. or more and 80° C. or less (hereinafter the binder may be referred to as a high-Tg binder), more preferably 15° C. to 70° C., and most preferably 20° C. or more and 65° C. or less.

It is noted that Tg of the polymer was calculated based on the following general formula.

$$1/Tg=\Sigma(Xi/Tgi)$$

When a polymer, which should be calculated by the formula, is obtained by copolymerizing n monomer components, which are different from each other, Tg was determined according the formula. Here, n is a number, and i represents a number from 1 to n. Xi is the mass ratio of the i th monomer ($\Sigma Xi=1$) and Tgi is the glass transition temperature (absolute temperature) of a homopolymer obtained from the i th monomer. It is to be noted that $\Sigma$ is a symbol of sum, and a sum of (Xi/Tgi) is calculated such that i is increased from 1 to n. As the value (Tgi) of the glass transition temperature of a homopolymer of each monomer, the values described in the Polymer Handbook (3rd Edition, J. Brandrup, E. H. Immergut, Wiley-Interscience, 1989) were adopted.

A combination of two or more types of the binder may be used as needed. Also, a binder having a glass transition temperature of 20° C. or more may be used in combination with a binder having a glass transition temperature of less than 20° C. When two or more polymers that have differnet Tg are blended and used, the mass average Tg preferably falls in the above range.

In the invention, the organic silver salt-containing layer is preferably prepared by applying a coating solution containing water in an amount of 30 mass % in a solvent, followed by drying to form a film.

In the invention, performance is improved in the case where the organic silver salt-containing layer is prepared by applying a coating solution containing water in an amount of 30 mass % in a solvent, followed by drying to form a film, and also in the case where the binder in the organic silver salt-containing layer is soluble or dispersible in a water-type solvent (aqueous solvent), and particularly in the case where a latex of a polymer having an equilibrium moisture content of 2 mass % or less at 25° C. and 60% RH is used. The binder in the most desirable form is one prepared such that the ionic conductivity thereof is 2.5 mS/cm or less. Examples of such a preparation method include a method in which after a polymer is synthesized, it is subjected to refining treatment using a membrane having a separation function.

The water-type solvent in which the aforementioned polymer is solvable or dispersible means water or a solvent obtained by mixing water with 70 mass % or less of a water-miscible organic solvent. Examples of the organic solvent miscible with water include alcohols such as methyl alcohol, ethyl alcohol and propyl alcohol, cellosolves such as methyl cellosolve, ethyl cellosolve and butyl cellosolve and ethyl acetate and dimethylformamide.

Incidentally, in the case of a system in which the polymer is undissolved thermodynamically but present in a dispersed state, the term "water-type solvent" is also used.

Also, "the equilibrium moisture content at 25° C. and 60% RH" may be given by the following general formula by using a mass W1 of the polymer placed in a humidity-equilibrium state in an atmosphere of 25° C. and 60% RH and a mass W0 of the polymer placed in an absolutely dry state.

Equilibrium moisture content at 25° C. and 60% RH={(W1−W0)/W0}×100 (mass %)

The definition and measuring method of the moisture content can be referred to in "Polymer Engineering Lecture 14, Polymer material Test Method" (Polymer Society edition, Chizin Shokan).

In the invention, the equilibrium moisture content of the binder polymer at 25° C. and 60% RH is preferably 2 mass % or less, more preferably 0.01 mass % or more and 1.5 mass % or less, and still more preferably 0.02 mass % or more and 1 mass % or less.

In the invention, a polymer dispersible in a water-type solvent is particularly preferable. As the dispersed state, examples thereof include a state of latex wherein fine particles of water-insoluble hydrophobic polymer are dispersed, and a state in which a polymer molecule is dispersed in a molecular state or a micell state. However, the state of latex in which the particles are dispersed is more preferable. The average particle diameter of the dispersed particles is preferably 1 to 50000 nm, more preferably 5 to 1000 nm, still more preferably 10 to 500 nm, and most preferably 50 to 200 nm. No particular limitation is imposed on the particle size distribution of the dispersed particles. Any polymer particle having a wide particle size distribution and those having a monodispersion particle size distribution may be acceptable. It is preferable to use a mixture of two or more types of polymer particles having a monodispersion particle size distribution from the viewpoint of controlling the qualities of the coating solution.

In the invention, preferable examples of the polymer dispersable in a water-type solvent include hydrophobic polymers such as acrylic polymers, poly(ester)s, rubbers (e.g., SBR resins), poly(urethane)s, poly(vinyl chloride)s, poly(vinyl acetate)s, poly(vinylidene chloride)s and poly (olefin)s. These polymers may be straight-chain polymers, branched polymers or crosslinked polymers. Also, homopolymers obtained by polymerizing single monomers or copolymers obtained by polymerizing two or more types of monomer may also be usable. In the case of copolymers, these copolymers may be random copolymers or block copolymers. The molecular weight of these polymers is 5000 to 1,000,000 and preferably 10,000 to 200,000 in terms of the number average molecular weight. Polymers having an excessively small molecular weight sometimes cause unfavorable insufficient dynamic strength in the emulsion layer, and polymers having excessively large molecular weight sometimes cause unfavorable impaired coatability. The crosslinked polymer latex is used particularly preferably.

As specific preferable examples of the polymer latex, the following compounds may be given. However these examples are not intended to limit the invention. In the following, these examples are represented by raw material monomers of the latex, wherein the values in the parenthesis are mass % and the molecular weight is a number average molecular weight. When a polyfunctional monomer is used, the concept of a molecular weight cannot be applied because the polyfunctional monomer forms a crosslinking structure. Therefore, such a case is described as "crosslinkable" and the description of a molecular weight is omitted. Tg represents a glass transition temperature.

P-1: Latex of -MMA(70)-EA(27)-MAA(3)-(molecular weight: 37000, Tg: 61° C.).

P-2: Latex of -MMA(70)-2EHA(20)-St(5)-AA(5)-(molecular weight: 40000, Tg: 59° C.).

P-3: Latex of -St(50)-Bu(47)-MAA(3)-(crosslinkable, Tg: 17° C.).

P-4: Latex of -St(68)-Bu(29)-AA(3)-(crosslinkable, Tg: 17° C.).

P-5: Latex of -St(71)-Bu(26)-AA(3)-(crosslinkable, Tg: 24° C.).

P-6: Latex of -St(70)-Bu(27)-IA(3)-(crosslinkable).

P-7: Latex of -St(75)-Bu(24)-AA(1)-(crosslinkable, Tg: 29° C.).

P-8: Latex of -St(60)-Bu(35)-DVB(3)-MAA(2)-(crosslinkable).

P-9: Latex of -St(70)-Bu(25)-DVB(2)-AA(3)-(crosslinkable).

P-10: Latex of -VC(50)-MMA(20)-EA(20)-AN(5)-AA(5)-(molecular weight: 80,000).

P-11: Latex of -VDC(85)-MMA(5)-EA(5)-MAA(5)-(molecular weight: 67,000).

P-12: Latex of -ET(90)-MMA(10)-(molecular weight: 12,000).

P-13: Latex of -St(70)-2EHA(27)-AA(3)-(molecular weight: 130,000, Tg: 43° C.).

P-14: Latex of -MMA(63)-EA(35)-AA(2)-(molecular weight: 33,000, Tg: 47° C.).

P-15: Latex of -St(70.5)-Bu(26.5)-AA(3)-(crosslinkable, Tg: 23° C.).

P-16: Latex of -St(69.5)-Bu(27.5)-AA(3)-(crosslinkable, Tg: 20.5° C.).

The abbreviations of the above structures indicate the following monomers: MMA: methylmethacrylate, EA: ethylacrylate, MAA: methacrylic acid, 2EHA: 2-ethylhexylacrylate, St: styrene, Bu: butadiene, AA: acrylic acid, DVB: divinylbenzene, VC: vinylchloride, AN: acrylonitrile, VDC: vinylidene chloride, Et: ethylene and IA: itaconic acid.

These polymer latexes as described above are commercially available and the following polymers can be utilized. Examples of acrylic polymers include Sebian A-4635, 4718 and 4601 (manufactured by Daicel Chemical Industries, Ltd.) and Nipol Lx 811, 814, 821, 820 and 857 (manufactured by Zeon Corporation). Examples of poly(ester)s include FINETEX ES650, 611, 675 and 850 (manufactured by Dainippon Ink and Chemicals, Incorporated) and WD-size and WMS (manufactured by Eastman Chemical Company). Examples of poly (urethane) s include HYDRAN AP10, 20, 30 and 40 (manufactured by Dainippon Ink and Chemicals, Incorporated). Examples of rubbers include LACSTAR 7310K, 3307B, 4700H and 7132C (manufactured by Dainippon Ink and Chemicals, Incorporated) and Nipol Lx 416, 410, 438C and 2507 (manufactured by Zeon Corporation). Examples of poly(vinyl chloride)s include G351 and G576 (manufactured by Zeon Corporation). Examples of poly(vinylidene chloride) s may include L502 and L513 (manufactured by Asahi Chemical Industry Co., Ltd.). Examples of poly(olefin)s include Chemipearl S120 and SA100 (manufactured by Mitsui Petrochemical Industries, Ltd.).

These polymer latexes may be used singly or in combination by blending two or more.

As the polymer latex used in the invention, latexes of styrene-butadiene copolymers are particularly preferable. The mass ratio of a monomer unit of styrene to a monomer unit of butadiene in the styrene-butadiene copolymer is 40:60 to 95:5. The proportion occupied by the monomer unit of styrene and the monomer unit of butadiene in the copolymer is preferably 60 to 99 mass %.

Further, in the invention, the polymer latex contains acrylic acid or methacrylic acid in an amount of preferably 1 to 6 mass %, and more preferably 2 to 5 mass % based on the sum of styrene and butadiene. The polymer latex of the invention preferably contains acrylic acid.

Preferable examples of the latex of a styrene-butadiene copolymer used in the invention include the foregoing latexes of P-3 to P-8, P-15 and commercially available LACSTAR-3307B, 7132C and Nipol Lx416.

The Tg of the forging latex of the styrene-butadiene copolymer is preferably 10° C. or more and 30° C. or less, and more preferably 17° C. or more and 25° C. or less.

A hydrophilic polymer such as gelatin, polyvinyl alcohol, methyl cellulose, hydroxypropyl cellulose and carboxymethyl cellulose may be compounded in the organic silver salt-containing layer of the heat-developable photosensitive material of the invention as required. The amount of these hydrophilic polymers to be added is 30 mass % or less and more preferably 20 mass % or less based on the entire binder of the organic silver salt-containing layer.

The organic silver-containing layer (namely, image forming layer) is preferably formed using the polymer latex. As to the amount of the binder comprised in the organic silver salt-containing layer, the mass ratio of binder to organic silver salt (binder/organic silver salt) is to be in a range from 1/10 to 10/1, more preferably 1/3 to 5/1 and most preferably 1/1 to 3/1.

Such an organic silver salt-containing layer is also usually a photosensitive layer (emulsion layer), which contains a photosensitive silver halide that is a photosensitive silver salt. In such a case, the mass ratio of the total binder to the silver halide (total binder/silver halide) is in a range from 400 to 5 and more preferably from 200 to 10.

The total amount of the binder comprised in the image forming layer in the invention is in a range from 0.2 to 30 $g/m^2$, more preferably 1 to 15 $g/m^2$ and most preferably 2 to 10 $g/m^2$. A crosslinking agent for a crosslinking reaction and a surfactant for improving coatability may be added to the image forming layer of the present invention.

The solvent (here, a solvent and a dispersant are called together a solvent for simplicity) used in the coating solution for the organic silver salt-containing layer in the heat-developable photosensitive material is preferably a water-type solvent containing 30 mass % or more of water. Examples of optional components of the solvent other than water include water-miscible organic solvents such as methyl alcohol, ethyl alcohol, isopropyl alcohol, methyl cellosolve, dimethylformamide and ethyl acetate. The content of water in the solvent used for the coating solution is to be 50 mass % or more and more preferably 70 mass % or more. In addition to water itself, preferable examples of the composition of the solvent include water/methyl alcohol=90/10, water/methyl alcohol=70/30, water/methyl alcohol/dimethylformamide=80/15/5, water/methyl alcohol/ethyl cellosolve=85/10/5 and water/methyl alcohol/isopropyl alcohol=85/10/5 (the values are mass %).

Examples of an anti fogging agent, stabilizer and stabilizer precursor include compounds described in JP-A No. 10-62899, paragraph no. 0070; European Patent Application Laid-Open No. 0803764A1, page 20, line 57 to page 21, line 7; U.S. Pat. No. 6,083,681; EP No. 1048975; and compounds described in JP-A Nos. 9-281637 and 9-329864. The anti fogging agent preferably used in the present invention is organic halides. Examples of these organic halides include those disclosed in JP-A No. 11-65021, paragraph nos. 0111 to 0112. Further, organic halide compounds represented by the general formula (P) described in JP-A No. 2000-284339, organic polyhalide compounds represented by the general formula (II) described in JP-A No. 10-339934, and organic polyhalide compounds described in JP-A Nos. 2001-31644 and 2001-33911 are particularly preferable.

Preferable organic polyhalide compounds will be hereinafter explained in detail. Preferable polyhalide compounds usable in the invention are represented by the following general formula (H).

General Formula (H)

$$Q\text{-}(Y)_n\text{—}C(Z_1)(Z_2)X$$

In the general formula (H), Q represents an alkyl group, an aryl group or a heterocyclic group, Y represents a divalent connecting group, n denotes 0 or 1, $Z_1$ and $Z_2$ each independently represent a halogen atom and X represents a hydrogen atom or an electron attractive group.

In the general formula (H), Q represents a phenyl group substituted with an electron attractive group preferably having a positive Hammett's substituent constant σρ. Journal of Medicinal Chemistry, 1973, Vol. 16, No. 11, 1207–1216 serves as a reference for the Hammett's substituent constant.

Examples of such an electron attractive group include halogen atoms (a fluorine atom (σvalue=0.06), a chlorine atom (σ value=0.23), a bromine atom (σ value=0.23) and an iodine atom (σ value=0.18)), trihalomethyl groups (a tribromomethyl (σ value=0.29), a trichloromethyl (σ value=0.33), a trifluoromethyl (σ value=0.54)), a cyano group (σ value = 0.66), a nitro group (σ value=0.78), aliphatic, aryl or heterocyclic sulfonyl groups (e.g., a methanesulfonyl (σ value=0.72)), aliphatic, aryl or heterocyclic acyl groups (e.g., an acetyl (σ value=0.50) and a benzoyl (σ value=0.43)), alkinyl groups (e.g., C≡CH (σ value=0.23)), aliphatic, aryl or heterocyclic oxycarbonyl groups (e.g., a methoxycarbonyl (σ value=0.45) and a phenoxycarbonyl (σ value=0.44)), a carbamoyl group (σ value=0.36), a sulfamoyl group (σ value=0.57), a sulfoxide group, a heterocyclic group and a phosphoryl group. The σ value is preferably in a range of from 0.2 to 2.0 and more preferably from 0.4 to 1.0. Particularly preferable examples of the electron attractive group include carbamoyl groups, alkoxycarbonyl groups, alkylsulfonyl groups and alkylphosphoryl groups. Among these groups, carbamoyl groups are most preferable.

X is preferably an electron attractive group, more preferably a halogen atom, aliphatic, aryl or heterocyclic sulfonyl group; aliphatic, aryl or heterocyclic acyl group; aliphatic, aryl or heterocyclic oxycarbonyl group; carbamoyl group or sulfamoyl group; and particularly preferably a halogen atom. Among halogen atoms, a chlorine atom, bromine atom and iodine atom are preferable, a chlorine atom and bromine atom are more preferable, and a bromine atom is particularly preferable.

Y preferably represents —C(═O)—, —SO— or —$SO_2$— more preferably —C(═O)— or —$SO_2$— and most preferably —$SO_2$—, n denotes 0 or 1 and preferably 1.

Specific examples of the compound represented by the general formula (H) according to the invention will be hereinafter explained. However, the compound represented by the general formula (H) that can be used in the invention, is not limited to these examples.

H-1

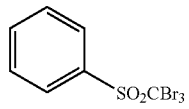

H-2

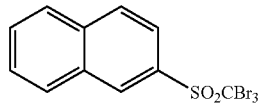

H-3

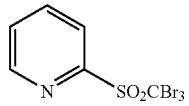

H-4

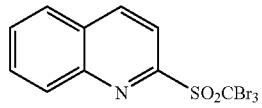

H-5

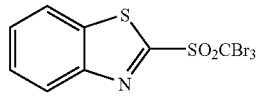

H-6

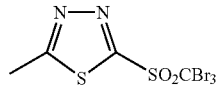

H-7

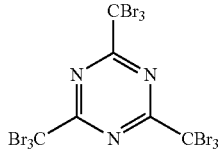

H-8

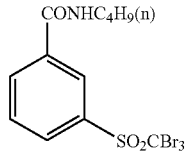

-continued

H-9

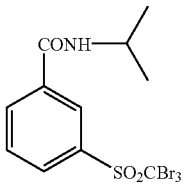

H-10

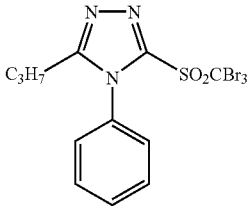

H-11

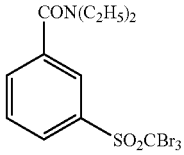

H-12

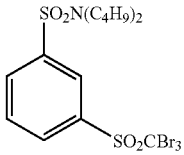

H-13

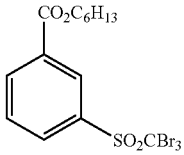

H-14

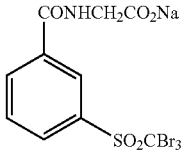

H-15

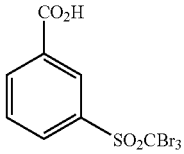

H-16

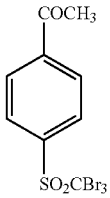

H-17

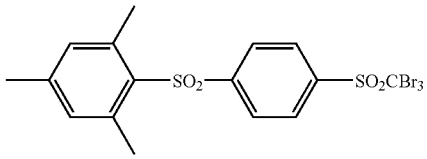

-continued

H-18

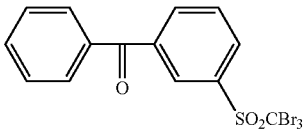

H-19

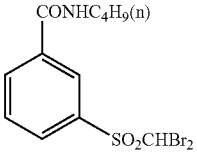

H-20

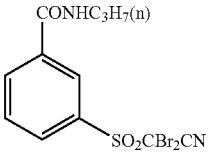

H-21

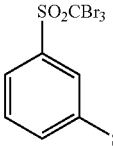

H-22

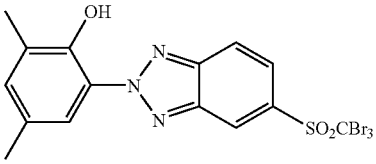

H-23

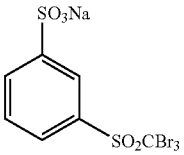

H-24

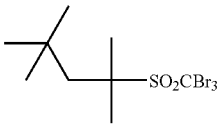

The compound represented by the general formula (H) of the present invention is preferably used in an amount from $1\times10^{-4}$ to 0.5 mol, more preferably $1\times10^{-3}$ to 0.1 mol, and most preferably $5\times10^{-3}$ to 0.05 mol per one mol of the nonphotonsensitive silver salt of the image forming layer.

In the present invention, as a method for compounding an anti fogging agent in the photosensitive material, the methods described above as the method for compounding the foregoing reducing agent are given. Further, the organic polyhalogen compound can be preferably added in the form of a solid fine particle dispersion.

Examples of other anti fogging agent include mercury (II) salts and benzoic acids described in JP-A No. 11-65021, paragraph nos. 0113 and 0114, salicylic acid derivatives described in JP-A No. 2000-206642, formalin scavenger compounds represented by the general formula (S) in JP-A No. 2000-221634, triazine compounds according to claim 9 described in JP-A No. 11-352624, compounds represented by the general formula (III) described in JP-A No. 6-11791, and 4-hydroxy-6-methyl-1,3,3a,7-tetrazaindene.

The heat-developable photosensitive material of the present invention may contain an azolium salt in order to prevent fogging. Examples of the azolium salt include compounds represented by the general formula (XI) described in JP-A No. 59-193447, compounds described in JP-B No. 55-12581, and compounds represented by the general formula (II) described in JP-A No. 60-153039. The azolium salt may be added to any portion and area of the photosensitive material. However, it is preferable that the azolium salt is added to a layer on the side provided with the photosensitive layer and more preferably to the organic silver salt-containing layer.

As the time in which to add the azolium salt, it may be added during any step for preparing the coating solution. When the azolium salt is added to the organic silver salt-containing layer, it can be added at any time between the preparation of the organic silver salt and the preparation of the coating solution. However, it is preferably added after the organic silver salt is prepared and just before application.

The azolium salt may be added in any form such as a powder, solution and fine particle dispersion. Also, it may be added as a solution prepared by mixing it with additives such as sensitizing dyes, reducing agents and color adjusting agents. The amount of the azolium salt to be added in the present invention is preferably $1\times10^{-6}$ mol or more and 2 mol or less, and more preferably $1\times10^{-3}$ mol or more and 0.5 mol or less.

Mercapto compounds, disulfide compounds and thion compounds may be compounded in the heat-developable photosensitive material of the present invention in order to control developing, for example, to restrain or to promote developing, to improve spectral sensitization efficiency and to improve the preservability before and after developing. Examples threof include compounds described in JP-A No. 10-62899, paragraph nos. 0067 to 0069, compounds represented by the general formula (I) described in JP-A No. 10-186572, including specific examples listed in paragraph nos. 0033 to 0052 and compounds described in European Patent Application Laid-open No. 0803764A1, page 20, lines 36 to 56. Among these compounds, hetero-aromatic compounds substituted with a mercapto groups described in JP-A Nos. 9-297367, 9-304875, 2001-100358, Japanese Patent Application 2001-104213 and 2001-104214 are preferable.

A color adjusting agent is preferably added to the heat-developable photosensitive material of the present invention. The color ajustting agent is described in JP-A No. 10-62899, paragraph nos. 0054 to 0055, European Patent Application Laid-Open No. 0803764A1, page 21, lines 23 to 48, JP-A Nos. 2000-356317 and Japanese Patent Application 2000-187298. Particularly preferable examples thereof include phthalazinones (phthalazinone, phthalazinone derivatives and their metal salts; for example, 4-(1-naphthyl) phthalazinone, 6-chlorophthalazinone, 5,7-dimethoxyphthalazinone and 2,3-dihydro-1,4-phthalazinedione); combinations of phthalazinones and phthalic acids (phthalic acids such as phthalic acid, 4-methylphthalic acid, 4-nitrophthalic acid, diammonium phthalate, sodium phthalate, potassium phthalate and tetrachlorophthalic acid anhydride); phthalazines (phthalazine, phthalazine derivatives and their metal salts; for example, 4-(1-naphthyl)phthalazine, 6-isopropylphthalazine, 6-t-butylphthalazine, 6-chlorophthalazine, 5,7-dimethoxyphthalazine and 2,3-dihydrophthalazine); and combinations of phthalazines and phthalic acids. Among them, a combination of 6-isopropylphthalazine and phthalic acid or 4-methylphthalic acid is preferable.

Plasticizers and lubricants which can be used for the photosensitive layer of the invention are described in JP-A No. 11-65021, paragraph no. 0117. Examples of a super-high tone agent used for the formation of super-high tone images, a method for adding it and its amount include those described in JP-A No. 11-65021, paragraph no. 0118, JP-A No. 11-223898, paragraph nos. 0136 to 0193, compounds represented by the general formulae (H), (I) to (III) and (A) and (B) in JP-A No. 2000-284399, and compounds represented by the formulae (III) to (V) (specific compounds: Compound 21 to Compound 24) in JP-A No. 11-91652. High-tone accelerators are described in JP-A No. 11-65021, paragraph no. 0102 and JP-A No. 11-223898, paragraph nos. 0194 to 0195.

In the case of using formic acid or a formate as a strong fogging agent, the compound is preferably added to the side in which the image forming layer containing a photosensitive silver halide is formed in an amount of 5 mmol or less and preferably 1 mmol or less per one mol of silver.

In the case of using the super-high tone agent in the heat-developable photosensitive material of the present invention, it is preferable that an acid produced by hydrating diphosphorous pentaoxide or it's salt is used in combination with the super-high tone agent. Examples of the acid produced by hydrating diphosphorous pentaoxide and its salt include metaphosphoric acid (salts), pyrophosphoric acid (salts), orthophosphoric acid (salts) triphosphoric acid (salts), tetraphosphoric acid (salts) and hexamethaphosphoric acid (salts). Preferable examples of the acid which are produced by hydrating diphosphorous pentaoxide and its salt include orthophosphoric acid (salts) and hexamethaphosphoric acid (salts). Specific examples of the salt include sodium orthophosphate, dihydrogen sodium orthophosphate, sodium hexametaphosphate and ammonium hexametaphosphate.

The amount (coating amount per 1 $m^2$ of the photosensitive material) of the acid produced by hydrating diphosphorous pentaoxide and its salt can be selected in a proper amount in accordance with the required performances such as sensitivity and fogging. However, preferable amount thereof is preferably 0.1 to 500 $mg/m^2$ and more preferably 0.5 to 100 $mg/m^2$.

The heat-developable photosensitive material of the present invention may be provided with a surface protective layer for the purpose of, for example, preventing unpreferable adhesion to the image forming layer. The surface protective layer may be either a monolayer or a multilayer. The surface protective layers are described in JP-A No. 11-65021, paragraph nos. 0119 to 0120 and Japanese Patent Application No. 2000-171936.

A gelatin is preferable as the binder of the surface protective layer. It is also preferable to use polyvinyl alcohol (PVA) or use a combination of polyvinyl alcohol and gelatin. As the gelatin, an innert gelatin (e.g., NiTTA GELATIN 750), gelatin phthalate (e.g., NiTTA GELATIN 801) or the like may be used. Examples of the PVA include those described in JP-A No. 2000-171936, paragraphs nos. 0009 to 0020. Preferable examples of the PVA include a completely saponified product PVA-105, partially saponified products PVA-205 and PVA-335, a modified polyvinyl alcohol MP-203 (these are trademarks, manufactured by Kuraray Co., Ltd.). In the protective layer, the coating amount (per 1 $m^2$ of the support) of polyvinyl alcohol to be applied (per one layer) is preferably 0.3 to 4.0 $g/m^2$ and more preferably 0.3 to 2.0 $g/m^2$.

In the case where the heat-developable photosensitive material of the invention is used in printing that could have a problem concerning dimensional change, a polymer latex is preferably used in a surface protective layer and a back layer. Such examples of a polymer latex are described in "Synthetic Resin Emulsion", (edited by OKUDA Taira and INAGAKI Hiroshi; issued by the Polymer Publishing Society (1978), "Application of Synthetic Latex", (edited by SUGIMURA Takaaki, KATAOKA Yasuo, SUZUKI Souichi and KASAHARA Keiji; issued by the Polymer Publishing Society (1993), "Chemicals of Synthetic Latex", (written by MUROI Souichi; issued by the Polymer Publishing Society (1970) and the like. Specific examples of the polymer latex include a latex of a methylmethacrylate (33.5 mass %)/ethylacrylate (50 mass %)/methacrylic acid (16.5 mass %) copolymer; latex of methylmethacrylate (47.5 mass %)/butadiene (47.5 mass %)/itaconic acid (5 mass %) copolymer; latex of ethylacrylate/methacrylic acid copolymer; latex of methylmethacrylate (58.9 mass %)/2-ethylhexylacrylate (25.4 mass %)/styrene (8.6 mass %)/2-hydroxyethylmethacrylate (5.1 mass %)/acrylic acid (2.0 mass %) copolymer; and latex of methylmethacrylate (64.0 mass %)/styrene (9.0 mass %)/butylacrylate (20.0 mass %)/2-hydroxyethylmethacrylate (5.0 mass %)/acrylic acid (2.0 mass %) copolymer. Moreover, a combination of polymer latexes described in Japanese Application No. 11-6872, technologies described in Japanese Application No. 11-143058, paragraph nos. 0021 to 0025, technologies described in Japanese Application No. 11-6872, paragraph nos. 0027 to 0028 and technologies described in Japanese Application No. 10-199626, paragraph nos. 0023 to 0041 can be applied for the binder of the surface protective layer. The ratio of the polymer latex in the surface protective layer is preferably 10 mass % or more and 90 mass % or less, and particularly preferably 20 mass % or more and 80 mass % or less based on the entire binders.

The total coating amount (per 1 $m^2$ of the support) of all of the binders (including a water-soluble polymer and latex polymer) applied in the surface protective layer (per one layer) is preferably 0.3 to 5.0 $g/m^2$ and more preferably 0.3 to 2.0 $g/m^2$.

The temperature for the preparation of the image forming layer coating solution is preferably 30° C. or more and 65° C. or less, more preferably 35° C. or more and less than 60° C., and most preferably 35° C. or more and 55° C. or less. Also, the image forming layer coating solution just after the polymer latex is added is preferably kept at a temperature of 30° C. or more and 65° C. or less.

The image forming layer of the invention is constituted of one or more layers on the support. When the image forming layer is constituted of one layer, this layer comprises an organic silver salt, a photosensitive silver halide, a reducing agent and a binder, and as required, additional desirable materials such as a color adjusting agent, a coating adjuvant and other auxiliary agents. When the image forming layer is constituted of two or more layers, it is necessary that the organic silver salt and the photosensitive silver halide are contained in the first image forming layer (usually, a layer adjacent to the support), and several other components are contained in the second image forming layer or in both layers. For the structure of a multicolor photosensitive heat-developable photographic material, the combination of these two layers may be contained for each color, and also, all components may be contained in a single layer as described in U.S. Pat. No. 4,708,928. In the case of a multi dye multicolor photosensitive heat-developable photographic material, each emulsion layer is usually kept isolated from the other by interposing one or more functional or nonfunctional barrier layers between each photosensitive layer as described in U.S. Pat. No. 4,460,681.

In the photosensitive layer of the present invention, various dyes and pigments (e.g., C.I. Pigment Blue 60, C.I. Pigment Blue 64, C.I. Pigment Blue 15:6) may be used in view of improving tone, preventing the generation of interference fringe during exposure to a laser, and preventing irradiation. These dyes and pigments are described in detail in WO98/36322 and in JP-A Nos. 10-268465 and 11-338098.

In the heat-developable photosensitive material of the invention, an antihalation layer may be disposed on the position which is more remote from a light source than the position of the photosensitive layer.

The heat-developable photosensitive material generally has a nonphotonsensitive layer in addition to a photosensitive layer. The nonphotonsensitive layer may be classified into the following layers based on its arrangement: (1) a protective layer disposed on the photosensitive layer (the protective layer is provided on the side of the photosensitive layer which is far from the support), (2) an intermediate layer disposed between plural photosensitive layers and between the photosensitive layer and the support, (3) an undercoat layer disposed between the photosensitive layer and the support and (4) a back layer disposed on the side of the support opposite to the side wherein the photosensitive layer is provided. A filter layer is disposed as the layer of (1) or (2) in the photosensitive material. The antihalation layer is disposed as the layer of (3) or (4) in the photosensitive layer.

There are descriptions concerning the antihalation layer in JP-A No. 11-65021, paragraph nos. 0123 to 0124, JP-A Nos. 11-223898, 9-230531, 10-36695, 10-104779, 11-231457, 11-352625 and 11-352626.

An antihalation dye having absorption in the wavelength of exposure light is contained in the antihalation layer. Because the wavelength of exposure light has a peak between 350 nm and 440 nm in the present invention, a dye that absorbs light in this wavelength range is also preferably contained in the antihalation layer.

In the case of preventing halation by using a dye having absorption in the visible range, it is not preferable that the color of the dye be substantially left after an image is formed. Therefore, it is preferable to use a method for discoloring the color of the dye by the heat of heat developing and it is more preferable to make the nonphotonsensitive layer function as an antihalation layer by adding a thermally discoloring dye and a basic precursor thereto. These technologies are described in JP-A No. 11-231457.

The amount of the discoloring dye to be added is determined based on its use. Generally, the dye is used in such an amount that the optical density (absorbance) measured at an intended wavelength exceeds 0.1. The optical density is preferably 0.15 to 2 and more preferably 0.2 to 1. The amount of the dye to be used for obtaining such an optical density is generally about 0.001 to 1 $g/m^2$.

If the dye is discolored in this manner, the optical density after heat development can be lowered to 0.1 or less. Two or more discoloring dyes may be comprised in combination in thermally discoloring recording materials and heat-developable photosensitive materials. Like the above, two or more base precursors may be used together.

In thermal discoloration using such a discoloring dye and a basic precursor, in addition thereto, it is preferable to use a material (e.g., diphenylsulfone or 4-chlorophenyl (phenyl) sulfone) that lowers the melting point by 3° C. (deg) or more if it is mixed with a base precursor as described in JP-A No. 11-352626, 2-naphthyl benzoate or the like in view of thermally discoloring ability.

In the invention, a colorant having an absorption maximum at 300 to 450 nm may be added for the purpose of improving silver tone and deteriorate with age. There are descriptions concerning such a colorant in JP-A Nos. 62-210458, 63-104046, 63-103235, 63-208846, 63-306436, 63-314535, 01-61745 and 2001-100363.

The colorant is added in an amount of from 0.1 $mg/m^2$ to 1 $g/m^2$. The layer to which the colorant layer is added is preferably the back layer disposed on the side opposite to the photosensitive layer.

The heat-developable photosensitive material of the invention is preferably a single-sided photosensitive material provide with at least one photosensitive layer containing a silver halide emulsion on at least one side of the support and a back layer is disposed on the other side.

In the invention, it is preferable to add a matting agent to improve carrying ability. The matting agent is described in JP-A No. 11-65021, paragraph nos. 0126 to 0127. The amount of the matting agent is preferably 1 to 400 $mg/m^2$ and more preferably 5 to 300 $mg/m^2$ when the amount is indicated by a coating amount per 1 $m^2$ of the photosensitive material.

The shape of the matting agent may be either a defined shape or an undefined shape. However, it is preferably a defined shape and more preferably a spherical shape. Also, the average particle diameter of the matting agent is preferably 0.5 to 10 μm, more preferably 1.0 to 8.0 μm and most preferably 2.0 to 6.0 μm. Further, the coefficient of variation in the distribution of size is preferably 50% or less, more preferably 40% or less and most preferably 30% or less. Here, the coefficient of variation means the value calculated from the following equation: {(standard deviation in particle diameter)/(average of particle diameter)}×100. Also, it is preferable to use two matting agents which have a small coefficient of variation and of which the ratio of the average particle diameters is 3 or more.

Although the degree of matting on the surface of the emulsion may be any as far as no failure such as occurrence of star dust marks takes place, the Beck smoothness of the surface is preferably 30 seconds or more and 2000 seconds or less and particularly preferably 40 seconds or more and 1500 seconds or less. The Beck smoothness can be easily found with reference to Japanese Industrial Standard (JIS) P8119 "Test Method of Smoothness of Paper and Paperboard by Beck tester" and TAPPI Standard Method T479.

With regard to the degree of matting of the back layer of the invention, the Beck smoothness is preferably 1200 seconds or less and 10 seconds or more, more preferably 800 seconds or less and 20 seconds or more and most preferably 500 seconds or less and 40 seconds or more.

In the present invention, the matting agent is preferably contained in the outermost surface layer, a layer that functions as the outermost surface layer or a layer close to the external surface and also preferably contained in a layer working as a so-called protective layer.

The back layer which may be applied to the invention is described in JP-A No. 11-65021, paragraphs No. 0128 to 0130.

The film surface pH of the heat-developable photosensitive material of the invention is preferably 7.0 or less and more preferably 6.6 or less before being heat-developed. There is no particular limitation on the lower limit, but in general it is about 3. The pH is most preferably in a range of from 4 to 6.2.

It is preferable to use an organic acid such as a phthalic acid derivative, a nonvolatile acid such as sulfuric acid or a volatile base such as ammonia in order to control the film surface pH from the viewpoint of lowering pH of the film surface. Particularly, ammonia is easily vaporized so that it can be removed before a coating process and heat development. Therefore, a low film surface pH is preferable.

Also, a combination of a nonvolatile base such as sodium hydroxide, potassium hydroxide or lithium hydroxide and ammonia is preferably used. A method of measuring the film surface pH is described in Japanese Patent Application No. 11-87297, paragraph no. 0123.

A hardener can be used in a layer such as the photosensitive layer, the protective layer and the back layer. Examples of the hardener are described in T. H. James "THE THEORY OF THE PHOTOGRAPHIC PROCESS FOURTH EDITION" (Macmillian Publishing Co., Inc, 1977), pp. 77, to 87. Examples of the hardener include chrome arum, 2-4-dichloro-6-hydroxy-s-triazine sodium salt, N,N-ethylenebis(vinylsulfonacetamide) and N,N-propylenebis(vinylsulfonacetamide). Other than the above, polyvalent metal ions described in the same document, pp. 78 and the like, polyisocyanates described in U.S. Pat. No. 4,281,060 and JP-A No. 6-208193, epoxy compounds described in U.S. Pat. No. 4,791,042 and vinylsulfone type compounds described in JP-A No. 62-89048 are preferably used.

The hardener is added in a solution state and this solution is added to a protective layer coating solution at any time between 180 minutes before and just before a coating operation and preferably between 60 minutes before and 10 seconds before a coating operation. However, no particular limitation is imposed on mixing methods and mixing conditions as far as the effect of the invention is sufficiently produced. As a specific mixing method, there are a method in which the hardener is mixed in a tank in which the average residence time calculated from the flow rate of the hardener to be added and the rate of a solution fed to a coater is set to a desired time and a method using a static mixer as described in N. Harnby, M. F. Edwards, A. W. Nienow, translated by TAKAHASHI Koji "Liquid Mixing Technologies" (published by The Nikkan Kogyo Shinbun, Ltd. 1989), Chapter 8.

The materials which may be applied to the invention are described in JP-A No. 11-65021 such that paragraph no. 0132 concerning a surfactant, paragraph no. 0133 concerning a solvent, paragraph no. 0134 concerning a support, paragraph no. 0135 concerning an antistatic or conductive layer and paragraph no. 0136 concerning a method for obtaining a color image. Further, a lubricant is described in paragraph nos. 0061 to 0064 of JP-A No. 11-84573 and in paragraph nos. 0049 to 0062 of JP-A No. 11-106881.

In the invention, it is preferable to dispose a conductive layer containing a metal oxide. As the conductive materials of the conductive layer, metal oxides which is increased in conductivity by introducing oxygen defects and dissimilar metal atoms therein are preferably used.

As examples of the metal oxide, $ZnO_2$, $TiO_2$ and $SnO_2$ are preferable. Al, In are preferably added in addition to $ZnO_2$, Sb, Nb, P, halogen atoms and the like are preferably added in addition to $SnO_2$ and Nb, Ta and the like are preferably in addition to $TiO_2$. Particularly the conductive layer comprising $SnO_2$ and Sb is preferable.

The amount of the dissimilar atom is preferably in a range of from 0.01 to 30 mol % and more preferably from 0.1 to 10 mol %. Although the shape of the metal oxide may be any of a sphaerical from, needle form and plate form. However, needle particles (grains) having a ratio of a major axis to minor axis (major axis/minor axis) of 2.0 or more and preferably 3.0 to 50 are preferable.

The amount of the metal oxide to be used is in a range of from 1 mg/m$^2$ to 1000 mg/m$^2$, more preferably 10 mg/m$^2$ to 500 mg/m$^2$ and most preferably 20 mg/m$^2$ to 200 mg/m$^2$. The conductive layer of the invention may be disposed on any of both sides of the emulsion layer and both sides of the back layer. However, the conductive layer is preferably disposed between the support and the back layer. Specific examples of the conductive layer according to the invention are described in JP-A Nos. 7-295146 and 11-223901.

In the invention, it is preferable to use a fluorine containing surfactant. Specific examples of the fluorine containing surfactant include compounds described in JP-A Nos. 10-197985, 2000-19680 and 2000-214554. Also, high molecular fluorine-containing surfactants as described in JP-A No. 9-281686 are preferably used. In the invention, the use of fluorine-containing surfactants as described in Japanese Patent Application No. 2000-206560 is particularly preferable.

As a transparent support, polyester, particularly polyethylene terephthalate, which is processed by being heated at a temperature ranging of from 130 to 185° C. is preferably used, since an internal strain remaining in the film support caused during biaxial stretching and a thermal shrinkage strain caused during heat development are eliminated. In the case of heat developing photosensitive materials for medical uses, the transparent support may be colored using a blue dye (e.g., the dye-1 described in the Examples of JP-A No. 8-240877) or non-colored.

It is preferable for the present invention to apply technologies for the undercoating of, for example, water-soluble polyesters described in JP-A No. 11-84574, styrene butadiene copolymers described in JP-A No. 10-186565 and vinylidene chloride copolymers described in JP-A No. 2000-39684 and Japanese Patent Application No. 11-106881, paragraph no. 0063 to no. 0080. Also, technologies as described in JP-A Nos. 56-143430, 56-143431, 58-62646, 56-120519, 11-84573, paragraph no. 0040 to no. 0051, U.S. Pat. No. 5,575,957 and JP-A No. 11-223898, paragraph no. 0078 to no. 0084 may be applied to an antistatic layer or undercoating of the present invention.

The heat-developable photosensitive material is preferably a monosheet type (a type enabling the formation of an image, which is formed on the heat-developable photosensitive material without using other sheets such as an image receptor material).

An antioxidant, stabilizer, plasticizer, ultraviolet absorber and coating adjuvant may be further added to the heat-developable photosensitive material. Such additives are added to either the photosensitive layer or nonphotonsensitive layer. WO98/36322, EP803764A1, JP-A Nos. 10-186567, 10-18568 and the like may serve as references for these additives.

In the invention, the heat-developable photosensitive material may be formed by any application method. Specific examples thereof include various coating operations such as extrusion coating, slide coating, curtain coating, dip coating, knife coating, flow coating and extrusion coating using a hopper of a type as those described in U.S. Pat. No. 2,681,294. Extrusion coating as described in Stephen F. Kistler, Petert M. Schweizer "LIQUID FILM COATING" (published by CHAPMAN & HALL, 1977), pp. 399 to 536 and slide coating are preferably used and slide coating is particularly preferable. Examples of the shape of a slide coater used for slide coating are described in FIG. 11*b*.1 on page 427 in the above document. Also, as desired, two or more layers can be formed at the same time by coating method described in the same document, pp 399 to 536, or methods described in U.S. Pat. No. 2,761,791 and U.K. Patent No. 837,095.

In the invention, the organic silver salt-containing layer coating solution is preferably so-called thixotropic fluid. JP-A No. 11-52509 may serve as a reference for the technologies concerned the thixotropic fluid. The viscosity of the organic silver salt-containing layer coating solution at a shear rate of 0.1 $S^{-1}$ is preferably 400 mPa·s or more and 100,000 mPa·s or less and more preferably 500 mPa·s or more and 20,000 mPa·s or less. Also, the viscosity at a shear rate of 1000 $S^{-1}$ is preferably 1 mPa·s or more and 200 mPa·s or less and more preferably 5 mPa·s or more and 80 mPa·s or less.

Examples of technologies which may be used for the heat-developable photosensitive material of the invention include those described in EP803764A1, EP883022A1, WO98/36322, JP-A Nos. 56-62648, 58-62644, 9-43766, 9-281637, 9-297367, 9-304869, 9-311405, 9-329865, 10-10669, 10-62899, 10-69023, 10-186568, 10-90823, 10-171063, 10-186565, 10-186567, each publication of JP-A Nos. 10-186569 to 10-186572, 10-197974, 10-197982, 10-197983, each publication of JP-A Nos. 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, each publication of JP-A Nos. 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420 and Japanese Patent applications Nos. 2000-187298, 2000-10229, 2000-47345, 2000-206642, 2000-98530, 2000-98531, 2000-112059, 2000-112060, 2000-112104, 2000-112064 and 2000-171936.

The heat-developable photosensitive material of the invention is preferably packaged with a packaging material having low oxygen permeability and moisture permeability to suppress variations in photographic characteristics during storage as a low material or to reduce curling and winding tendencies.

The oxygen permeability is preferably 50 ml/atm·m$^2$·day or less, more preferably 10 ml/atm·m$^2$·day or less and most preferably 1.0 ml/atm·m$^2$·day or less. The moisture permeability is preferably 10 g/atm·m$^2$·day or less, more preferably 5 g/atm·m$^2$·day or less and still more preferably 1 g/atm m$^2$·day.

Specific examples of the aforementioned packaging material having low oxygen permeability and low moisture permeability include packaging materials described in JP-A Nos. 8-254793 and 2000-206653.

Although the heat-developable photosensitive material of the invention may be developed using any method, it is usually developed by raising the temperature of the heat-developable photosensitive material exposed imagewise. The developing temperature is preferably 80 to 250° C., more preferably 100 to 140° C., still more preferably 100 to 120° C. and most preferably 105 to 115° C. (maximum temperature). The developing time is preferably 1 to 60 seconds, more preferably 3 to 30 seconds, still more preferably 5 to 25 seconds and most preferably 7 to 15 seconds.

As a heat developing system, a plate heater system is preferable. As a heat developing system using the plate heater system, a method described in JP-A No. 11-133572 is preferably used. This system is a heat developing apparatus in which a heat-developable photosensitive material, on which a latent image is formed, is brought into contact with heating means in a heat developing section to obtain a visible image. The heating means comprises a plate heater and plural pressure rollers, which are arranged opposite to each other and along one side of the plate heater. The heat-developable photosensitive material is made to pass between the pressure rollers and the plate heater to carry out heat development. It is desirable that the plate heater is divided into 2 to 6 stages. That is, the heat-developable photosensitive material is preferably into contact with two to six plate-like heaters in a heat-development section, while the heat-developable photosensitive material is conveyed. Further, the temperature of the top section heater is preferably lowered about 1 to 10° C. An example is given such that a set of 4 plate heaters, which can be independently controlled, are used and these are respectively controlled such that each temperature thereof is 112° C., 119° C., 121° C. and 120° C. Such a method is also described in JP-A No. 54-30032. In this method, water and organic solvents contained in the heat-developable photosensitive material can be excluded externally from the system and also, a change in the shape of the support of the heat-developable photosensitive material as the result of rapid heating of the heat-developable photosensitive material can be suppressed.

It is preferable to expose the heat-developable photosensitive material of the invention to light, which has high illuminance as 1 mW/mm$^2$ or more, in a short time. The exposure to light having such a high illuminance renders it possible to obtain sufficient sensitivity in the case of the heat-developable material containing the silver halide emulsion having high iodine content and the nonphotonsensitive organic silver salt in the invention. Namely, it is possible to obtain higher sensitivity in the aforementioned high-illuminance exposure than those in low-illuminance exposure. The above illuminance is more preferably 2 mw/mm$^2$ or more and 50 mW/mm$^2$ or less and most preferably 10 mW/mm$^2$ or more and 50 mW/mm$^2$ or less.

The light source used for the above exposure may be any light. However, it is preferably laser light. As the laser light in the invention, a gas laser ($Ar^+$, Kr), YAG laser, dye laser, semiconductor laser or the like is preferable. Also, a laser and a second higher harmonic generating element may be used. Gas lasers and semiconductor lasers emitting infrared to near-infrared light are preferable. Also, semiconductor lasers emitting blue to violet lights are also preferable. As the high-output semiconductor laser emitting blue-violet light, an LHV3000E semiconductor laser manufactured by Nichia Kagaku may be exemplified.

As a medical laser imager provided with an exposure section and a heat developing section, Fuji Medical Dry Laser Imager FM-DP L may be exemplified.

There are descriptions concerning FM-DP L in Fuji Medical Review No. 8, pp39–55. It is needless to say that these technologies can be applied for a laser imager, which uses the heat-developable photosensitive material of the invention. These technologies also allow the heat-developable photosensitive material of the invention to be applied to material for a laser imager in the "AD network" proposed by Fuji Medical System as a network system adapted to the DICOM standard.

The heat-developable photosensitive material of the invention forms a monochrome image of a silver image and it can be preferably used as heat-developable photosensitive materials for medical diagnosis, heat-developable photosensitive materials for industrial photographs, heat-developable photosensitive materials for printing and heat-developable photosensitive materials for COM.

EXAMPLES

The present invention will be explained in detail with examples. However, the invention is not intended to be limited to the examples.

Example 1

(Production of a PET Support)

Using terephthalic acid and ethylene glycol, PET having an intrinsic viscosity IV=0.66 (measured in phenol/tetrachloroethane=6/4 (mass ratio) at 25° C.) was produced according to a usual method. The obtained PET was made into a pellet, and then dried at 130° C. for 4 hours. The resulting pellet was melted at 300° C. and then extruded from a T-type die, followed by cooling rapidly to produce a non-stretched film with such a thickness that the film thickness after fixed under heating was 175 μm.

This film was longitudinally stretched 3.3 times by using rolls which have different peripheral speed and then laterally stretched 4.5 times by using a tenter. The temperatures at these stretchings were 110° C. and 130° C. respectively. Thereafter, the film was thermally fixed at 240° C. for 20 seconds and then relaxed by 4% in a lateral direction. Then, the chuck part of the tenter was slit, both ends were subjected to knurling processing and wound under a pressure of 4 kg/cm$^2$ to obtain a roll 175 μm in thickness.

(Surface Corona Treatment)

Both surfaces of the support were treated at a rate of 20 m/min. At room temperature using a Solid State Corona processing machine 6KVA model manufactured by Pillar Corporation. It was found from the readings of current and voltage at this time that the support had been treated at 0.375 kV·A·min./m$^2$. At this time, the process frequency was 9.6 kHz and the gap clearance between the electrode and the dielectric roll was 1.6 mm.

(Production of an Undercoated Support)

| (1) Preparation of an undercoat layer coating solution | |
|---|---|
| Composition (1) (for undercoat layer which is the side of photosensitive layer) | |
| Pesresin A-520 (30 mass % solution) manufactured by Takamatsu Yushi Corporation | 59 g |
| Polyethylene glycol monononylphenyl ether (average ethylene oxide number = 8.5) 10 mass % solution | 5.4 g |
| MP-1000 manufactured by Soken Chemical & Engineering Co., Ltd. (polymer fine particle, average particle diameter: 0.4 μm) | 0.91 g |
| Distilled water | 935 ml |
| Composition (2) (for first back layer) | |
| Styrene-butadiene copolymer latex (solid content: 40 mass %, styrene/butadiene = 68/32 (mass ratio)) | 158 g |
| 2,4-dichloro-6-hydroxy-S-triazine sodium salt, 8 mass % aqueous solution | 20 g |
| Sodium laurylbenzenesulfonate, 1 mass % aqueous solution | 10 ml |
| Distilled water | 854 ml |
| Comosition (3) (for second back layer) | |
| $SnO_2$/SbO (mass ratio: 1/9, average particle diameter: 0.038 μm, 17 mass % dispersion) | 84 g |
| Gelatin (10 mass % aqueous solution) | 89.2 g |

-continued

| (1) Preparation of an undercoat layer coating solution | |
|---|---|
| Methorose TC-5 (2 mass % aqueous solution) manufactured by Shin-Etsu Chemical Co., Ltd. | 8.6 g |
| MP-1000, manufactured by Soken Chemical & Engineering Co., Ltd. | 0.01 g |
| Sodium dodecylbenzenesulfonate, 1 mass % aqueous solution | 10 ml |
| NaOH (1 mass %) | 6 ml |
| Proxel (manufactured by ICI Corporation) | 1 ml |
| Distilled water | 805 ml |

Both surfaces of the aforementioned biaxially oriented polyethylene terephthalate support having 175 μm thickness were processed by the foregoing corona discharge treatment. Then, one surface (surface for a photosensitive layer) was coated with the undercoat coating solution of the above composition (1) using a wire bar such that the wet coating amount was 6.6 ml/m$^2$ (per one surface), followed by drying at 180° C. for 5 minutes. Then, the backside (back surface) of the support was coated with the undercoat coating solution of the foregoing formulation (2) using a wire bar such that the wet coating amount was 5.7 ml/m$^2$, followed by drying at 180° C. for 5 minutes. Moreover, the backside (back surface) was coated with the undercoat coating solution of the foregoing formulation (3) by using a wire bar such that the wet coating amount was 7.7 ml/m$^2$, followed by drying at 180° C. for 6 minutes. In this way, an undercoated support was obtained.

(Preparation of a Coating Solution for Back Layer)

(Preparation of a Dispersion (a) of Base Precursor Solid Fine Particles)

64 g of a base precursor compound-1, 28 g of diphenylsulfone and 10 g of a surfactant Demol N manufactured by Kao Corporation were mixed with 220 ml of distilled water. The mixed solution was dispersed using a sand mill (¼ Gallon sand grinder mill, manufactured by I.mecs Corporation) by means of beads to obtain a dispersion (a) of base precursor compound solid fine particles having an average particle diameter of 0.2 μm.

(Preparation of a Dispersion of Dye Solid Fine Particles)

9.6 g of a cyanine dye compound-1 and 5.8 g of sodium p-dodecylbenzenesulfonate were mixed with 305 ml of distilled water and the mixture was dispersed using a sand mill (¼ Gallon sand grinder mill, manufactured by I.mecs) by means of beads to obtain a dispersion (a) of dye solid fine particles having an average particle diameter of 0.2 μm.

(Preparation of an Antihalation Layer Coating Solution)

17 g of a gelatin, 9.6 g of polyacrylamide, 56 g of the foregoing dispersion (a) of base precursor solid fine particles, 50 g of the above dye solid fine particle dispersion, 1.5 g of monodispersion polymethylmethacrylate fine particles (average particle size: 8 μm and standard deviation of particle diameter: 0.4), 0.03 g of benzoisothiazolinone, 2.2 g of sodium polyethylenesulfonate, 0.1 g of a blue dye compound-1, 0.1 g of a yellow dye compound-1 and 844 ml of water were mixed with each other to prepare an antihalation layer coating solution.

(Preparation of a Backside Protective Layer Coating Solution)

In a container kept at 40° C., 50 g of a gelatin, 0.2 g of sodium polystyrenesulfonate, 2.4 g of N,N-ethylenebis(vinylsulfonacetamide), 1 g of sodium t-octylphenoxyethoxyethanesulfonate, 30 mg of benzoisothiazolinone, 37 mg of a fluorine containing surfactant (F-1: potassium N-perfluorooctylsulfonyl-N-propylalanate), 150 mg of a fluorine containing surfactant (F-2: polyethylene glycol mono(N-perfluorooctylsulfonyl-N-propyl-2-aminoethyl) ether [average polymerization degree of ethylene oxide: 15]), 64 mg of a fluorine-containing surfactant (F-3), 32 mg of a fluorine containing surfactant (F-4), 8.8 g of an acrylic acid/ethylacrylate copolymer (mass ratio of copolymer: 5/95), 0.6 g of Aerosol OT (manufactured by American Cyanamide Company), 1.8 g of a liquid paraffin emulsion as liquid paraffin and 950 ml of water were mixed to make a backside protective layer coating solution.

(Preparation of a Silver Halide Emulsion)

<<Preparation of a Silver Halide Emulsion 1>>

3.1 ml of a 1 mass % potassium bromide solution was added to 1421 ml of distilled water, to which were then added 3.5 ml of sulfuric acid having a concentration of 0.5 mol/L and 36.7 g of gelatin phthalate. To the obtained solution which was kept at a solution temperature of 35° C. with stirring in a stainless reacting pot, 195.6 ml of a solution A prepared by diluting 22.22 g of silver nitrate with distilled water and 218 ml of a solution B prepared by diluting 13.7 g of potassium bromide and 2.6 g of potassium iodide with distilled water were wholly added at a constant flow rate over 9 minutes. After that, 10 ml of an aqueous solution of 3.5 mass % hydrogen peroxide was added and further 10.8 ml of an aqueous solution of 10 mass % benzoimidazole was added to the resulting mixture.

Moreover, 317.5 ml of a solution C prepared by diluting 51.86 g of silver nitrate with distilled water and 600 ml of a solution D prepared by diluting 31.9 g of potassium bromide and 6.1 g of potassium iodide with distilled water were added to the foregoing mixture such that the solution C was wholly added at a constant flow rate over 120 minutes and the solution D was added by a controlled double jet method with keeping the solution at pAg 8.1. hexachloroiridium (III) acid potassium salt was all added in such an amount of $1\times10^{-4}$ mol per 1 mol of silver 10 minutes after the start of the addition of the solutions C and D. Also, an aqueous solution of potassium iron (II) hexacyanide was all added in an amount $3\times10^{-4}$ mol per 1 mol of silver 5 seconds after the addition of the solution C was finished. The solution was adjusted to pH 3.8 using sulfuric acid having a concentration of 0.5 mol/L. Then, the stirring was stopped and the solution was subjected to sedimentation/desalting/water-washing steps. The resulting solution was adjusted to pH 5.9 using sodium hydroxide having a concentration of 1 mol/L to produce a silver halide dispersion having a pAg of 8.0.

5 ml of a methanol solution of 0.34 mass % 1,2-benzoisothiazolin-3-one is added to the foregoing silver halide dispersion with stirring and keeping the dispersion at 38° C. After 40 minutes, a methanol solution containing a spectral sensitizing dye A and a sensitizing dye B in a molar ratio of 1:1 was added to the solution in an amount of $1.2\times10^{-3}$ mol as the total amount of the sensitizing dyes A and B per 1 mol of silver. After one minute, the obtained solution was raised to 47° C. Sodium benzenethiosulfonate in the form of a methanol solution was added in an amount of $7.6\times10^{-5}$ mol per 1 mol of silver 20 minutes after the temperature was raised and, further, after 5 minutes, a tellurium sensitizer C in the form of a methanol solution was added in an amount of $2.9\times10^{-4}$ mol per 1 mol of silver, followed by ripening for 91 minutes. To the ripened solution were added 1.3 ml of a metanol solution containing 0.8 mass % of N,N'-dihydroxy-N"-diethylmelamine and, further after 4 minutes, 5-methyl- 2-mercaptobenzoimidazole in the form of a methanol solution in an amount of $4.8\times10^{-3}$ mol per 1 mol of silver, 1-phenyl-2-heptyl-5-mercapto-1,3,4-triazole in the form of a methanol solution in an amount of $5.4\times10^{-3}$ mol per 1 mol of silver and a mercapto compound-2 in the form of an aqueous solution in an amount of $1.5\times10^{-2}$ mol per 1 mol of silver, to prepare a silver halide emulsion 1.

The particles (grains) in the prepared silver halide emulsion were a silver bromoiodide particle having an average sphere equivalent diameter of 0.040 μm with the coefficient of variation of sphere equivalent diameter being 18% and containing 12 mol % of iodine uniformly. The particle diameter and the like were found from an average of 1000 particles using an electron microscope.

<<Preparation of a Mixed Emulsion A for a Coating Solution>>

The silver halide emulsion 1 was dissolved and benzothiazolium iodide in the form of a 1 mass % aqueous solution was added to the emulsion in an amount of $7\times10^{-3}$ mol per 1 mol of silver. Further, water was added such that the content of the silver halide was 38.2 g as silver per 1 kg of the mixed emulsion for a coating solution.

<<Preparation of a Fatty Acid Silver Dispersion>>

87.6 Kg of behenic acid (tradename: Edenor C22-85R) manufactured by Henkel, 423 L of distilled water, 49.2 L of an aqueous NaOH solution having a concentration of 5 mol/L and 120 L of t-butyl alcohol were mixed and the mixture was stirred at 75° C. for one hour to react, thereby obtaining a sodium behenate solution. Separately, 206.2 L (pH 4.0) of an aqueous solution containing 40.4 kg of silver nitrate was prepared and kept at 10° C. A reactor containing 635 L of distilled water and 30 L of t-butyl alcohol and kept at 30° C. was charged with all the foregoing sodium behenate solution and all the foregoing aqueous silver nitrate solution at constant flow rates respectively over 93 minutes and 15 seconds and 90 minutes.

At this time, the operation was carried out as follows. At first, only the aqueous silver nitrate solution had been added for 11 minutes after the start of the addition thereof, and then the addition of the sodium behenate solution was also started, and after the addition of the aqueous silver nitrate solution was finished, only the sodium behenate solution had been added for 14 minutes and 15 seconds. At this time, the temperature in the reactor was set to 30° C. and it was controlled from the outside such that the solution temperature was kept constant. Also, the pipe in a system for adding the sodium behenate solution was kept at a constant temperature by circulating hot water through the outside of a double pipe. The hot water was controlled such that the solution temperature of the sodium behenate solution at an outlet, which was provided at the end of the addition nozzle of the system, was 75° C. Also, the pipe in a system for adding the aqueous silver nitrate solution was kept at a constant temperature by circulating cool water through the outside of a double pipe. The position where the sodium behenate solution was added and the position where the aqueous silver nitrate solution was added were arranged symmetrically based on a stirring shaft. Further, those positions were adjusted to such heights that each outlet nozzle was not in contact with the reaction solution.

After the addition of the sodium behenate solution was finished, the reaction solution was allowed to stand at the same temperature for 20 minutes under stirring, then raised to 35° C. over 30 minutes, and followed by ripening for 210 minutes. A solid obtained therefrom was separated by centrifugal filtration immediately after the ripening was finished. The solid was washed with water until the conductivity of the filtered water became 30 μS/cm. Thus, a fatty acid silver salt was obtained. The resulting solid was not dried and stored in the form of wet cake.

The form of the resulting silver behenate particle (grain) was evaluated by photographing using an electron microscope to find that the particle was a scale-like crystal having the following characteristics: a=0.14 μm, b=0.4 μm and c=0.6 μm (in average), average aspect ratio: 5.2, average sphere equivalent diameter: 0.52 μm and coefficient of variation in the sphere equivalent diameter: 15% (a, b and c are those defined in this specification).

19.3 Kg of polyvinyl alcohol (tradename: PVA-217) and water were added to the wet cake in an amount equivalent to 260 Kg of a dry solid such that the total amount was 1000 Kg. Then, the mixture was made into a slurry using a dissolver blade and then the slurry was further pre-dispersed using a pipeline mixer (PM-10 type, manufactured by Mizuho Industries Corporation).

Next, the pre-dispersed raw solution was treated three times using a dispersing machine (tradename: Microfluidizer M-610, manufactured by Microfluidex International Corporation, a Z-type interaction chamber) wherein the pressure was adjusted to 1260 kg/cm$^2$ to obtain a silver behenate dispersion. As to the cooling operation, a coiled heat exchanger was installed in each of front and back sides of the interaction chamber and the temperature of the cooling medium was controlled to thereby set the dispersion temperature to 18° C.

(Preparation of a Reducing Agent Dispersion)

<<Preparation of a Reducing Agent (Exemplified Compound 7-6) Dispersion>>

10 Kg of water was added to 10 Kg of a reducing agent (exemplified compound 7-6: 6,6'-di-t-butyl-4,4'-dimethyl-2,2'-butylidenediphenol) and 16 Kg of an 10 mass % aqueous solution of modified polyvinyl alcohol (Poval MP203, manufactured by Kuraray Co., Ltd.) and these components were thoroughly mixed to make a slurry.

This slurry was fed by a diaphragm pump and dispersed using a horizontal sandmill (UVM-2: manufactured by I.mecs) filled with zirconia beads having an average diameter of 0.5 mm for 3.5 hours. 0.2 g of benzoisothiazolinone sodium salt and water were added such that the concentration of the reducing agent was adjusted to 25 mass % to obtain a reducing agent dispersion.

The reducing agent particle contained in the reducing agent dispersion obtained in this manner had a median diameter of 0.40 μm and a maximum particle diameter of 1.5 μm or less. The resulting reducing agent dispersion was subjected to filtration using a polypropylene filter having a hole diameter of 3.0 μm to remove foreign substances such as dust and then put away.

<<Preparation of a Hydrogen-Bondable Compound-1 Dispersion>>

10 Kg of water was added to 10 Kg of a hydrogen-bondable compound-1 (tri(4-t-butylphenyl)phosphine oxide) and 16 Kg of an 10 mass % aqueous solution containing modified polyvinyl alcohol (Poval MP203 manufactured by Kuraray Co., Ltd.). The mixture was thoroughly mixed to make a slurry. This slurry was fed by a diaphragm pump and dispersed using a horizontal sand mill (UVM-2: manufactured by I.mecs) filled with zirconia beads having an average diameter of 0.5 mm for 3.5 hours. 0.2 g of benzoisothiazolinone sodium salt and water were added thereto such that the concentration of the reducing agent was adjusted to 25 mass % to obtain a hydrogen-bondable compound-1 dispersion.

The reducing agent particle contained in the reducing agent dispersion obtained in this manner had a median diameter of 0.35 μm and a maximum particle diameter of 1.5 μm or less. The resulting hydrogen-bondable dispersion was subjected to filtration using a polypropylene filter having a hole diameter of 3.0 μm to remove foreign substances such as dusts and then put away.

<<Preparation of a Developing Accelerator Dispersion>>

10 Kg of water was added to 10 Kg of a developing accelerator (developing accelerator of the present invention: the exemplified compound 1-68) and 20 Kg of a 10 mass % aqueous solution containing modified polyvinyl alcohol (Poval MP203 manufactured by Kuraray Co., Ltd.). The mixture was thoroughly mixed to make a slurry.

This slurry was fed by a diaphragm pump and dispersed using a horizontal sandmill (UVM-2: manufactured by I.mecs) filled with zirconia beads having an average diameter of 0.5 mm for 3.5 hours. 0.2 g of benzoisothiazolinone sodium salt and water were added thereto such that the concentration of the reducing agent was adjusted to 20 mass % to obtain a developing accelerator-1 dispersion. The reducing agent particle contained in the reducing agent dispersion obtained in this manner had a median diameter of 0.48 μm and a maximum particle diameter of 1.4 μm or less. The resulting reducing agent dispersion was subjected to filtration using a polypropylene filter having a hole diameter of 3.0 μm to remove foreign substances such as dusts and then put away.

Each solid dispersion of the developing accelerator and tone control agent-1 shown in table 14 was dispersed in the same method as in the case of the developing accelerator (exemplified compound I-68) to obtain a 20 mass % dispersion.

(Preparation of a Polyhalogen Compound)

<<Preparation of an Organic Polyhalogen Compound-1 Dispersion>>

10 Kg of an organic polyhalogen compound-1 (tribromomethanesulfonylbenzene), 10 Kg of a 20 mass % aqueous solution of modified polyvinyl alcohol (Poval MP203 manufactured by Kuraray Co., Ltd.), 0.4 Kg of a 20 mass % aqueous solution of sodium triisopropylnaphthalenesulfonate and 14 Kg of water were mixed and the mixture was thoroughly mixed to make a slurry.

This slurry was fed by a diaphragm pump and dispersed using a horizontal sandmill (UVM-2: manufactured by I.mecs) filled with zirconia beads having an average diameter of 0.5 mm for 5 hours. 0.2 g of benzoisothiazolinone sodium salt and water were added thereto such that the concentration of the organic polyhalogen compound was adjusted to 26 mass % to obtain an organic polyhalogen compound-1 dispersion.

The organic polyhalogen compound particle contained in the polyhalogen compound dispersion obtained in this manner had a median diameter of 0.41 μm and a maximum particle diameter of 2.0 μm or less. The resulting organic polyhalogen compound dispersion was subjected to filtration using a polypropylene filter having a hole diameter of 10.0 μm to remove foreign substances such as dust and then put away.

<<Preparation of an Organic Polyhalogen Compound-2 Dispersion>>

10 Kg of an organic polyhalogen compound-2 (N-butyl-3-tribromomethanesulfonylbenzoamide), 20 Kg of an 10 mass % aqueous solution of modified polyvinyl alcohol (Poval MP203 manufactured by Kuraray Co., Ltd.) and 0.4 Kg of an 20 mass % aqueous solution of sodium triisopropylnaphthalenesulfonate were mixed and the mixture was thoroughly mixed to make a slurry. This slurry was fed by a diaphragm pump and dispersed using a horizontal sandmill (UVM-2: manufactured by I.mecs Corporation) filled with zirconia beads having an average diameter of 0.5 mm for 5 hours. Then, 0.2 g of benzoisothiazolinone sodium salt and water were added thereto such that the concentration of the organic polyhalogen compound was adjusted to 30 mass % to obtain a dispersion. This dispersion was heated at 40° C. for 5 hours to obtain an organic polyhalogen compound-2 dispersion. The organic polyhalogen compound particle contained in the polyhalogen compound dispersion obtained in this manner had a median diameter of 0.40 μm and a maximum particle diameter of 1.3 μm or less. The resulting organic polyhalogen compound dispersion was subjected to filtration using a polypropylene filter having a hole diameter of 3.0 μm to remove foreign substances such as dust and then put away.

<<Preparation of a Phthalazine Compound-1 Solution>>

8 Kg of modified polyvinyl alcohol MP203 manufactured by Kuraray Co., Ltd. was dissolved in 174.57 Kg of water. Next, 3.15 Kg of an 20 mass % aqueous solution of sodium triisopropylnaphthalenesulfonate solution and 14.28 Kg of an 70 mass % aqueous solution of phthalazine compound-1 (6-isopropylphthalazine) solution were added to the resulting mixture to obtain an 5 mass % aqueous solution of phthalazine compound-1.

(Preparation of a Mercapto Compound)

<<Preparation of an Aqueous Mercapto Compound-1 Solution>>

7 g of a mercapto compound-1 (1-(3-sulfophenyl)-5-mercaptotetrazole sodium salt) was dissolved in 993 g of water to prepare an aqueous 0.7 mass % solution.

<<Preparation of an Aqueous Mercapto Compound-2 Solution>>

20 g of a mercapto compound-2 (1-(3-methylureido)-5-mercaptotetrazole sodium salt) was dissolved in 980 g of water to prepare an aqueous 2.0 mass % solution.

<<Preparation of a Pigment-1 Dispersion>>

250 g of water was added to 64 g of C.I. Pigment Blue 60 and 6.4 g of Demol N manufactured by Kao Corporation and these components were mixed to make a slurry. 800 g of zirconia beads having an average diameter of 0.5 mm was prepared and was placed in a vessel together with the slurry to disperse the slurry using a disperser (¼G sand grinder mill, manufactured by I.mecs) for 25 hours, and thereby a pigment-1 dispersion was obtained. The pigment particle contained in the pigment dispersion obtained in this manner had an average particle diameter of 0.21 μm.

<<Preparation of a SBR Latex Solution>>

A SBR latex having a Tg of 22° C. was prepared in the following manner.

Using ammonium persulfate as a polymerization initiator and an anionic surfactant as an emulsion, 70.0 mass parts of styrene, 27.0 mass parts of butadiene and 3.0 mass parts of acrylic acid were emulsion-polymerized, and followed by aging at 80° C. for 8 hours. Thereafter, the polymer mixture was cooled to 40° C. and adjusted to pH 7.0 using aqueous ammonia. Further, Sundet BL manufactured by Sanyo Chemical Industries, Ltd. was added to the polymer mixture such that the content thereof was 0.22%. Next, the mixture was adjusted to pH 8.3 by adding a 5% aqueous solution of sodium hydroxide and then adjusted to pH 8.4 by adding aqueous ammonia. The molar ratio of a $Na^+$ ion and a $NH_4^+$ ion was 1:2.3. Further, to the solution was added 0.15 ml of a 7% aqueous solution of benzoisothiazolinone sodium salt to prepare a SBR latex solution. (SBR latex: a latex of -St(70.0)-Bu(27.0)-AA(3.0)-) Tg: 22° C., average particle diameter: 0.1 μm, concentration: 43 mass %, equilibrium moisture content at 25° C. and 60% RH: 0.6 mass %, ionic conductivity: 4.2 mS/cm (the ionic conductivity was measured as follows: the ionic conductivity of the raw solution of latex (43 mass %) was measured using a conductivity meter CM-30S manufactured by DKK-TOA Corporation) and pH: 8.4. A SBR latex having a different Tg can be prepared by changing the ratio of styrene/butadiene appropriately and by treating in the same manner.

<<Preparation of an Emulsion Layer (Photosensitive Layer) Coating Solution-1>>

1000 g of the fatty acid silver dispersion obtained above, 276 ml of water, 32.8 g of the pigment-1 dispersion, 3.2 g of the organic polyhalogen compound-1 dispersion, 8.7 g of the organic polyhalogen compound-2 dispersion, 173 g of the phthalazine compound-1 solution, 1082 g of the SBR latex solution (Tg: 22° C.), 155 g of the foregoing reducing agent dispersion, the developing accelerator dispersion shown in Table 14 in an amount (amount per 1 mol of the above reducing agent) shown in Table 14, 55 g of the hydrogen-bondable compound-1,2 g of the tone control agent-1 dispersion and 6 ml of the aqueous mercapto compound-2 solution were compounded in this order. Further, 117 g of the silver halide mixed emulsion A was compounded thereto just before coating. These components were thoroughly mixed to prepare an emulsion layer coating solution. The emulsion layer coating solution was fed to a coating die as it was and was applied.

The viscosity of the aforementioned emulsion layer coating solution was measured using a B-type viscometer manufactured by Tokyo Keiki Corporation and it was found that it was 40 [mPa·s] at 40° C. (No. 1 rotor, 60 rpm).

The viscosities of the coating solution which were measured at 25° C. by using an RFS Fluid Spectrometer manufactured by Reometrix Fareast Corporation were 530, 144, 96, 51 and 28 [mPa·s] at a shear rate of 0.1, 1, 10, 100 and 1000 [1/sec] respectively.

Also, the amount of zirconium in the coating solution was 0.25 mg per 1 g of silver.

<<Preparation of a Coating Solution for an Emulsion Side Intermediate Layer>>

To a mixture of 1000 g of polyvinyl alcohol PVA-205 (manufactured by Kuraray Co., Ltd.), 272 g of a 5 mass % pigment dispersion and 4200 ml of a solution containing 19 mass % latex of methylmethacrylate/styrene/butylacrylate/hydroxyethylme thacrylate/acrylic acid copolymer (copolymer mass ratio: 64/9/20/5/2) was added 27 ml of a 5 mass % aqueous solution of Aerosol OT (manufactured by American Cyanamide Company), 135 ml of a 20 mass % aqueous solution of diammonium phthalate and water in an amount such that the total amount was adjusted to 10000 g. Then, pH of the mixture was adjusted to pH 7.5 by adding NaOH to make an intermediate layer coating solution, and then the intermediate layer coating solution fed to a coating die in such an amount that the coating amount was 9.1 ml/m$^2$.

The viscosity of the coating solution which was measured using a B-type viscometer was 58 [mPa·s] at 40° C. (No. 1 rotor, 60 rpm).

<<Preparation of a Coating Solution for an Emulsion Side First Protective Layer>>

64 g of an inert gelatin was dissolved in water. To the gelatin solution were added 80 g of a solution containing 27.5 mass % of a methylmethacrylate/styrene/butylacrylate/hydroxyethylmethacrylate/acrylic acid copolymer (copolymer ratio: 64/9/20/5/2) latex, 23 ml of a methanol solution containing 10 mass % of phthalic acid, 23 ml of a 10 mass % aqueous solution of 4-methylphthalic acid, 28 ml of sulfuric acid having a concentration of 0.5 mol/L, 5 ml of a 5 mass % aqueous solution of Aerosol OT (manufactured by American Cyanamide Company), 0.5 g of phenoxy ethanol, 0.1 g of benzoisothiazolinone and water in an amount such that the total amount was adjusted to 750 g to prepare a coating solution. 26 ml of 4 mass % chrome alum was mixed with the coating solution by using a static mixer just before coating, and then the solution obtained fed to a coating die such that the coating amount was 18.6 ml/m$^2$.

The viscosity of the coating solution which was measured using a B-type viscometer was 20 [mPa·s] at 40° C. (No. 1 rotor, 60 rpm).

<<Preparation of a Coating Solution for an Emulsion Side Second Protective Layer>>

80 g of an inert gelatin was dissolved in water. To the gelatin solution were added 102 g of a solution containing 27.5 mass % of a methylmethacrylate/styrene/butylacrylate/hydroxyethylmethacrylate/acrylic acid copolymer (copolymer ratio: 64/9/20/5/2) latex, 3.2 ml of a solution comprising 5 mass % of a fluorine containing surfactant (F-1: potassium N-perfluorooctylsulfonyl-N-propylalanate), 32 ml of an aqueous solution comprising 2 mass % of a fluorine containing surfactant (F-2: polyethylene glycol mono(N-perfluorooctylsulfonyl-N-propyl-2-aminoethyl) ether [ethylene oxide average degree of polymerization=15], 3 ml of a solution comprising 5% of a fluorine containing surfactant F-5, 10 ml of a solution comprising 2% of a fluorine containing surfactant F-6, 23 ml of a 5 mass % solution containing of Aerosol OT (manufactured by American Cyanamide Company), 4 g of a polymethylmethacrylate fine particle (average particle diameter: 0.7 μm), 21 g of a polymethylmethacrylate fine particle (average particle diameter: 4.5 μm), 1.6 g of 4-methylphthalic acid, 4.8 g of phthalic acid, 44 ml of sulfuric acid having a concentration of 0.5 mol/L, 10 mg of benzoisothiazolinone and water in an amount such that the total amount was adjusted to 650 g to prepare a coating solution. 445 ml of an aqueous solution containing 4 mass % of chrome alum and 0.67 mass % of phthalic acid were mixed with the coating solution by using a static mixer to prepare a surface protective layer coating solution. The surface protective layer coating solution was then fed to a coating die such that the coating amount was 8.3 ml/m$^2$.

The viscosity of the coating solution which was measured using a B-type viscometer was 19 [mPa·s] at 40° C. (No. 1 rotor, 60 rpm).

<<Preparation of a Heat-developable Photosensitive Material-1>>

The backside of the aforementioned undercoated support was double-coated with the antihalation layer coating solution such that the solid content of a solid fine particle dye to be applied was 0.04 g/m$^2$ and with the backside protective layer coating solution such that the amount of a gelatin to be applied was 1.7 g/m$^2$ at the same time and the applied coating solutions were dried to form a back layer.

The surface opposite to the backside of the support was multiple-coated such that the emulsion layer, intermediate layer, first protective layer and second protective layer were coated in this order on the undercoat layer at the same time by using a slide beads coating system. In this way, a sample of a heat-developable photosensitive material was formed. At this time, the solutions for the emulsion layer and the intermediate layer were adjusted to a temperature of 31° C., that for the first protective layer was adjusted to a temperature of 36° C. and that for the second protective layer was adjusted to a temperature of 37° C.

The amount (g/m$^2$) of each compound to be applied in the emulsion layer is as follows.

| | |
|---|---|
| Silver behenate | 5.55 |
| Pigment (C.I. Pigment Blue 60) | 0.036 |
| Polyhalogen compound-1 | 0.02 |
| Polyhalogen compound-2 | 0.06 |
| Phthalazine compound-1 | 0.19 |
| SBR latex | 9.67 |
| Reducing agent complex 7-6 | 0.81 |
| Hydrogen-bondable compound-1 | 0.30 |
| Developing accelerator | the amount described in Table 14 |
| Tone controlling agent-1 | 0.010 |
| Mercapto compound-1 | 0.002 |
| Mercapto compound-2 | 0.012 |
| Silver halide (as Ag) | 0.091 |

Coating and drying conditions are as follows.

The coating was carried out at a rate of 160 m/min. A gap between the end of a coating die and the support was set to 0.10 to 0.30 mm and the pressure in a pressure reducing chamber was set to a pressure lower than the atmospheric pressure by 196 to 882 Pa. The support was deelectrified by an ionic wind before coating.

In succession, the coating solution was cooled by a wind having a dry bulb temperature of 10 to 20° C. in a chilling zone. Then, the support was carried by a non-contact system and the coating film was dried using a dry air having a dry bulb temperature of 23 to 45° C. and a wet bulb temperature of 15 to 21° C. in a helical non-contact type drier.

After dried, the support was humidified at 25° C. under a humidity of 40 to 60% RH and then, the film surface was heated to 70 to 90° C. After heated, the film surface was cooled down to 25° C.

The degree of matting of the produced heat-developable photosensitive material was 550 seconds in terms of Beck smoothness on the side of the photosensitive layer and 130 seconds on the backside. Also, the pH of the film surface on the side of the photosensitive layer was measured and it was 6.0.

The chemical structures of the compound used in Example 1 of the invention are shown below.

Cyanine dye compound-1

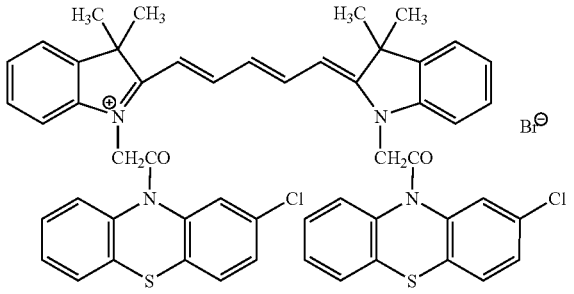

-continued

Blue dye compound-1

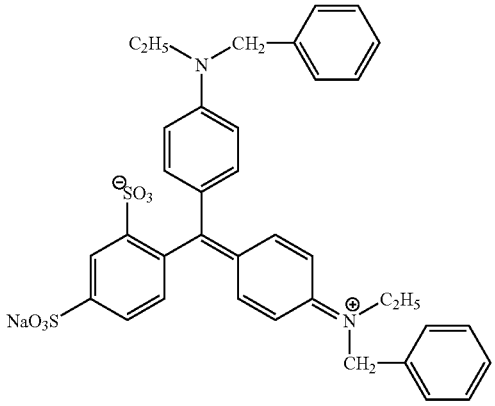

Yellow dye compound-1

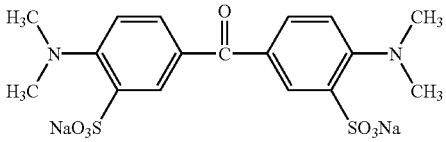

Spectral sensitizing dye A

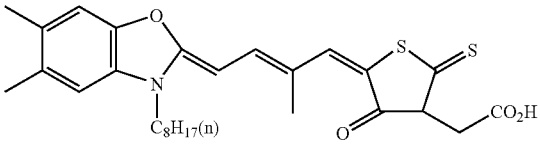

Spectral sensitizing dye B

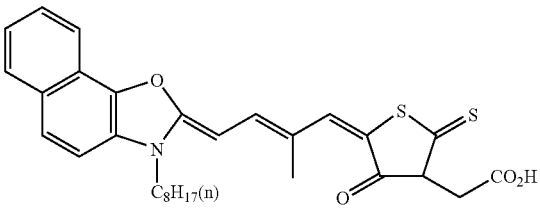

Tellurium sensitizer C

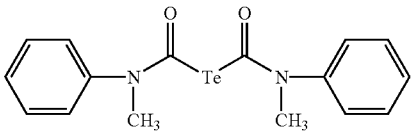

Base precursor compound-1

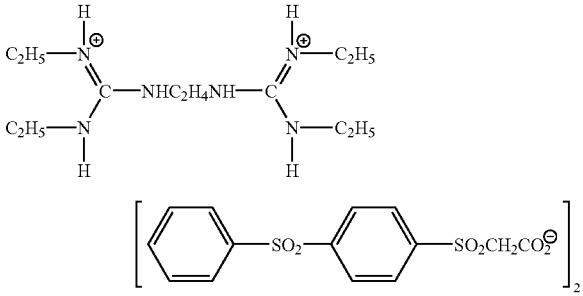

-continued

Hydrogen-bondable compound-1

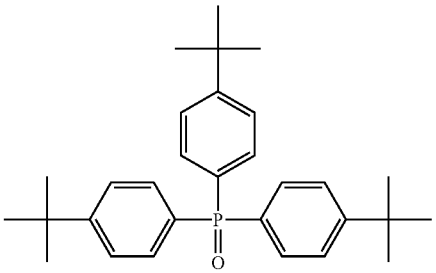

Polyhalogen compound-1

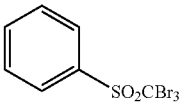

Polyhalogen compound-2

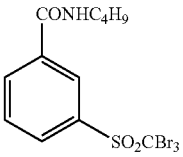

Mercapto compound-1

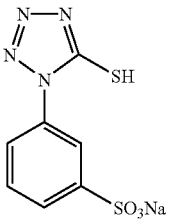

Mercapto compound-2

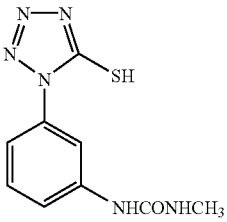

Phthalazine compound-1

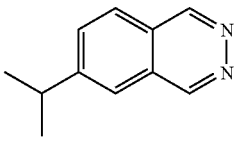

Tone control agent-1

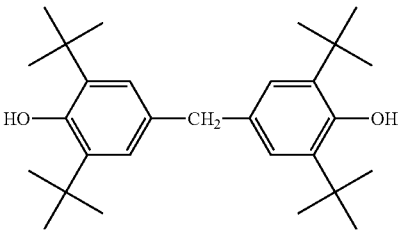

(F-1)

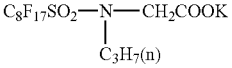

(F-2)

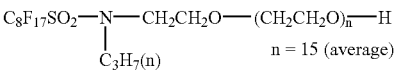

-continued (F-3)

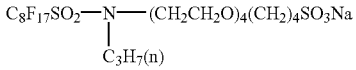

(F-4)

(F-5)

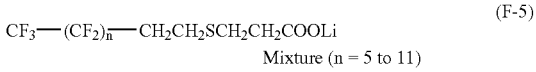

Mixture (n = 5 to 11)

(F-6)

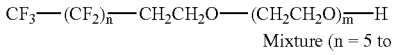

Mixture (n = 5 to 11, m = 5 to 15)

(F-7)

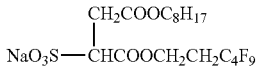

(F-8)

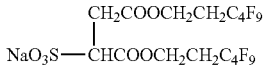

The resulting samples were cut down to a half-cut size, packaged with the following packaging material under an atmosphere of 25° C. and 50% humidity and stored at 20° C. for 2 weeks. Then, the sample was evaluated as follows. Also, in order for the evaluation of preserving ability of the samples as raw materials, samples obtained and packed in the same conditiond as aforementioned above were stored at 35° C. for 2 weeks at the same time.

(Packaging Material)

PET 10 μm/PE 12 μm/aluminum foil 9 μm/Ny 15 μm/polyethylene 50μ containing 3% carbon, oxygen permeability: 0 ml/atm.m$^2$.25° C.day and moisture permeability: 0 g/atm.m$^2$.25° C.day.

<Production of Heat-developable Photosensitive Materials 2 to 13>

Uniform silver halide emulsions 2 and 3 described in Table 14 were produced in the same manner as in the production of the silver halide emulsion-1 except that the halogen composition to be added was altered. As to the particle size of the silver halide, a silver halide having an average sphere equivalent diameter of 0.040 μm was produced by changing the temperature during the formation of particles.

Heat-developable photosensitive materials 2 to 13 were produced using the silver halide emulsions-1, -2 and -3 in the same manner as in the production of the heat-developable photosensitive material-1 except that the developing accelerator and its coating amount were altered as described in Table 14.

<Evaluation of the Heat-developable Photosensitive Materials>

The sample was exposed and heat-developed (heat-development was carried out with 4 panel heaters set to 112° C.-119° C.-121° C.-121° C., 14 seconds in total) using a Fuji Medical Dry Laser Imager FM-DP L (mounted with a 660 nm semiconductor laser having a maximum output of 60 mW (IIIB)

(Evaluation of the Image)

The density of the resulting image was measured using a densitometer, and a characteristic curve of a density with respect to a logarithm of the exposure amount was formed. Fogging was determined as an optical density of the unexposed portion. Sensitivity was obtained as a relative value such that at first the exposure amount making it possible to obtain an optical density of 3.0 was determined, an inverse number thereof was calculated, and then the inverse number were expressed as a relative value when the sensitivity of the heat-developable photosensitive material 1 was set to 100. Also, the average contrast at optical densities of 1.5 and 3.0 was measured. The results are shown in Table 14.

(Evaluation of Printout Performances)

The photosensitive material after developing treatment was placed in a room kept at 25° C. under a humidity of 60% RH and allowed to stand under 100 Lux fluorescent light for 30 days. A difference between a fogging density just after development and a fogging density after 30 days under the aforementioned condition was evaluated as the printout performance (ability). The results obtained are shown in Table 14. It is desirable that an increase of fogging is small even in the case where the photosensitive material is allowed to stand in such a condition.

TABLE 14

| Photo-sensitive material | Emulsion No. | Content of silver iodide (mol %) | Particle size | Developing accelerator | Coating amount of the developing | Sensitivity | Fogging | Average contrast | Printout performance | Remarks |
|---|---|---|---|---|---|---|---|---|---|---|
| 1 | 1 | 12 | 40 nm | Unobserved | 0 | 20 | 0.17 | 3.0 | 0.02 | Comparative Example |
| 2 | " | " | " | 1–68 | 0.06 | 90 | 0.18 | 3.5 | 0.02 | Present invention |
| 3 | " | " | " | 4–60 | 0.12 | 85 | 0.17 | 3.6 | 0.03 | Present invention |
| 4 | " | " | " | 5–3 | 0.30 | 80 | 0.18 | 3.2 | 0.03 | Present invention |
| 5 | " | " | " | 6–41 | 0.03 | 95 | 0.18 | 3.7 | 0.02 | Present invention |
| 6 | " | " | " | 6–7 | 0.02 | 95 | 0.17 | 3.4 | 0.02 | Present invention |
| 7 | " | " | " | 1–68<br>6–7 | 0.03<br>0.015 | 100 | 0.17 | 3.5 | 0.03 | Present invention |
| 8 | " | " | " | 1–68<br>6–41 | 0.03<br>0.01 | 105 | 0.17 | 3.6 | 0.03 | Present invention |
| 9 | " | " | " | 1–68<br>4–60<br>5–3 | 0.03<br>0.06<br>0.10 | 95 | 0.18 | 3.4 | 0.02 | Present invention |
| 10 | 2 | 3.5 | " | Unobserved | 0 | 50 | 0.19 | 2.8 | 0.06 | Comparative Example |
| 11 | " | " | " | 1–68<br>6–7 | 0.03<br>0.015 | 70 | 0.23 | 3.0 | 0.12 | Comparative Example |
| 12 | 3 | 0 | " | Unobserved | 0 | 60 | 0.19 | 2.5 | 0.08 | Comparative Example |
| 13 | " | " | " | 1–68<br>6–7 | 0.03<br>0.01 | 85 | 0.25 | 2.8 | 0.14 | Comparative Example |

It is found from Table 14 that the heat-developable photosensitive materials of the invention have high sensitivity, low fogging, desirable gradation and high printout performance.

Example 2

<<Preparation of a Silver Halide Emulsion 4>>

4.3 ml of a 1 mass % potassium iodide solution was added to 1421 ml of distilled water, to which were then added 3.5 ml of sulfuric acid having a concentration of 0.5 mol/L and 36.7 g of gelatin phthalate. The obtained solution was kept at a solution temperature of 42° C. with stirring in a stainless reacting pot. To the solution, 195.6 ml of a solution A prepared by diluting 22.22 g of silver nitrate with distilled water and 218 ml of a solution B prepared by diluting 21.8 g of potassium iodide with distilled water were wholly added at a constant flow rate over 9 minutes. After that, 10 ml of a 3.5 mass % aqueous solution of hydrogen peroxide was added and further 10.8 ml of a 10 mass % aqueous solution of benzoimidazole was added to the resulting mixture.

Moreover, 187.6 ml of a solution C prepared by diluting 30.64 g of silver nitrate with distilled water and 400 ml of a solution D prepared by diluting 40 g of potassium bromide with distilled water were added to the foregoing mixture such that the solution C was wholly added at a constant flow rate over 12 minutes and the solution D was added using a controlled double jet method with keeping the solution at pAg 8.1. Thereafter, a solution E obtained by adding 130 ml of distilled water to 22.2 g of silver nitrate and 217 ml of a solution F obtained by diluting 21.7 g of potassium iodide with distilled water were added by using a controlled double jet method with keeping the solution at pAg 6.3. 10 minutes after the start of the addition of the solutions C and D, potassium iridium (III) hexachloride was added in such an amount of $1\times10^{-4}$ mol per 1 mol of silver. Also, 5 seconds after the addition of the solution C was finished, an aqueous solution of potassium iron (II) hexacyanide was all added in an amount $3\times10^{-4}$ mol per 1 mol of silver. The solution obtained was adjusted to pH 3.8 using sulfuric acid having a concentration of 0.5 mol/L. Then, the stirring was stopped and the solution was subjected to sedimentation/desalting/water-washing steps. The resulting solution was adjusted to pH 5.9 by using sodium hydroxide having a concentration of 1 mol/L to produce a silver halide dispersion having a pAg of 8.0.

5 ml of a methanol solution of 0.34 mass % 1,2-benzoisothiazolin-3-one was added to the foregoing silver halide dispersion with stirring and keeping the dispersion at 38° C. After one minute, the temperature of the obtained solution was raised at 47° C. 20 minutes after the temperature was raised, a methanol solution of sodium benzenethiosulfonate in an amount of $7.6\times10^{-5}$ mol per 1 mol of silver was added to the dispersion. Further, after 5 minutes, a methanol solution of a tellurium sensitizer B in an amount of $2.9\times10^{-4}$ mol per 1 mol of silver was added to the dispersion, and followed by ripening for 91 minutes. To the ripened solution were added 1.3 ml of a methanol solution of 0.8 mass % of N,N'-dihydroxy-N"-diethylmelamine and. Further, 4 minutes after the addition, a methanol solution of 5-methyl-2-mercaptobenzoimidazole in an amount of $4.8\times10^{-3}$ mol per 1 mol of silver and a methanol solution of 1-phenyl-2-heptyl-5-mercapto-1,3,4-triazole in an amount of $5.4\times10^{-3}$ mol per 1 mol of silver were added to the solution, to prepare a silver halide emulsion 4.

The particles in the prepared silver halide emulsion 4 were a pure silver iodide particles having an average sphere equivalent diameter of 0.040 μm and the coefficient of variation of sphere equivalent diameter of 18%.

<Preparation of Silver Halide Emulsions 5 to 17>

Silver halide emulsions 5 to 17 having the halogen structures described in Table 15 were prepared in the same manner as in the production of the silver halide emulsion 4 except that the halogen compositions of the solutions B, D and F were altered. As to the particle size of the silver halide of the emulsions, a silver halide having an average sphere equivalent diameter of 0.040 μm was produced by changing the temperature during the formation of particles.

<Preparation of Silver Halide Emulsions 18 to 21>

Emulsions in which particles were formed in the same manner as in the case of the silver halide emulsion 9 were subjected to sedimentation/desalting/water-washing steps after adding an aqueous potassium iodide solution in such a manner as to obtain the average iodine composition shown in Table 15. Thereby, silver halide emulsions 18 and 19 were prepared. The same procedures were carried out using the silver halide emulsion 6 to prepare silver halide emulsions 20 and 21.

Among these silver halide emulsions 5 to 21, the emulsions having a silver iodide structure had strong photoabsorption due to direct transition.

<Production of Heat-developable Photosensitive Materials 14 to 36>

Heat-developable photosensitive materials 14 to 36 as shown in Table 16 were produced in the same manner as in Example 1 except that the developing accelerator and the amount thereof were made the same as those of the heat-developable photosensitive material 7 or in the manner such that no developing accelerator was added. The resulting heat-developable photosensitive materials were evaluated in the following manner.

(Exposure of the Heat-developable Photosensitive Material)

The resulting heat-developable photosensitive materials were subjected to exposure treatment which was carried out as follows.

An NLHV 3000E semiconductor laser manufactured by Nichia Corporation was mounted as a semiconductor laser light source on the exposure section of a Fuji Medical Dry Laser Imager FM-DPL. The illuminance of the laser light on the surface of the heat-developable photosensitive material was altered between 0 and 1 mW/mm$^2$ to 1000 mW/mm$^2$ by restricting the diameter of the laser beam to expose the heat-developable photosensitive material to the light for $10^{-6}$ seconds. The emission wavelength of the laser light was 405 nm.

(Development of the Heat-developable Photosensitive Material)

The exposed heat-developable photosensitive material was heat developed in the following manner.

The photosensitive material was heat-developed using 4 panel heaters, which were set to 112° C.-110° C.-110° C.-110° C., for 14 seconds in total in the Fuji Medical Dry Laser Imager FM-DPL. Each sample was evaluated in the same manner as in Example 1. The results are shown in Table 16.

TABLE 15

| Emulsion No. | Content of silver iodide of core (%) | Content of first shell silver iodide (%) | Content of second shell silver iodide (%) | Average content of silver iodide (%) | Direct transition absorption derived from the crystal structure of silver iodide | Particle size |
|---|---|---|---|---|---|---|
| 4 | 100 | 100 | 100 | 100 | Observed | 40 nm |
| 5 | 95 | 95 | 95 | 95 | " | " |
| 6 | 40 | 40 | 40 | 40 | Unobserved | " |
| 7 | 10 | 10 | 10 | 10 | " | " |
| 8 | 3.5 | 3.5 | 3.5 | 3.5 | " | " |
| 9 | 0 | 0 | 0 | 0 | " | " |
| 10 | 0 | 0 | 100 | 30 | Observed | " |
| 11 | 0 | 100 | 0 | 40 | " | " |
| 12 | 0 | 100 | 100 | 70 | " | " |
| 13 | 100 | 0 | 0 | 30 | " | " |
| 14 | 100 | 100 | 0 | 70 | " | " |
| 15 | 0 | 0 | 40 | 8 | Unobserved | " |
| 16 | 0 | 40 | 0 | 12 | " | " |
| 17 | 40 | 0 | 0 | 8 | " | " |
| 18 | | Conversion method | | 10 | " | " |
| 19 | | " | | 30 | " | " |
| 20 | | " | | 60 | Observed | " |
| 21 | | " | | 90 | " | " |

TABLE 16

| Photon-sensitive material | Emul-sion No. | Content of silver iodide (mol %) | Direct transition absorption derived from the crystal structure of silver iodide | Developing accelerator and its amount to be added | Sensi-tivity | Fog-ging | Average contrast | Printout performance | Remarks |
|---|---|---|---|---|---|---|---|---|---|
| 14 | 4 | 100 | Observed | Same as in the case of the photosensitive material 7 | 100 | 0.17 | 3.5 | 0.00 | Example |
| 15 | " | " | " | Non-added | 20 | 0.17 | 3.0 | 0.00 | Comparative Example |
| 46 | 5 | 95 | " | Same as in the case of the photosensitive material 7 | 105 | 0.17 | 3.5 | 0.01 | Example |
| 17 | 6 | 40 | Unobserved | Same as in the case of the photosensitive material 7 | 60 | 0.17 | 3.4 | 0.02 | " |
| 18 | 7 | 10 | " | Same as in the case of the photosensitive material 7 | 45 | 0.18 | 3.3 | 0.03 | " |
| 19 | 8 | 3.5 | " | Same as in the case of the photosensitive material 7 | 35 | 0.25 | 3.0 | 0.12 | Comparative Example |
| 20 | " | " | " | Non-added | 20 | 0.19 | 2.8 | 0.06 | Comparative Example |
| 21 | 9 | 0 | " | Same as in the case of the photosensitive material 7 | 40 | 0.26 | 2.8 | 0.14 | Comparative Example |
| 22 | 10 | 30 | Observed | Same as in the case of the photosensitive material 7 | 75 | 0.18 | 3.3 | 0.02 | Example |
| 23 | 11 | 40 | " | Same as in the case of the photosensitive material 7 | 80 | 0.18 | 3.4 | 0.02 | " |
| 24 | 12 | 70 | " | Same as in the case of the photosensitive material 7 | 95 | 0.17 | 3.5 | 0.01 | " |
| 25 | " | " | " | Non-added | 35 | 0.17 | 3.0 | 0.01 | Comparative Example |
| 26 | 13 | 30 | " | Same as in the case of the photosensitive material 7 | 75 | 0.18 | 3.3 | 0.02 | Example |
| 27 | 14 | 70 | " | Same as in the case of the photosensitive material 7 | 95 | 0.17 | 3.5 | 0.01 | " |
| 28 | 15 | 8 | Unobserved | Same as in the case of the photosensitive material 7 | 40 | 0.19 | 3.2 | 0.03 | " |
| 29 | 16 | 12 | " | Same as in the case of the photosensitive material 7 | 50 | 0.18 | 3.3 | 0.03 | " |
| 30 | " | " | " | Non-added | 12 | 0.18 | 2.9 | 0.03 | Comparative Example |
| 31 | 17 | 8 | " | Same as in the case of the photosensitive material 7 | 40 | 0.19 | 3.2 | 0.03 | Example |
| 32 | 18 | 10 | " | Same as in the case of the photosensitive material 7 | 45 | 0.18 | 3.3 | 0.03 | " |
| 33 | 19 | 30 | " | Same as in the case of the photosensitive material 7 | 55 | 0.18 | 3.3 | 0.02 | " |
| 34 | 20 | 60 | Observed | Same as in the case of the photosensitive material 7 | 90 | 0.17 | 3.5 | 0.02 | " |
| 35 | 21 | 90 | " | Same as in the case of the photosensitive material 7 | 95 | 0.17 | 3.5 | 0.01 | " |
| 36 | " | " | " | Non-added | 15 | 0.17 | 3.5 | 0.01 | Comparative Example |

Table 16 shows that the heat-developable photosensitive materials of the present invention have excellent performance also in the case of exposure to a blue laser.

Example 3

A pure silver iodide emulsion 22 having an average particle size of 100 nm was produced in the same manner as in the production of the silver halide emulsion 4 of Example 2 except that the temperature during the formation of particles was altered. Further, heat-developable photosensitive materials 37, 38 and 39 described in Table 17 were produced in the same manner as in the heat-developable photosensitive material 14 except that the coating amount of the silver iodide emulsion was altered.

Exposure treatment and the evaluation of photographic characteristics were carried out in the same manner as in Example 2. Here, the maximum optical density after heat developing was designated as Dmax. The results are shown in Table 17.

TABLE 17

| Photon-sensitive material | Exposure condition | Content of silver iodide | Content of Br | Particle size of the silver halide | Coating amount of the silver halide (converted into Ag) | Direct transition absorption derived from the crystal structure of silver iodide | Fogging | Sensitivity | Dmax |
|---|---|---|---|---|---|---|---|---|---|
| 1 | Laser exposure 405 nm | 100 | 0 | 40 nm | 0.091 mg/m$^2$ | observed | 0.18 | 100 | 4.2 |

TABLE 17-continued

| Photon-sensitive material | Exposure condition | Content of silver iodide | Content of Br | Particle size of the silver halide | Coating amount of the silver halide (converted into Ag) | Direct transition absorption derived from the crystal structure of silver iodide | Fogging | Sensitivity | Dmax |
|---|---|---|---|---|---|---|---|---|---|
| 37 | Laser exposure 405 nm | 100 | 0 | 100 nm | " | observed | 0.18 | Unevaluated because no density was seen | 2.0 |
| 38 | Laser exposure 405 nm | 100 | 0 | " | 0.18 mg/m$^2$ | observed | 0.18 | 120 | 3.2 |
| 39 | Laser exposure 405 nm | 100 | 0 | " | 0.36 mg/m$^2$ | observed | 0.17 | 75 | 3.6 |

As is clear from Table 17, only insufficient sensitivity is obtained and Dmax is also lowered when the average particle size of the silver iodide emulsion is 100 nm. Because absorption of a silver halide is usually proportion to the cube of an average particle size, it is reasonable that higher sensitivity is obtained along with an increase in the size of the silver halide. However, the highly iodinated silver emulsion does not bring about such a result in the present invention.

In the present invention, a decrease in average particle size ensures higher sensitization for its size, raises Dmax simultaneously and is therefore desirable.

Example 4

A pure silver iodide emulsion 23 having an average particle size of 70 nm and a coefficient of variation of 8% was produced in the same manner as in the production of the silver halide emulsion 4 of Example 2 except that the temperature during the formation of particles was raised.

The temperature during the formation of particles was altered in the same manner to thereby produce a pure silver iodide emulsion 24 having an average particle size of 28 nm and a coefficient of variation of 8%.

A heat-developable photosensitive material 40 was produced in a same manner as in the heat-developable photosensitive material 14, except that the silver halide emulsions 4, 23 and 24 were mixed in a ratio of 60:15:25 respectively and the mixed halide emulsion was added in place of the silver halide emulsion 4. The photosensitive material 40 was evaluated in the same manner as in Example 2 and as a result, desirable results were obtained. Also, the average contrast was 2.7.

A heat-developable photosensitive material 41 was likewise produced in a same manner as in the heat-developable photosensitive material 41 except that the silver halide emulsions 12 and 23 were blended in a ratio of 85:15. The photosensitive material was evaluated in the same manner as in Example 2 and as a result, desirable results were obtained.

As described above, the silver halide emulsions of the invention may be mixed among them in a desirable ratio.

Example 5

Silver halide emulsions 25 to 42 were prepared in the same manner as in the production of the silver halide emulsions 4 to 21 of Example 2 except that potassium iodate was added in an amount of $5\times10^{-4}$ mol per 1 mol of silver and potassium thiocyanate was added in an amount of $2\times10^{-3}$ mol per 1 mol of silver.

Using these emulsions, heat-developable photosensitive materials 42 to 59 were produced in the same manner as in the production of the heat-developable photosensitive material 14 of Example 2. These photosensitive materials were evaluated in the same manner as in Example 2. As a result, the sensitivity was improved without deteriorations in fogging and printout performance were caused, and desirable results were obtained.

Example 6

A heat-developable photosensitive material 60 was produced in the same manner as in the case of the heat-developable photosensitive material 14 of Example 2 except that the fluorine containing surfactants F-1, F-2, F-3 and F-4, which were used for the backside protective layer and emulsion side protective layer, were altered to fluorine containing surfactants F-5, F-6, F-7 and F-8 respectively.

The photosensitive material was evaluated in the same manner as in Example 2 and as a result, the same desirable results as in the case of the heat-developable photosensitive material 14 were obtained.

According to the invention, a heat-developable photosensitive material comprising a silver halide emulsion containing high silver iodide which has high sensitivity and ensuring a high quality image, and a heat developing method using the heat-developable photosensitive material can be provided.

What is claimed is:

1. A heat-developable photosensitive material comprising at least a photosensitive silver halide, a nonphotonsensitive organic silver salt, a reducing agent, a developing accelerator, a color adjusting agent and a binder on a support, wherein said photosensitive material has an average contrast between 2.5 and 6 at a density between 1.5 and 3.0;

said photosensitive silver halide includes silver iodide at 5 mol % to 100 mol %; and the average particle size of said photosensitive silver halide is 5 nm to 80 nm;

the developing accelerator is a compound represented by the following formula (III):

Formula (III)

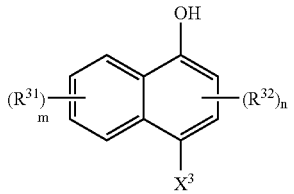

wherein, in the formula (III), $X^3$ represents a hydrogen atom or a substituent, each of $R^{31}$ and $R^{32}$ independently represents a hydrogen atom or substituent, m denotes an integer from 0 to 4 and n denotes an integer from 0 to 2;

and the reducing agent is represented by the following formula (VII):

Formula (VII)

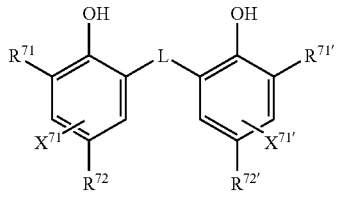

wherein each of $R^{71}$ and $R^{71'}$ independently represents an alkyl group having 1 to 20 carbon atoms, each of $R^{72}$ and $R^{72'}$ independently represents a hydrogen atom or a substituent with which a benzene ring may be substituted, each of $X^{71}$ and $X^{71'}$ independently represent a hydrogen atom or a substituent with which a benzene ring may be substituted, L represents one of —S— and —$CHR^{73}$— and $R^{73}$ represents one of a hydrogen atom and an alkyl group having 1 to 20 carbon atoms.

2. The heat-developable photosensitive material according to claim 1, wherein said photosensitive silver halide includes the silver iodide at 40 mol % to 100 mol %.

3. The heat-developable photosensitive material according to claim 1, wherein the nonphotosensitive organic silver salt is a fatty acid salt containing 50 mol % or more of silver behenate.

4. The heat-developable photosensitive material according to claim 1, wherein the developing accelerator raises sensitivity at a density of 1.0 by 0.05 or more when 5 mol % of the reducing agent is substituted by the compound represented by formula (III).

5. A heat developing method for a heat-developable photosensitive material comprising steps of:

preparing a heat-developable photosensitive material, the heat-developable photosensitive material comprising at least a photosensitive silver halide, a nonphotonsensitive organic silver salt, a reducing agent, a developing accelerator, a color adjusting agent and a binder on a support, wherein the photosensitive material has an average contrast between 2.5 and 6 at a density between 1.5 and 3.0;

with the photosensitive silver halide including silver iodide at 5 mol % to 100 mol % and the average particle size of said photosensitive silver halide being 5 nm to 80 nm;

image exposing the heat-developable photosensitive material; and heat-developing the heat-developable photosensitive material at a maximum temperature of between 100° C. and 120° C.;

wherein the developing accelerator is a compound represented by the following formula (III):

Formula (III)

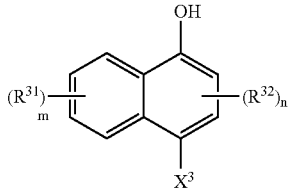

wherein, in the formula (III), $X^3$ represents a hydrogen atom or a substituent, each of $R^{31}$ and $R^{32}$ independently represents a hydrogen atom or substituent, m denotes an integer from 0 to 4 and n denotes an integer from 0 to 2; and said reducing agent is represented by the following formula (VII):

Formula (VII)

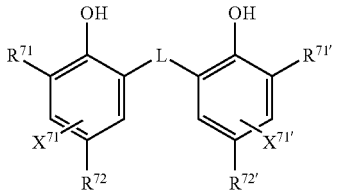

wherein each of $R^{71}$ and $R^{71'}$ independently represents an alkyl group having 1 to 20 carbon atoms, each of $R^{72}$ and $R^{72'}$ independently represents a hydrogen atom or a substituent with which a benzene ring may be substituted, each of $X^{71}$ and $X^{71'}$ independently represent a hydrogen atom or a substituent with which a benzene ring may be substituted, L represents one of —S— and —$CHR^{73}$— and $R^{73}$ represents one of a hydrogen atom and an alkyl group having 1 to 20 carbon atoms.

6. The heat developing method according to claim 5, wherein the heat-developable photosensitive material is heat-developed at a maximum temperature of 105° C. to 115° C.

7. The heat developing method according to claim 5, wherein the developing accelerator raises sensitivity at a density of 1.0 by 0.05 or more when 5 mol % of the reducing agent is substituted by the compound.

* * * * *